US008439586B2

(12) United States Patent
Sandahl et al.

(10) Patent No.: US 8,439,586 B2
(45) Date of Patent: May 14, 2013

(54) POWERED INTERNAL FEED ROLLER

(75) Inventors: Jeffrey E. Sandahl, Buffalo, MN (US); Timothy J. Wessels, Victoria, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 363 days.

(21) Appl. No.: 12/811,405

(22) PCT Filed: Sep. 26, 2008

(86) PCT No.: PCT/US2008/077832

§ 371 (c)(1), (2), (4) Date: Oct. 7, 2010

(87) PCT Pub. No.: WO2009/088539

PCT Pub. Date: Jul. 16, 2009

(65) Prior Publication Data

US 2011/0020050 A1 Jan. 27, 2011

Related U.S. Application Data

(60) Provisional application No. 61/019,448, filed on Jan. 7, 2008.

(51) Int. Cl.
*B43K 5/06* (2006.01)

(52) U.S. Cl.
USPC ..... 401/176; 401/171; 401/197

(58) Field of Classification Search ..... 401/171, 401/176–182, 197
See application file for complete search history.

(56) References Cited

U.S. PATENT DOCUMENTS

RE26,180 E * 4/1967 Frenzel et al. ..... 222/39
3,635,378 A 1/1972 DeHart
4,615,469 A * 10/1986 Kishi et al. ..... 222/327

(Continued)

FOREIGN PATENT DOCUMENTS

DE 29804402 U1 5/1998
GB 2172933 A 10/1986

(Continued)

OTHER PUBLICATIONS

International Search Report and Written Opinion issued in PCT/US2008/077832, Jan. 15, 2009, 13 pages.

(Continued)

*Primary Examiner* — David Walczak
*Assistant Examiner* — Jennifer C Chiang
(74) *Attorney, Agent, or Firm* — Westman, Champlin & Kelly, P.A.

(57) ABSTRACT

A hand-held, battery powered liquid applicator having an on-board reservoir. An electric motor drives a piston in the reservoir via a pinion gear member and rack gear. A gear shifter may disengage the pinion gear member from the rack gear. A battery compartment may have a door has recess to enable a user to grasp a dry cell located farthest from the door. The rack gear may have modified profile teeth at the end of travel to allow the pinion gear member to slip when the piston is urged past the end of travel. The piston may have a length substantially equal to a characteristic length of the reservoir. Liquid may be drawn into the reservoir by powered or manual retraction of the piston and liquid may be delivered from the reservoir to an applicator head by powered or manual motion of the piston into the reservoir.

15 Claims, 59 Drawing Sheets

U.S. PATENT DOCUMENTS

| | | | | |
|---|---|---|---|---|
| 4,732,503 | A | 3/1988 | Bader et al. | |
| 5,295,614 | A | 3/1994 | Chang | |
| 5,503,307 | A | 4/1996 | Wilson et al. | |
| 5,909,830 | A * | 6/1999 | Bates et al. | 222/327 |
| D417,552 | S | 12/1999 | Snetting et al. | |
| 7,556,447 | B2 * | 7/2009 | Bruggeman et al. | 401/197 |

FOREIGN PATENT DOCUMENTS

| | | | |
|---|---|---|---|
| JP | 6047328 | A | 2/1994 |
| JP | 9131557 | A | 5/1997 |
| JP | 11276976 | A | 12/1999 |

OTHER PUBLICATIONS

Examination Report for European Patent Application No. 08 870 384.8, dated Jul. 25, 2011.

English Translation of the First Office Action for Counterpart Chinese Patent Application No. 80088127828.6.

Communication pursuant to Article 94(3) EPC from European Patent Application No. 8 870 348.8-2424, dated Apr. 24, 2012, 4 pages.

Examiner's First Report for Australian Patent Application No. 2008347014, dated May 7, 2012, 2 pages.

English translation for first Chinese Office Action for Chinese Patent Application No. 200880127828.6, dated Jan. 18, 2012, 2 pages.

* cited by examiner

*Fig, 41*

POWERED INTERNAL FEED ROLLER

CROSS REFERENCE TO RELATED APPLICATION

This application claims the benefit of U.S. Provisional Application No. 60/019,448, filed Jan. 7, 2008, the entire contents of which are hereby expressly incorporated by reference.

FIELD OF THE INVENTION

The present invention relates to the field of paint applicators, more particularly, to internally fed paint applicators such as rollers and pads. Stated another way, the present invention relates to the field of liquid coating applicators including, but not limited to painting equipment. More specifically, the invention relates to devices and methods for applying liquids including, but not limited to, paint and similar coatings (such as liquid stain) using an internally-fed powered roller or other liquid coating applicator head.

BACKGROUND OF THE INVENTION

In the past, paint rollers have been used to apply paint to surfaces to be protected or beautified. Internal feed rollers with an on-board paint reservoir are known, one example of which is a product offered by Wagner Spray Tech Corporation under the Paint Mate trademark. Other internal feed rollers with a remote paint reservoir are known, one example of which is another product offered by Wagner Spray Tech Corporation under the Roll N Go trademark.

Prior art paint applicators include conventional rollers, pad applicators and brushes. One advance in the prior art included a single stage internal feed paint roller, exemplified by U.S. Pat. No. 4,732,503 and Des 417,552, the entire contents of each of which are hereby incorporated by reference. Such internal feed paint applicators have found commercial success through wide acceptance and use by consumers. However, such applicators require manual effort to move the coating material from the reservoir to the applicator head.

SUMMARY OF THE INVENTION

The present invention is an improvement over the manually operated prior art internal feed liquid applicators in that it provides a liquid applicator which is electrically powered, reducing the required effort on the part of the operator. The liquid applicator of the present invention is unlike the prior art applicators in that it includes an electric drive to move a piston in a liquid reservoir. The electrical drive is powered by on-board batteries, and the present invention may be manually operated in the event of missing or discharged batteries.

In one embodiment, the present invention is a new apparatus having an on-board paint reservoir for quickly and conveniently applying paint using a hand-held battery powered drive mechanism to move a piston in the apparatus capable of both drawing paint into the reservoir and delivering paint to the applicator.

More particularly, in one aspect, the present invention is an improvement in combination with a hand held, internal feed coating apparatus of the type having an on-board coating reservoir and an internal piston having a rack gear operable to move the piston to deliver coating material to an outlet of the reservoir, where the improvement in combination therewith includes a drive mechanism including: a) an electric motor; and b) an engagement mechanism having i) a pinion gear member rotatably driven by the electric motor and selectively engageable with the rack gear, and ii) a gear shifter operable to move the pinion gear member into and out of engagement with the rack gear wherein the motor is operable to move the piston to deliver coating material when the motor is energized and the gear shifter holds the pinion gear member in engagement with the rack gear and wherein the piston is free to move independently of the drive mechanism when the gear shifter holds the pinion gear member out of engagement with the rack gear.

The apparatus of the present invention may include a paint applicator connected to the outlet of the reservoir. The paint applicator may be a roller.

The apparatus of the present invention may also include at least one electrical dry cell selectively electrically connectable to the electric motor.

The apparatus of the present invention may also include an electrical switch connected between the at least one electrical dry cell and the electric motor. The electrical switch may include means for selecting a direction of motion of the motor.

The apparatus of the present invention may also include c) a battery compartment including i) a battery access door, and ii) a battery compartment frame sized and shaped to receive and retain a plurality of dry cells. The battery compartment frame may have an internal contour shaped to hold at least some of the dry cells in desired positions within the battery compartment with at least one dry cell located farthest away from the battery access door, and the internal contour may also have a recess to allow a user to grasp the at least one dry cell located farthest away from the battery access door for removal of that dry cell. The at least one dry cell located farthest away from the battery access door includes one dry cell that is typically the first dry cell to be installed in the battery compartment and the last dry cell to be removed from the battery compartment.

The apparatus of the present invention may also include d) a housing enclosing the electric motor, engagement mechanism and battery compartment and wherein the battery access door may also include i) a hinge on one edge thereof, and ii) a projecting tab on an opposite edge thereof wherein the projecting tab is captured by a threaded ring received on the housing. The battery access door may be released for opening when the threaded ring is moved out of the way of the projecting tab.

The housing and the projecting tab on the battery access door may have cooperating interfering edges to retain the battery access door in the closed position while allowing a user to open the battery access door by moving the interfering edges out of interference. The battery access door may also have at least one lip projecting outward of the battery access door and housing to enable a user to open the battery access door by manually urging the lip away from the housing.

In another aspect of the present invention, the engagement mechanism may include a selector switch connected to the gear shifter to selectively move the pinion gear member into and out of engagement with the rack gear.

In another aspect of the present invention, the pinion gear member may include a flange and the gear shifter may be formed by a pair of axial shifter halves with a recess receiving the flange for controlling an axial position of the pinion gear member.

In another aspect of the present invention, the engagement mechanism may include a guide ring preventing rotational motion of the gear shifter.

Stated another way, in the practice of the present invention the pinion gear member may include the flange and the engagement mechanism may include i) a pair of axial shifter halves each having a depending recess receiving the flange for controlling an axial position of the pinion gear member and each having a radially outwardly directed projection and each having a radially inwardly directed projection, ii) a guide ring having a pair of axially oriented channels, with each channel receiving one of the radially outwardly directed projections to prevent rotational motion of the pair of axial shifter halves while allowing axial motion thereof, and iii) a selector switch having a pair of helical grooves, with each groove receiving one of the radially inwardly directed projections such that rotation of the selector switch causes axial motion of the pair of shifter halves and the pinion gear member between an engaged position and a disengaged position with respect to the rack gear.

The gear shifter may have an internal wall and the engagement mechanism may further include iv) a spring located between the selector switch and the internal wall biasing the axial shifter halves away from the selector switch.

The drive mechanism may include a drive spindle selectively rotated by the electric motor wherein the drive spindle has at least one spline coupled to the pinion gear member for rotationally driving the pinion gear member. The internal wall of the gear shifter may have a central aperture receiving a circular cross section shaft extension of the drive spindle.

The apparatus of the present invention may further include a housing enclosing the drive mechanism and wherein the selector switch is journaled for rotation in the housing.

The apparatus of the present invention may further include a detent mechanism located between the selector switch and the housing for retaining the selector switch in a first predetermined angular position with respect to the housing. The detent mechanism may be formed by a recess on one of the selector switch and housing with a mating protuberance on the other of the selector switch and housing such that the protuberance is received in the recess when the selector switch is in the first predetermined angular position with respect to the housing.

In the practice of the present invention the selector switch holds the pinion gear member out of engagement with the rack gear when the selector switch is in the first predetermined angular position. The selector switch is movable to a second predetermined angular position in which the pinion gear member is engaged with the rack gear. A spring may be used to urge the selector switch to the second predetermined angular position.

A further aspect of the present invention may include the rack gear having at least one modified profile tooth located at each of the ends of travel of the piston into and out of the reservoir, the at least one modified profile tooth having a height less than other teeth in the rack gear and angled towards a central region of the rack gear. Preferably there are two modified profile teeth at each end of travel. In this aspect of the present invention, the pinion gear member may be located adjacent one of the modified profile teeth when the piston is at the end of travel such that the pinion gear and rack gear slip with respect to each other when the electric motor drives the pinion gear in a direction to urge the piston past the end of travel. When the piston is at the end of travel and the electric motor drives the pinion gear in a direction to move the piston away from the end of travel and towards a central region of the rack gear, the pinion gear member will initially engage a modified profile tooth and subsequently engage non-modified profile teeth in the rack gear to drive the piston away from the end of travel.

In another aspect, the housing of the present invention may enclose the electric motor, engagement mechanism and battery compartment and the present invention may include a pair of resilient members located between the piston and housing, with one located between a distal portion of the piston and the housing, and the other located between a proximal portion of the piston and the housing. In this aspect, the other member is located between the knob and the housing. Each of the pair of resilient members may be formed by an O-ring mounted on the piston for movement therewith. When the piston is located at either end of travel, the respective one of the resilient members is compressed by contact with the housing and urges the piston towards the central region of the rack gear.

While two embodiments are disclosed, other embodiments of the present invention will become apparent to those skilled in the art from the following detailed description and the drawings portraying illustrative embodiments of the invention. Accordingly, the drawings and detailed description are to be regarded as illustrative in nature and not restrictive.

DETAILED DESCRIPTION

Figure 1:
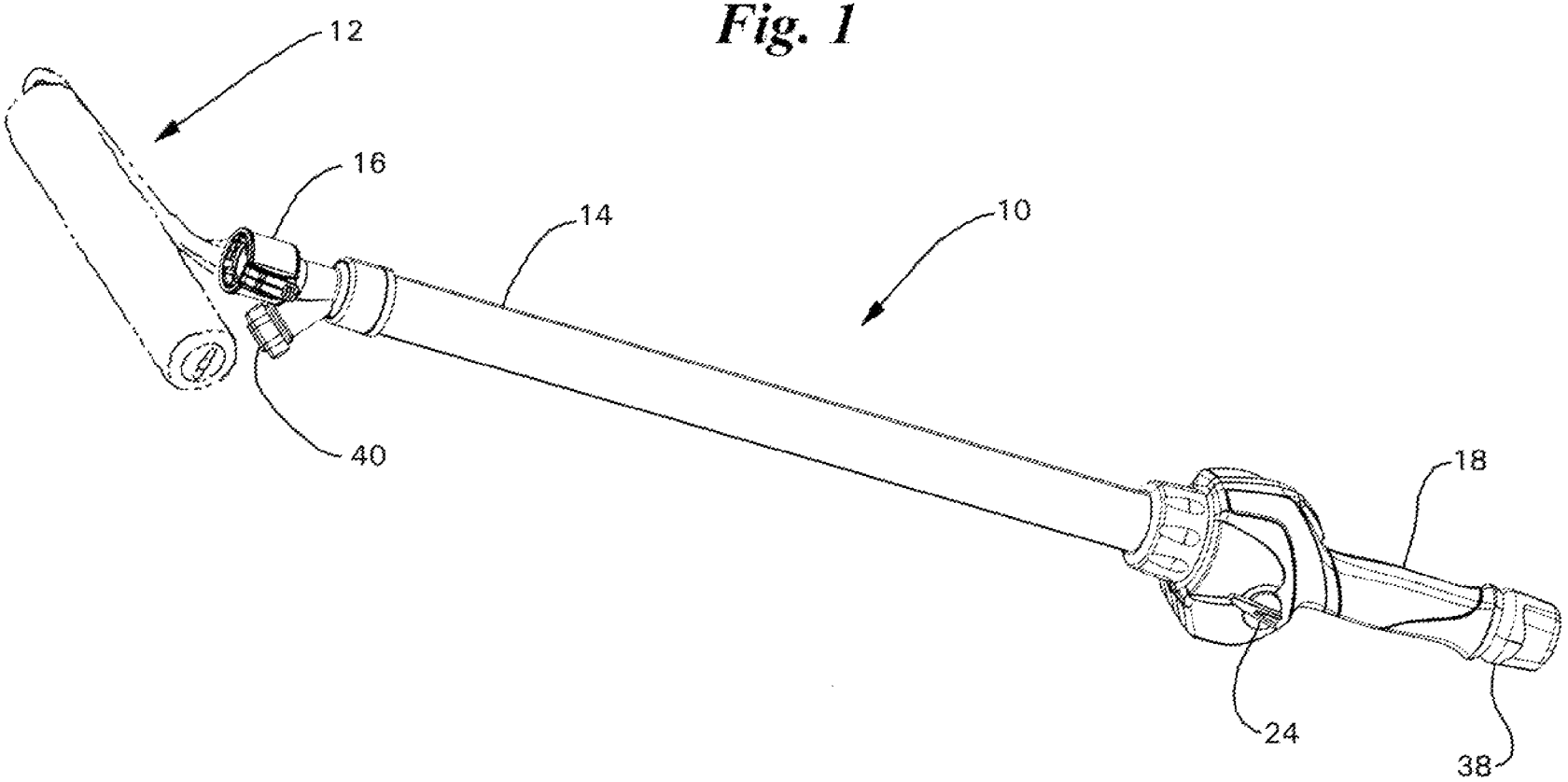
FIG. 1 shows a perspective view of an embodiment of the powered internal feed apparatus of the present invention along with a roller attachment in phantom.

Referring now to the drawings, and most particularly to FIG. 1, a powered internal feed apparatus 10 of the present invention is shown as a first embodiment along with a roller attachment 12 in phantom. It is to be understood that other types of paint applicators than rollers may be used with the present invention, including, but not limited to pad applicators (not shown). The apparatus 10 of the present invention includes a cylinder 14, an outlet 16, and a handle 18. As may be seen most clearly in FIG. 2, apparatus 10 also includes a piston 20 received in the cylinder 14. Apparatus 10 has a coating reservoir 15 made up of cylinder 14 and piston 20.

Figure 2:
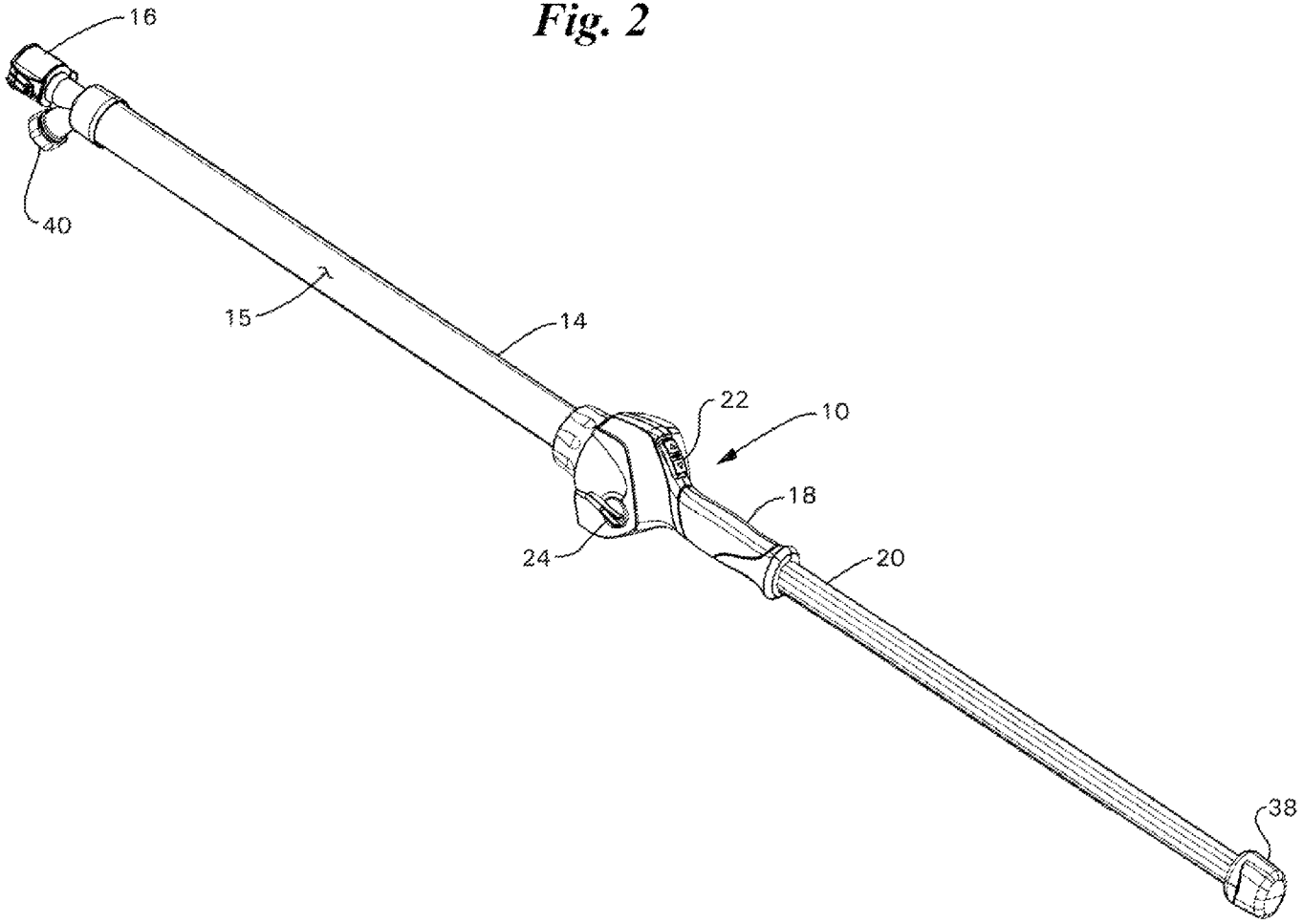
FIG. 2 is a perspective view of the powered internal feed apparatus shown in FIG. 1, except with a piston retracted out of a reservoir as it would appear with the reservoir filled with coating material.
Figure 3:
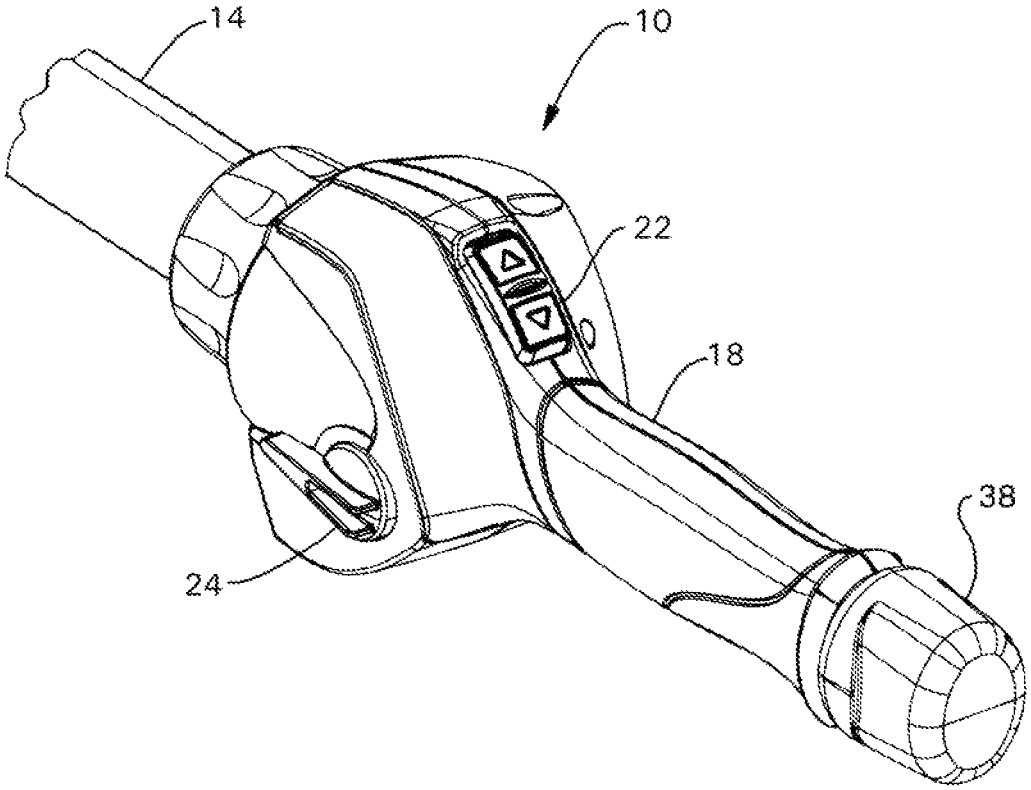
FIG. 3 is an enlarged fragmentary perspective view of an end portion of the powered internal feed apparatus of FIG. 1.
Figure 4:
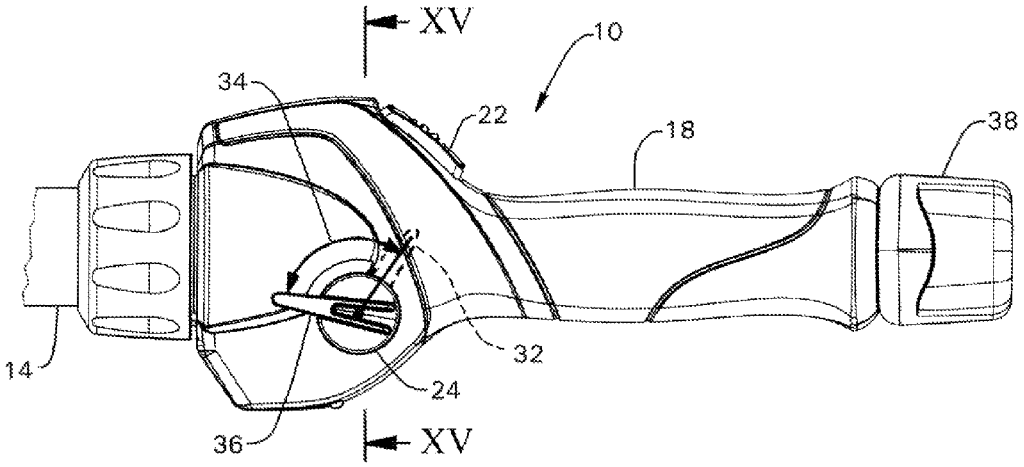
FIG. 4 is a fragmentary side elevation view of the end portion shown in FIG. 2.
Figure 32:
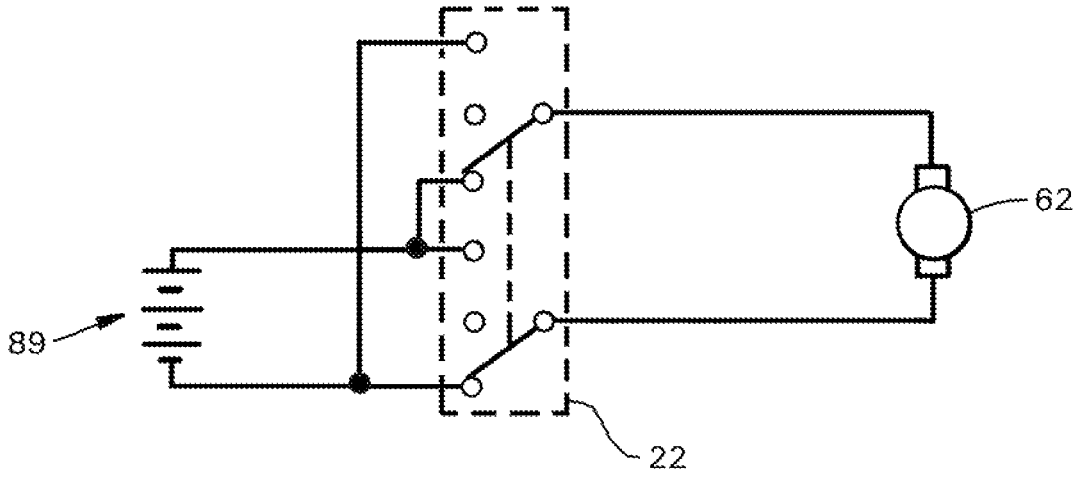
FIG. 32 is an electrical schematic of the powered internal feed apparatus of the present invention.

Referring now also to FIGS. 3 and 4, apparatus 10 has a double pole, double throw electric switch 22 with a center OFF position, and momentary ON action, to provide a user with the option to advance the piston 20 into the cylinder 14 by depressing (rocking) the switch 22 into a "forward" condition or to retract the piston 20 out from the cylinder 14 by depressing the switch 22 into a "reverse" condition. Releasing the switch 22 allows it to return to the center OFF position. FIG. 2 illustrates the piston 20 fully retracted from the cylinder 14. FIG. 32 contains an electrical schematic for apparatus 10.

Figure 5:
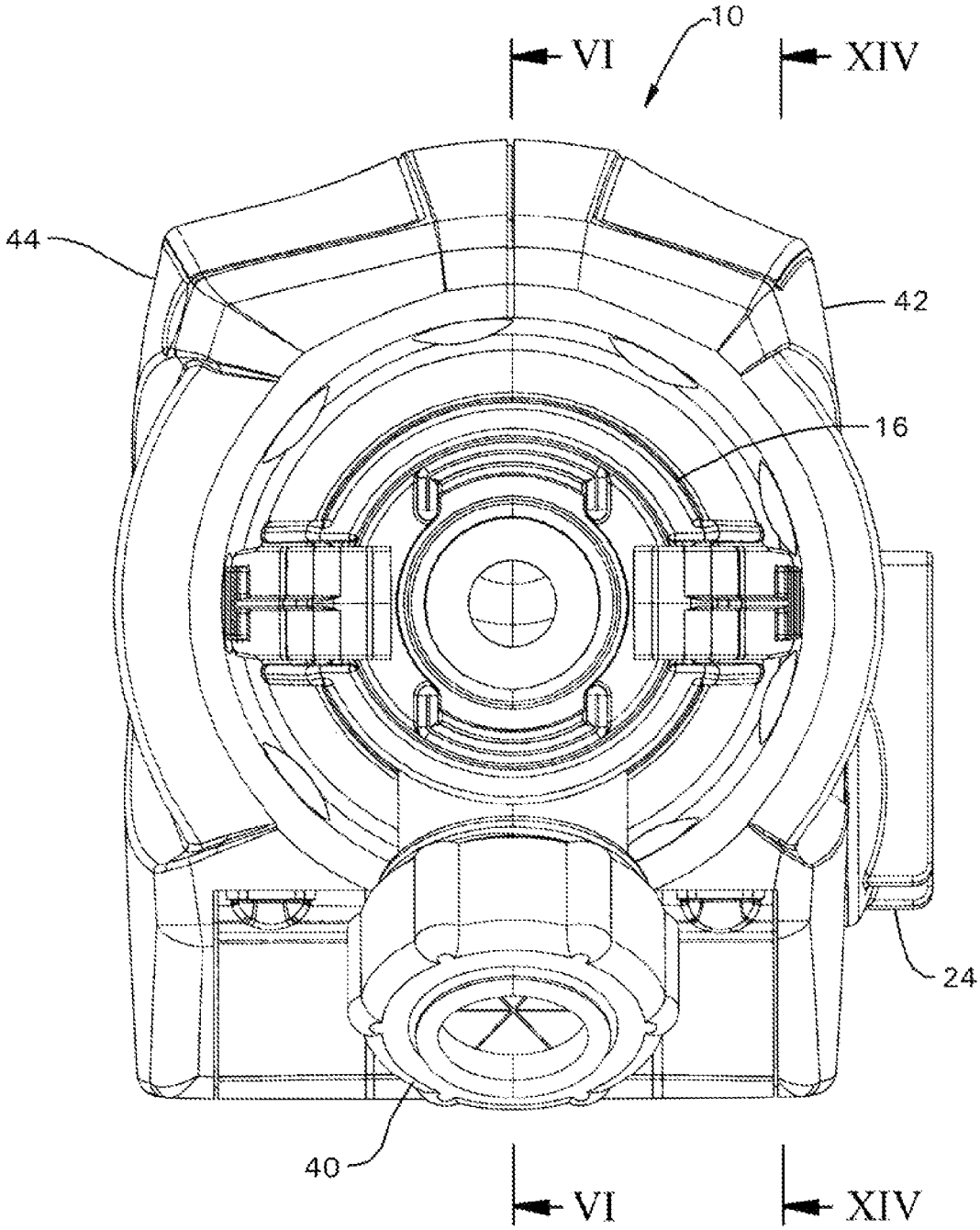
FIG. 5 is an end view of the powered internal feed apparatus shown in FIG. 1.
Figure 6:
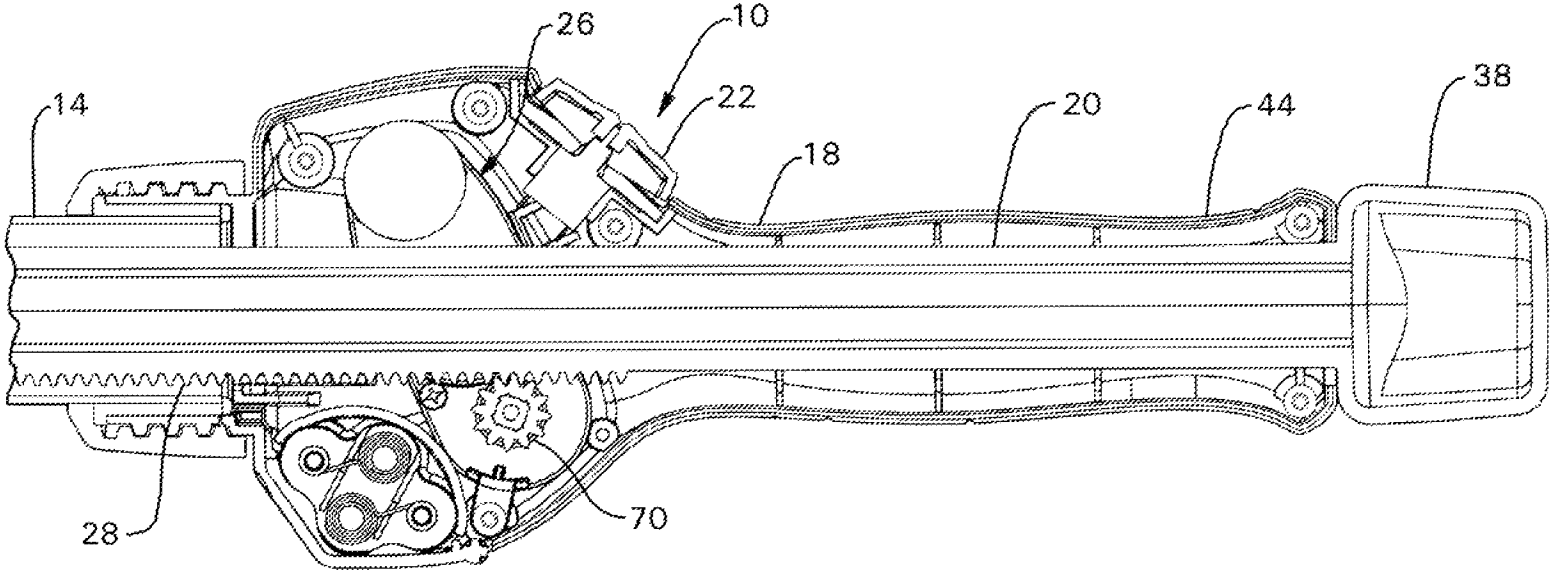
FIG. 6 is fragmentary side section view taken along line VI-VI of FIG. 5.
Figure 7:
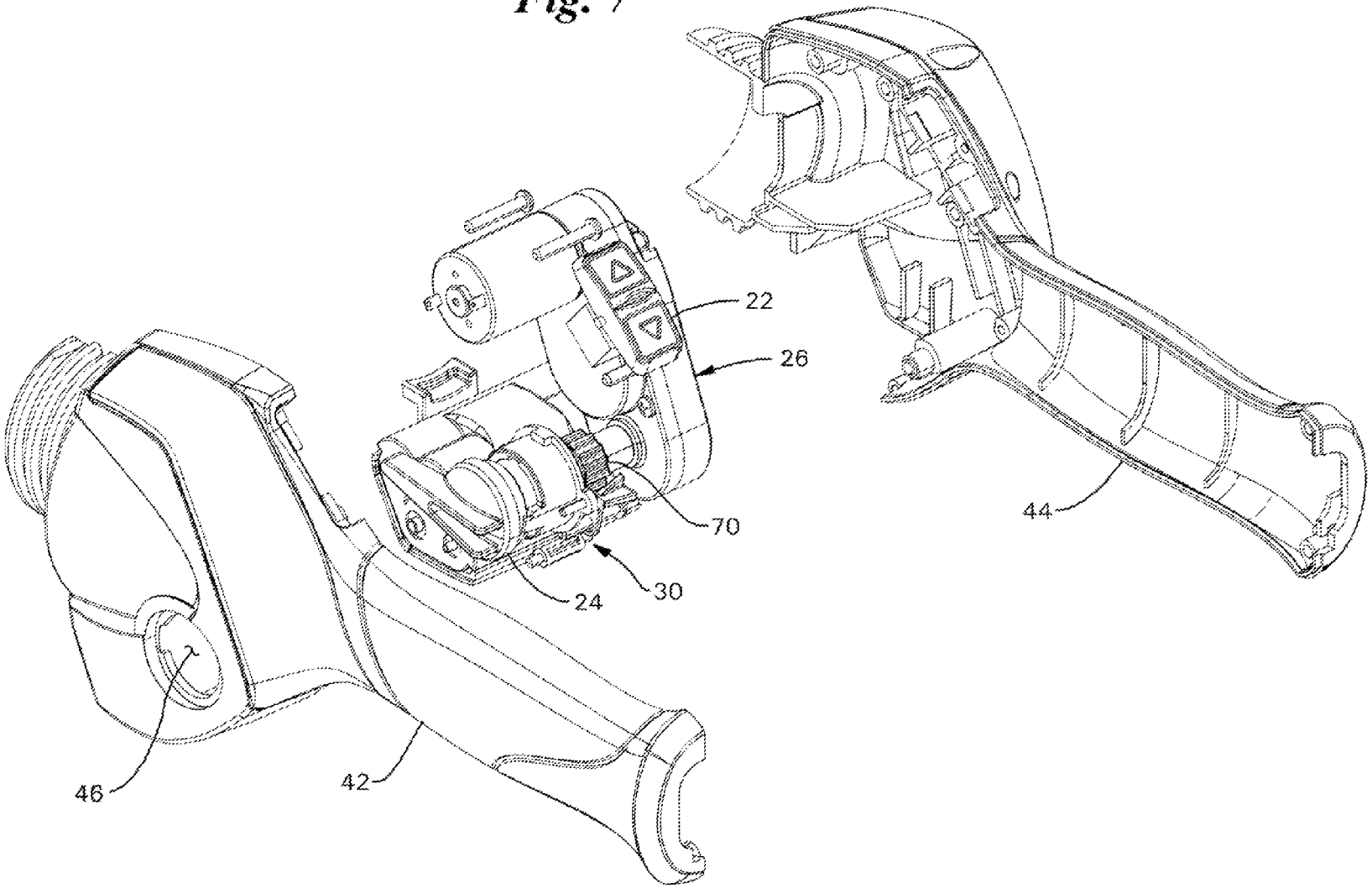
FIG. 7 is a partially exploded perspective view of two housing halves and a drive mechanism from the end portion of the powered internal feed apparatus illustrating certain aspects of the present invention.

Referring now also to FIGS. 5, 6 and 7, apparatus 10 also preferably includes a mechanical selector switch 24 for engaging and disengaging a drive mechanism 26 (described infra) from a rack gear 28 on the piston 20. The selector switch 24 is part of an engagement mechanism 30 (also described in more detail, infra).

In reference to FIG. 4, the selector switch 24 is rotatable between a first predetermined angular position 32 through a range of rotation indicated by arrow 34 to a second predetermined angular position 36. When selector switch 24 is in the first position 32 (shown in phantom in FIG. 4) the drive mechanism 26 is disengaged from the piston 20, allowing a user to manually advance and retract the piston 20 with respect to the cylinder 14 by grasping the handle 18 in one hand and a knob 38 on the piston 20 in the other hand and causing relative motion therebetween, as desired. When the selector switch 24 is in the second position 36, the drive mechanism 26 is engaged with the rack gear 28 and the piston 20 will move in response to depression of the electrical switch 22, either in a forward or a reverse direction, as desired by the user.

In operation, apparatus 10 is used to initially draw paint or other liquid coating material into the reservoir 15 by coupling a siphon tube (not shown) to an inlet 40 of the reservoir 15 with the siphon tube partially immersed in the liquid coating material, during which the piston 20 is retracted either manually via knob 38 (with the drive mechanism 26 disengaged) or under power by depressing the electrical switch 22 in the reverse direction with the drive mechanism 26 engaged with the piston 20 via the rack gear 28.

Figure 8:
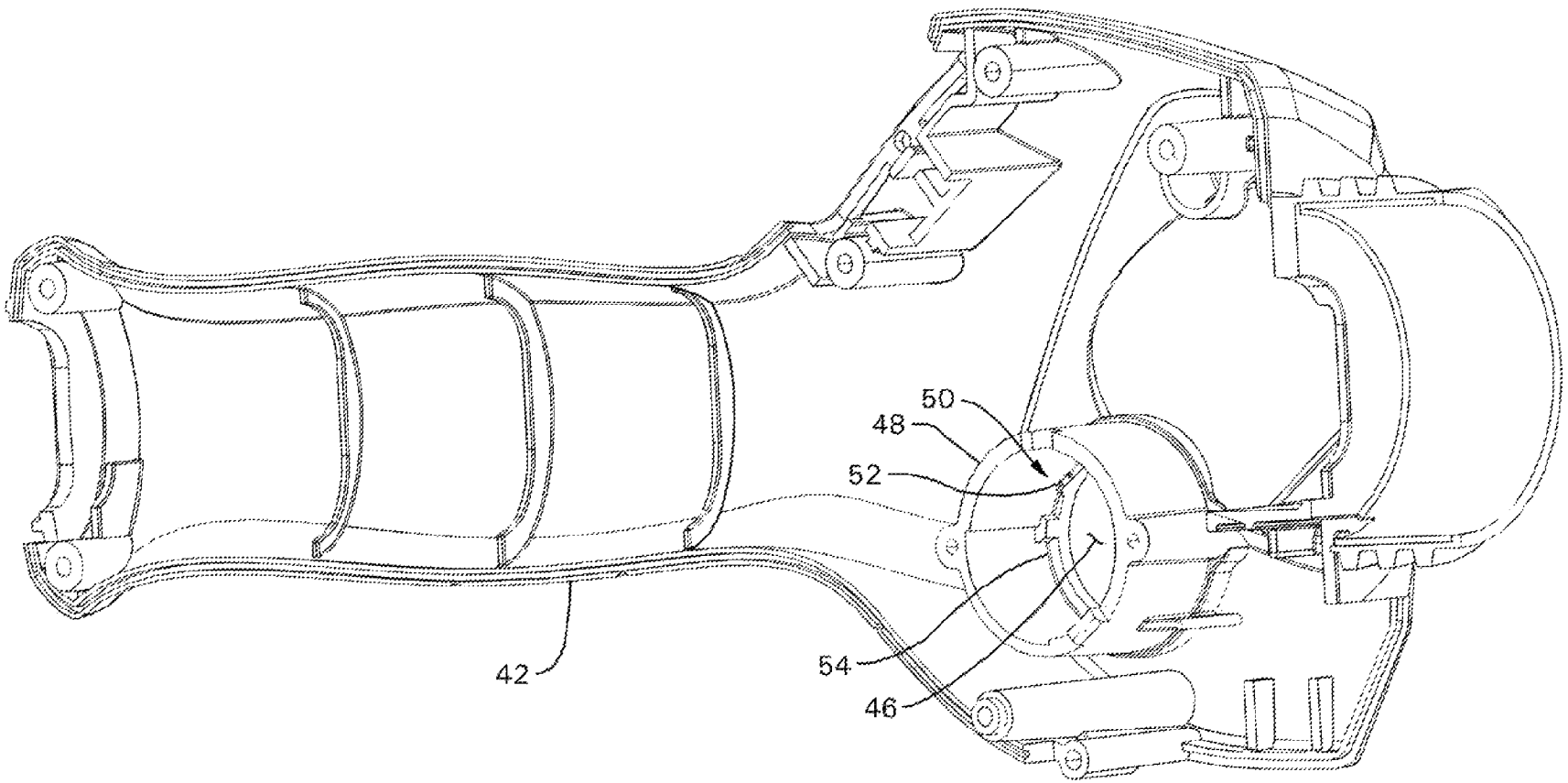
FIG. 8 is side perspective view of the interior of one of the housing halves from FIG. 7.
Figure 23:
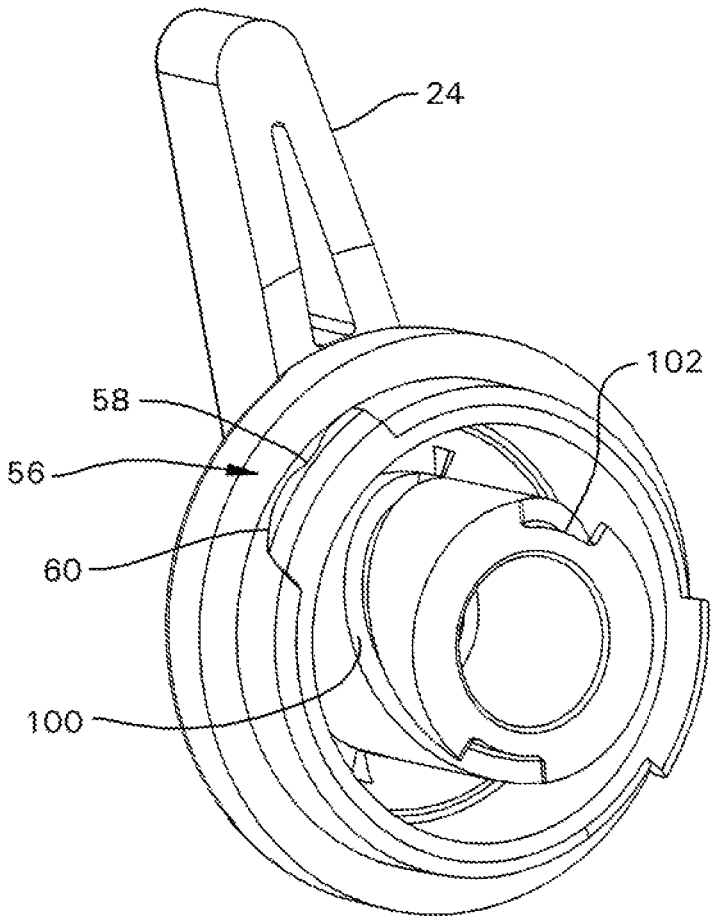
FIG. 23 is an enlarged second perspective view of the selector switch of FIG. 22.
Figure 24:
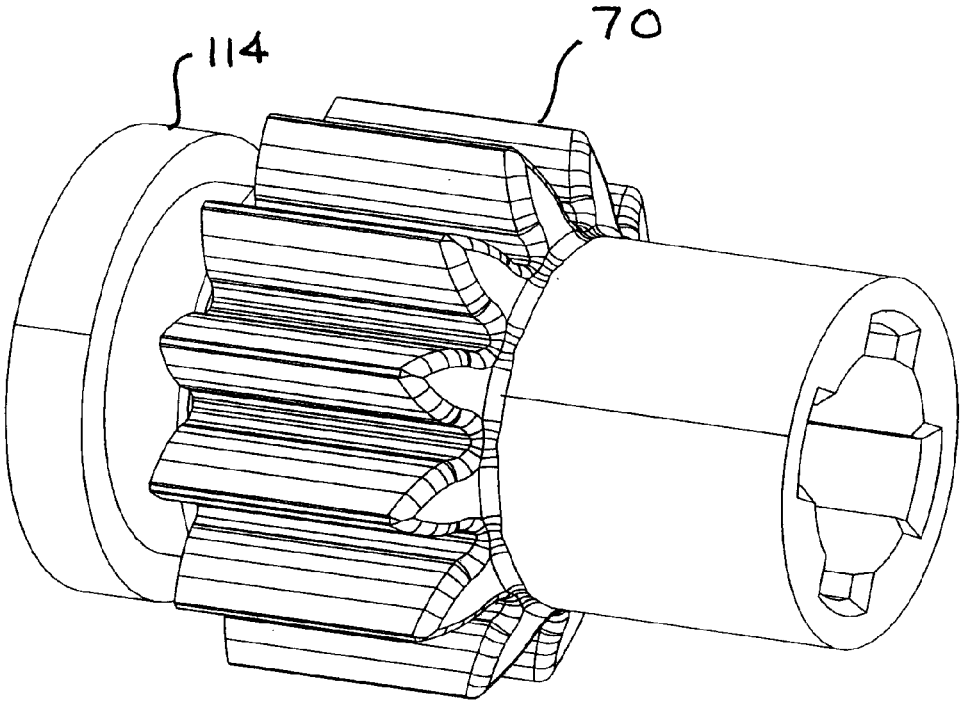
FIG. 24 is an enlarged first perspective view of a pinion gear member from FIG. 20.
Figure 25:
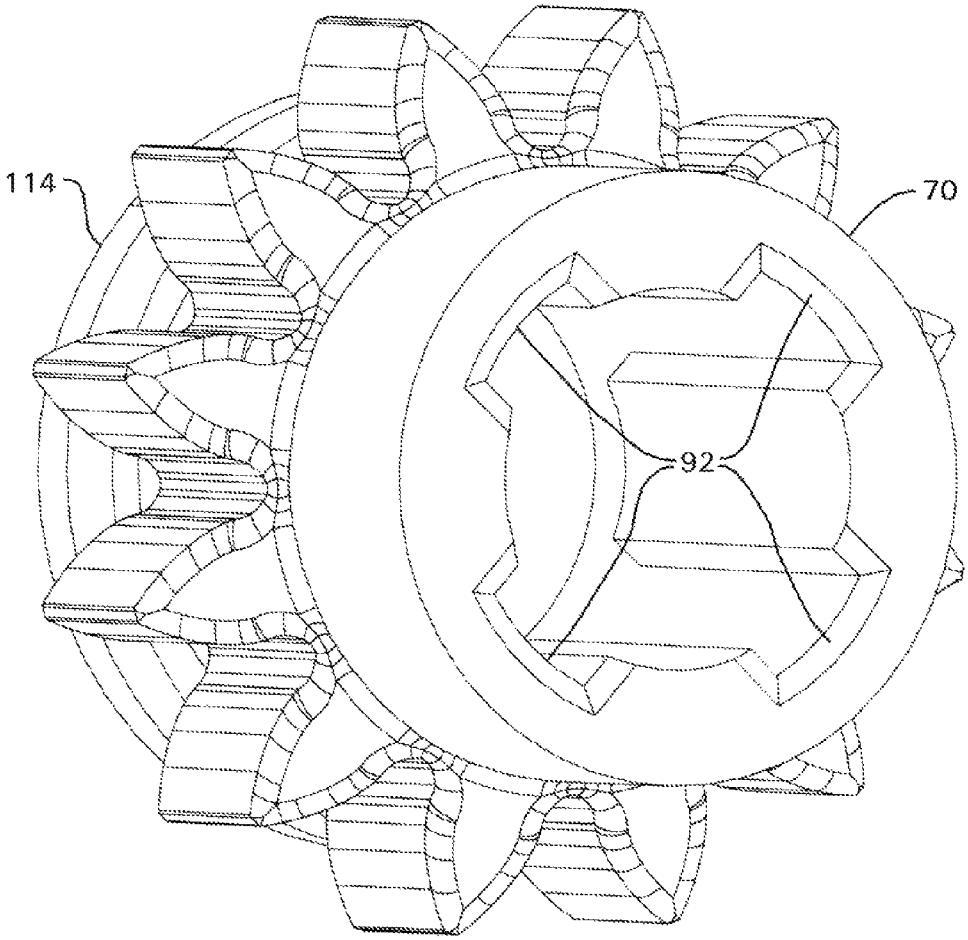
FIG. 25 is a second perspective view of the pinion gear member of FIG. 24.
Figure 26:
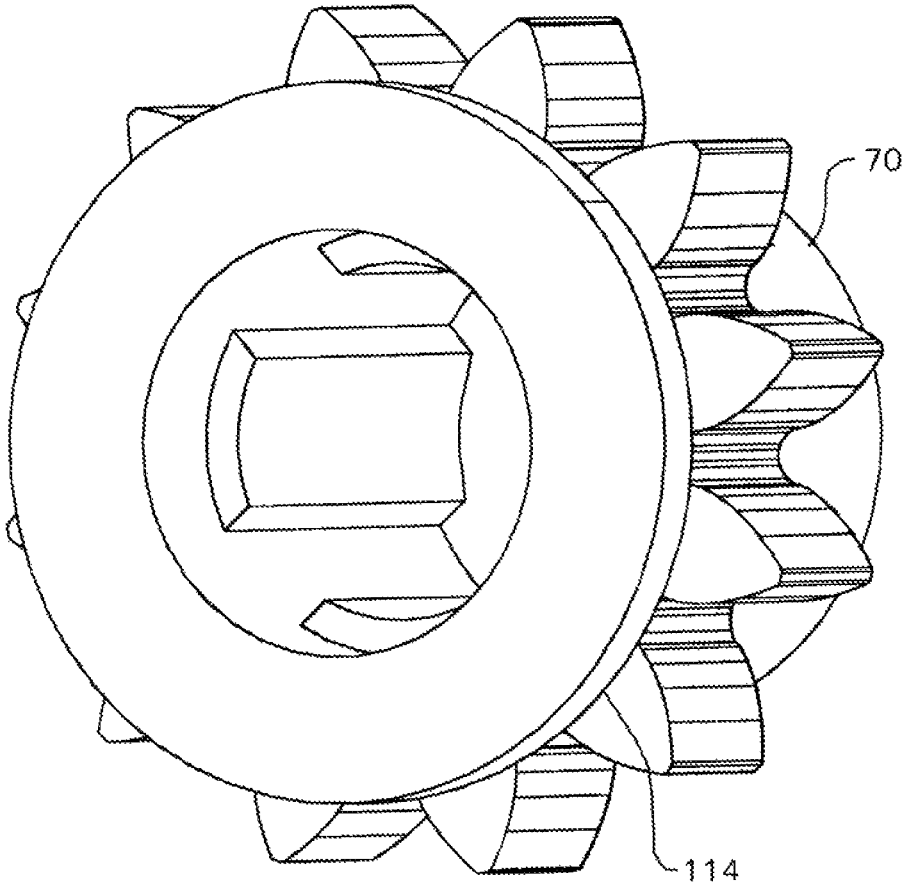
FIG. 26 is a third perspective view of the pinion gear member of FIG. 24.
Figure 27:
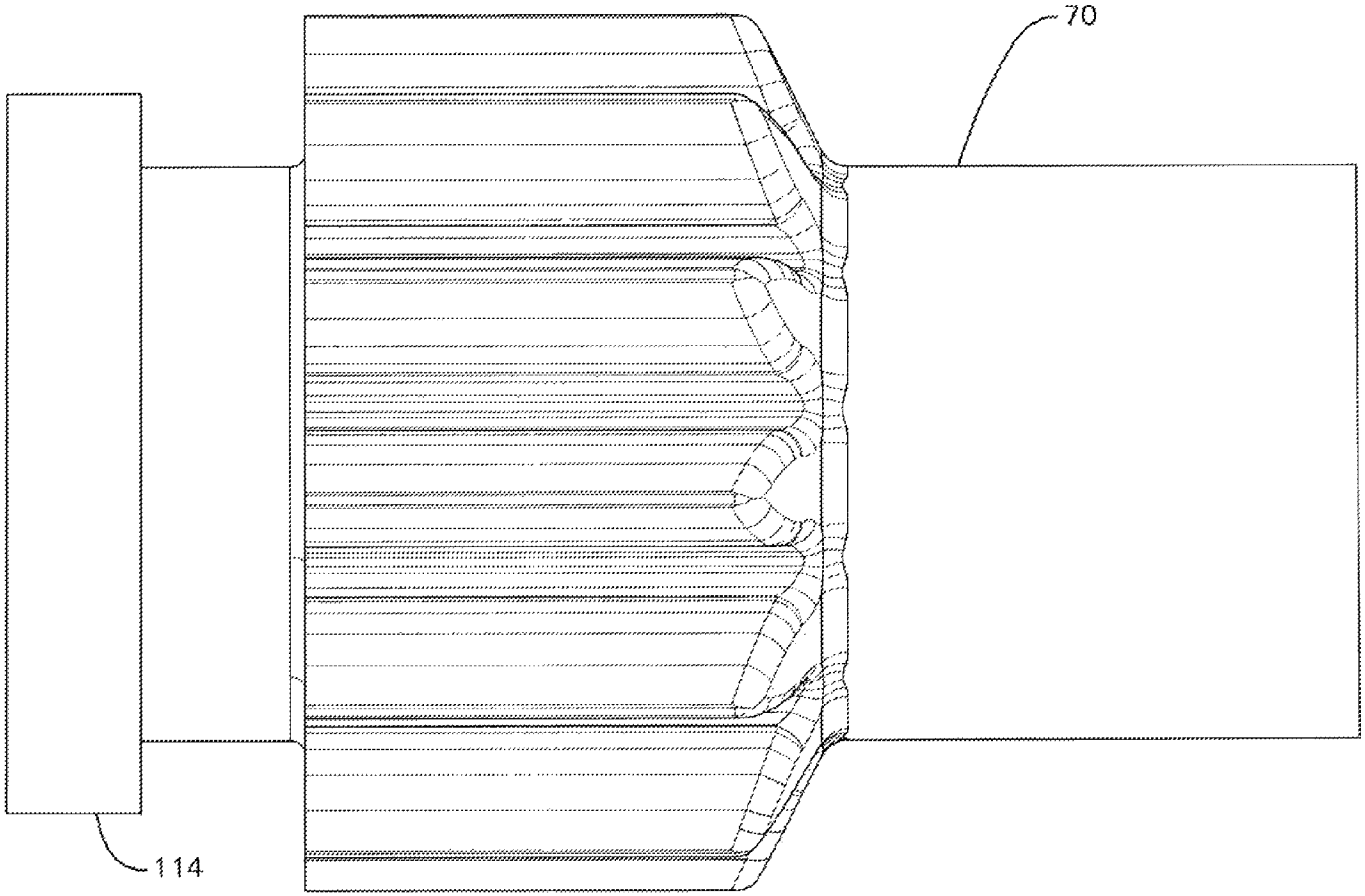
FIG. 27 is a side view of the pinion gear member of FIG. 24.

Handle 18 is made up of two housing halves 42, 44 which together form a housing for the drive mechanism 26, as may be most clearly seen in FIGS. 6 and 7. Referring now also to FIG. 8, housing half 42 includes an aperture 46 and a cylindrical supporting wall section 48 for the engagement mechanism 30, including the mechanical selector switch 24. A first portion 50 of a detent mechanism useful in holding the selector switch 24 in the first position 32 is integrally formed as a raised bump 52 on an interior rim 54 of the cylindrical supporting wall section 48. Bump 52 cooperates with a second portion 56 of the detent mechanism, which is a recess 58 formed on selector switch 24 (see FIG. 23). A ramp surface 60 guides bump 52 into alignment with recess 58 as the selector switch is urged by a user toward the first (disengaged) position 32. Interengagement of the bump 52 and recess 58 will hold the selector switch 24 in the first position 32 until a user rotates the selector switch 24 away from the first position 32 towards the second (engaged) position 36.

Figure 9:
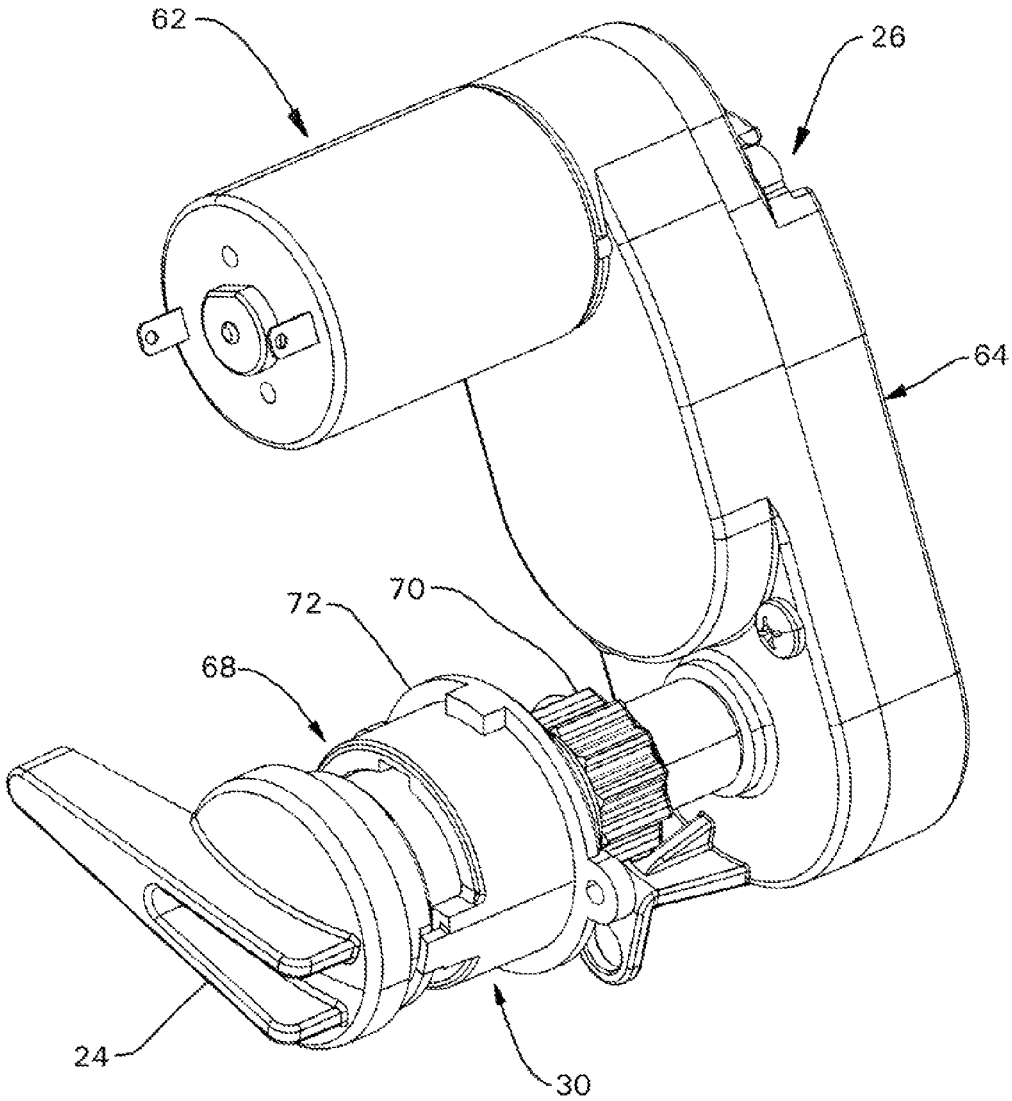
FIG. 9 is an enlarged view of the drive mechanism of FIG. 7, except with certain parts omitted to better illustrate certain aspects of the present invention.

Referring now also to FIG. 9 the drive mechanism 26 may be seen. Drive mechanism 26 may include an electric motor 62, a gear reduction unit 64, a drive spindle 66 and the engagement mechanism 30. The engagement mechanism 30 may include the selector switch 24, a gear shifter 68, a pinion gear member 70 and a guide ring 72. The engagement mechanism 30 allows a user to move the pinion gear member 70 into and out of engagement with the rack gear 28, as desired.

Figure 10:
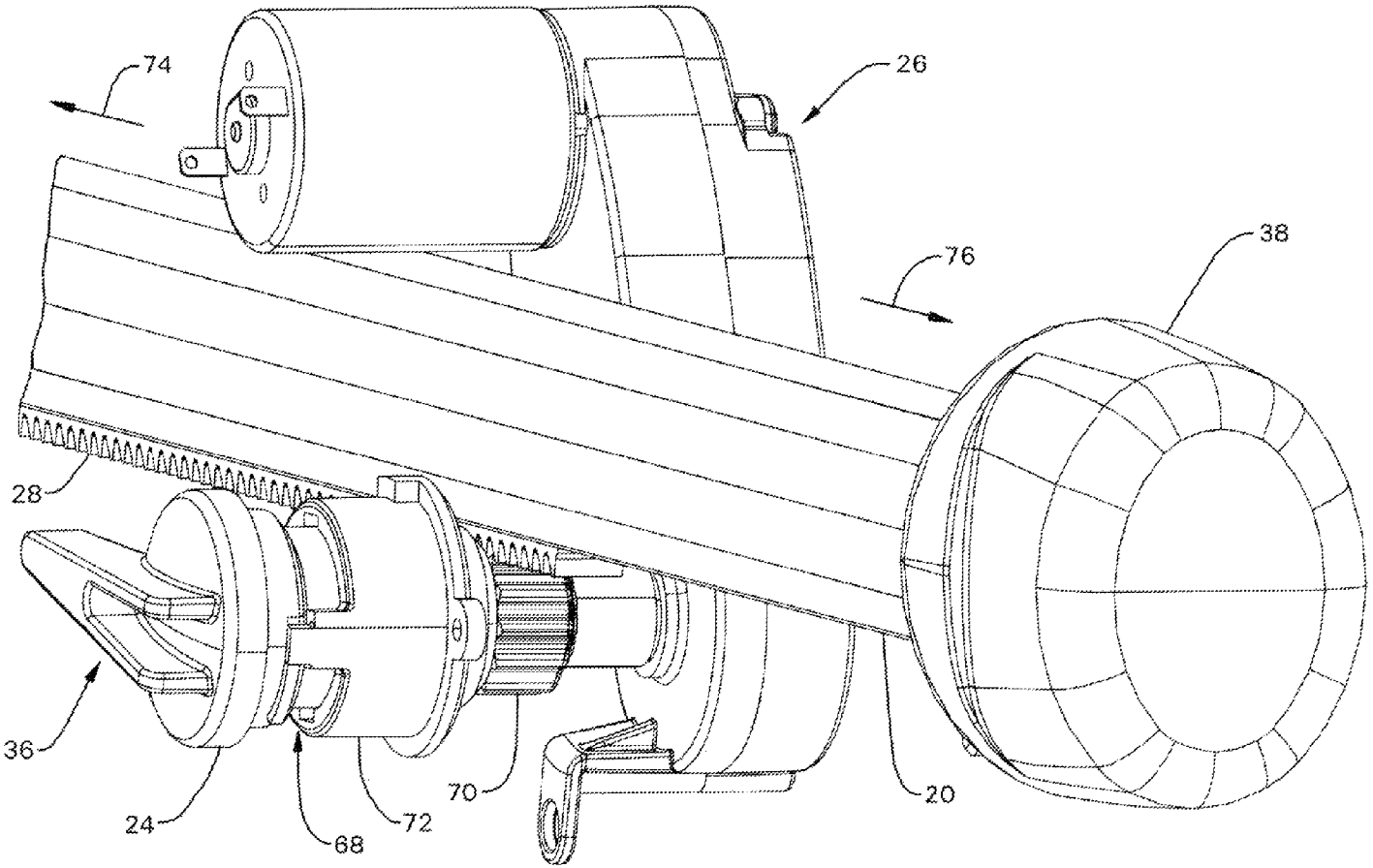
FIG. 10 is a perspective view from the rear of the drive mechanism of FIG. 9 shown engaged with a rack gear of the piston to illustrate certain aspects of the present invention.
Figure 11:
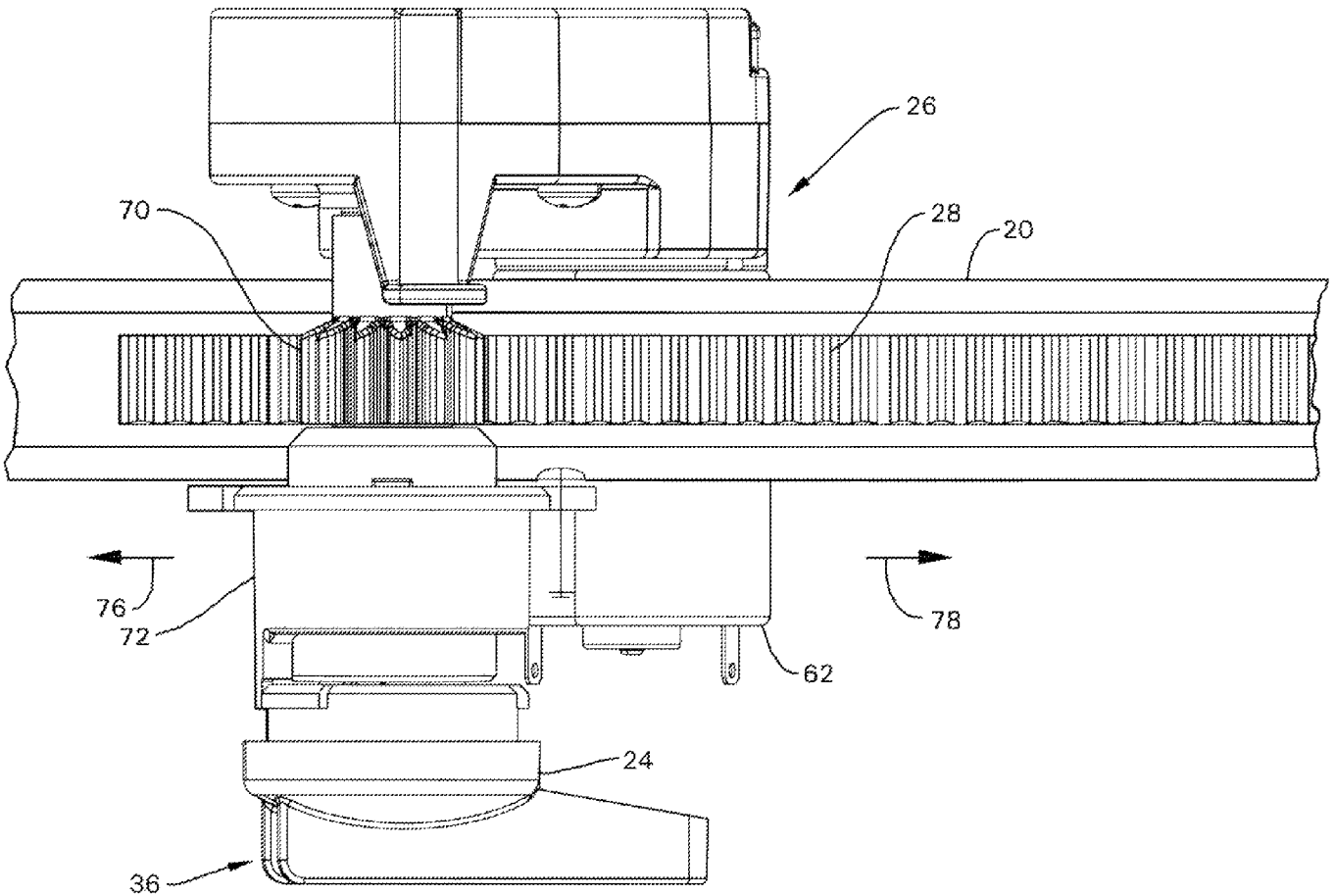
FIG. 11 is a bottom plan view of the parts shown in FIG. 10.

Referring now to FIGS. 10 and 11, the drive mechanism 30 is shown with the pinion gear 70 engaged with the rack gear 28. Electric motor may be energized to drive the rack gear 28 and piston 20 in either a forward direction (indicated by arrow 74) or a reverse direction (indicated by arrow 76). It may be noted that the selector switch is in the engaged or second position 36 in FIGS. 10 and 11, causing the engagement mechanism 30 to place the pinion gear member 70 in engagement with the rack gear 28.

Figure 12:
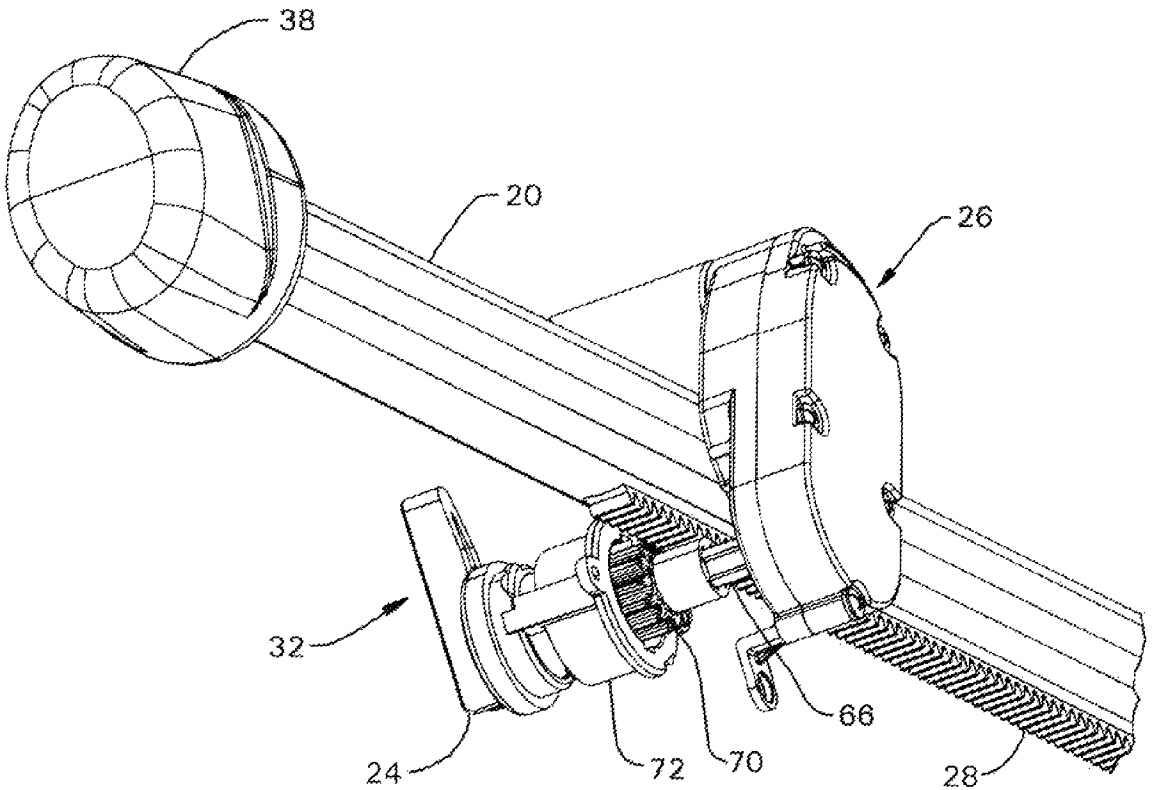
FIG. 12 is a perspective view of the parts shown in FIG. 10, except with the drive mechanism disengaged from the rack gear.
Figure 13:
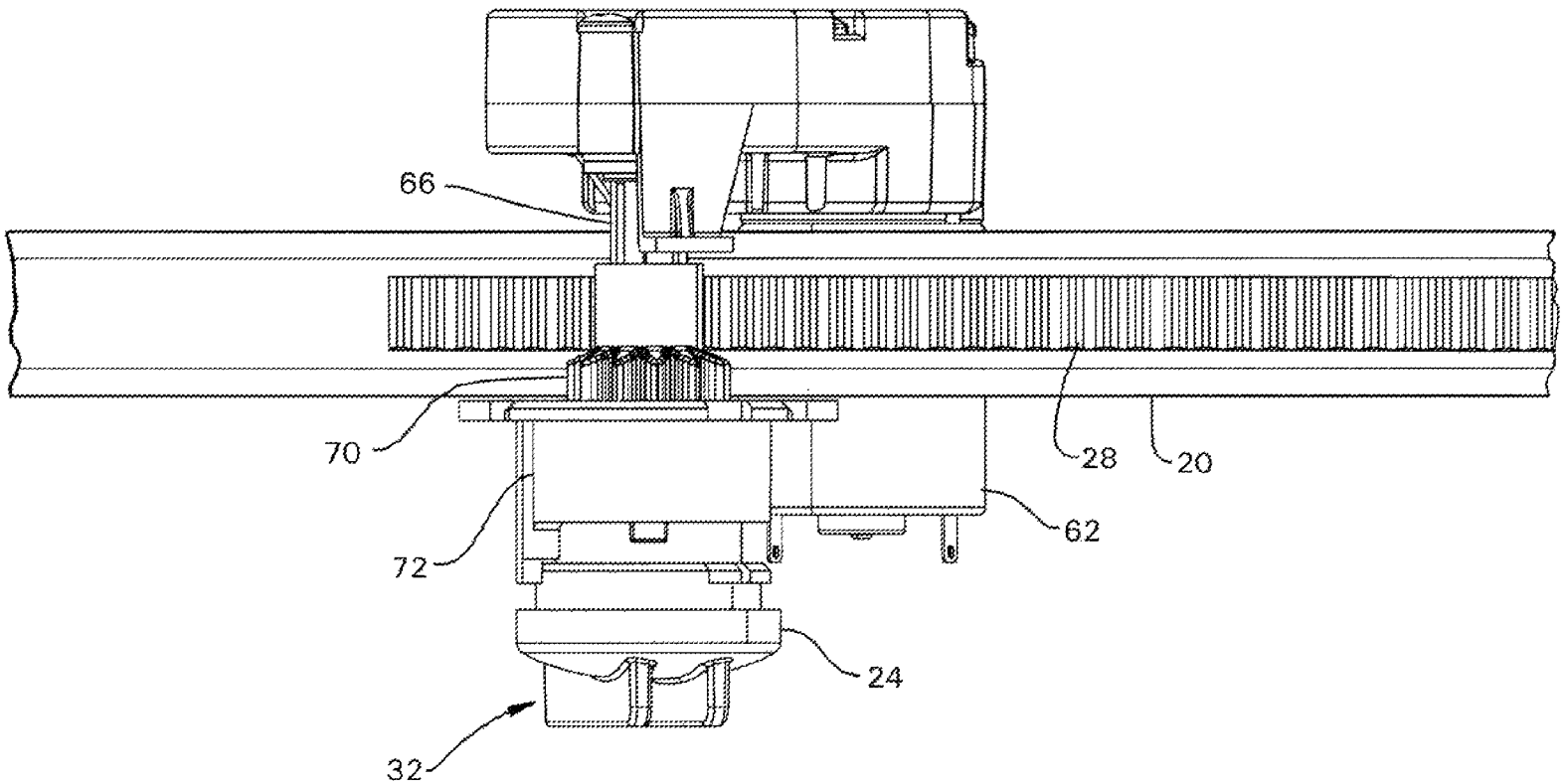
FIG. 13 is a bottom plan view of the parts shown in FIG. 11.

Referring now to FIGS. 12 and 13, the drive mechanism is shown with the pinion gear disengaged from the rack gear 28, because the selector switch 24 has been moved to the disengaged or first position 32. In this condition, the piston 20 will not be driven by the drive mechanism 30 and a user may manually move the piston in the forward or reverse direction, as desired.

Figure 14:
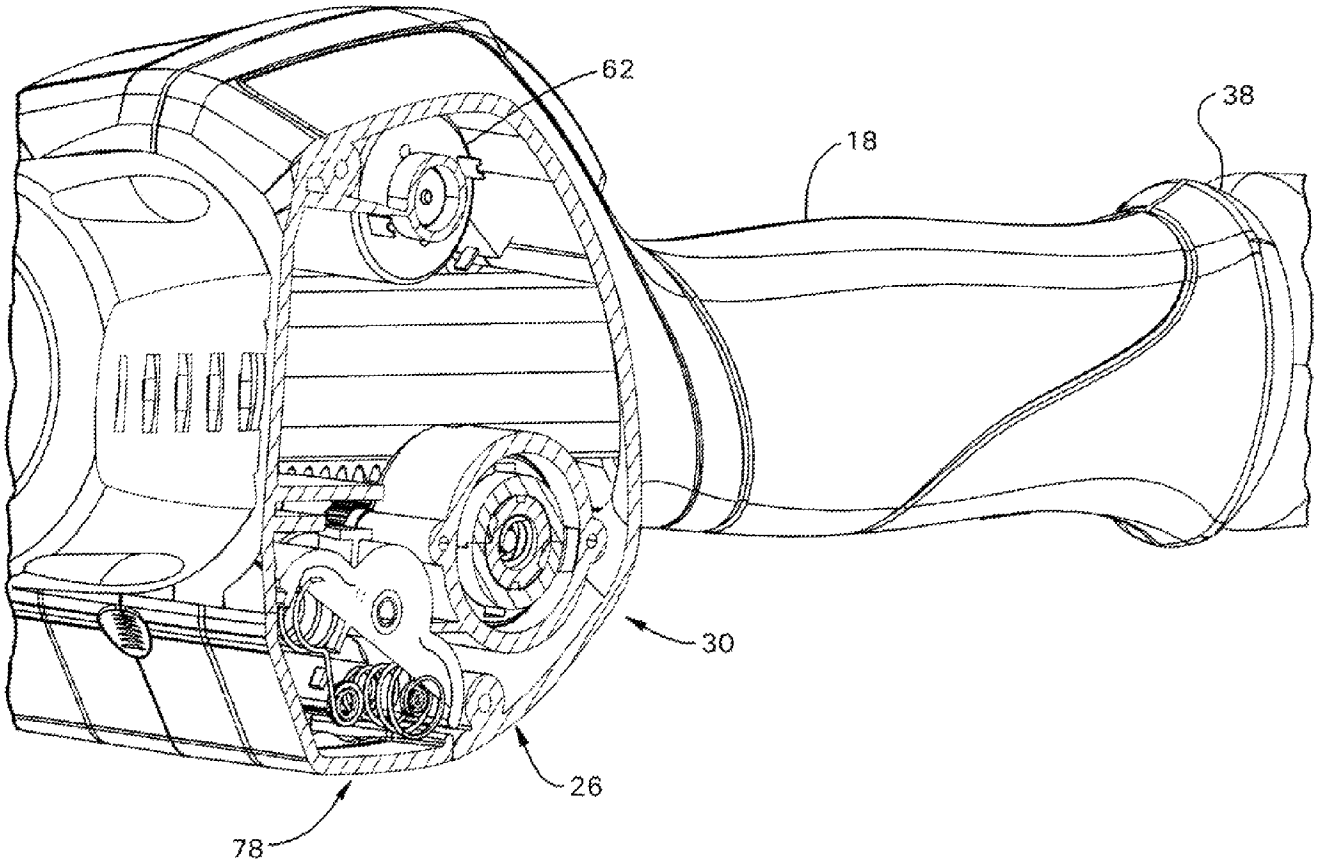
FIG. 14 is a fragmentary section view taken along line XIV-XIV of FIG. 5.

FIG. 14 shows a fragmentary section view taken along line XIV-XIV of FIG. 5. This view shows certain details of the drive mechanism 26 and certain aspects of the mounting arrangements for the motor 62 and engagement mechanism 30. Certain details of a portion of a battery compartment 78 are also visible in this view.

Figure 15:
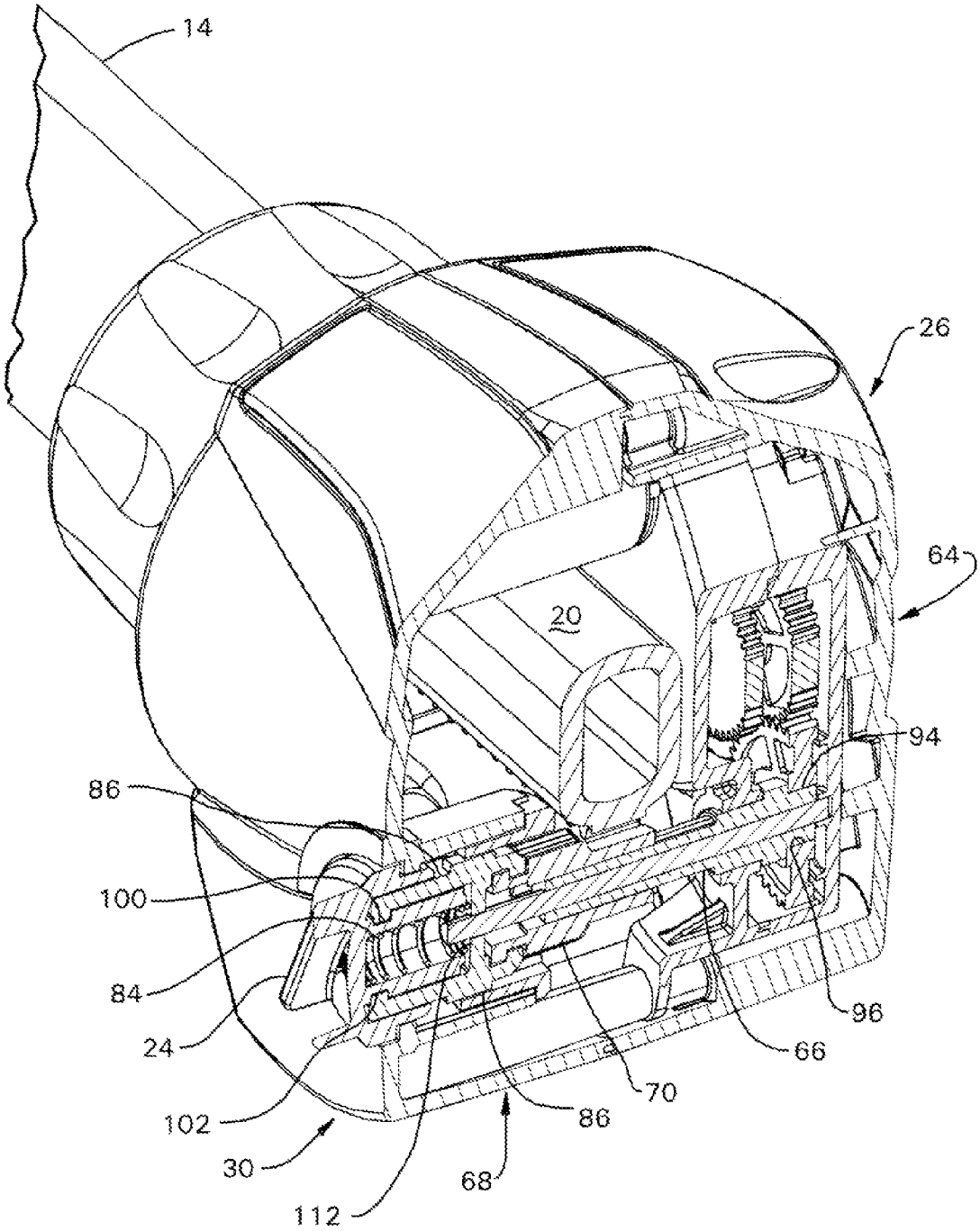
FIG. 15 is a fragmentary section view taken along line XV-XV of FIG. 3 and showing the drive mechanism disengaged from the rack gear.
Figure 16:
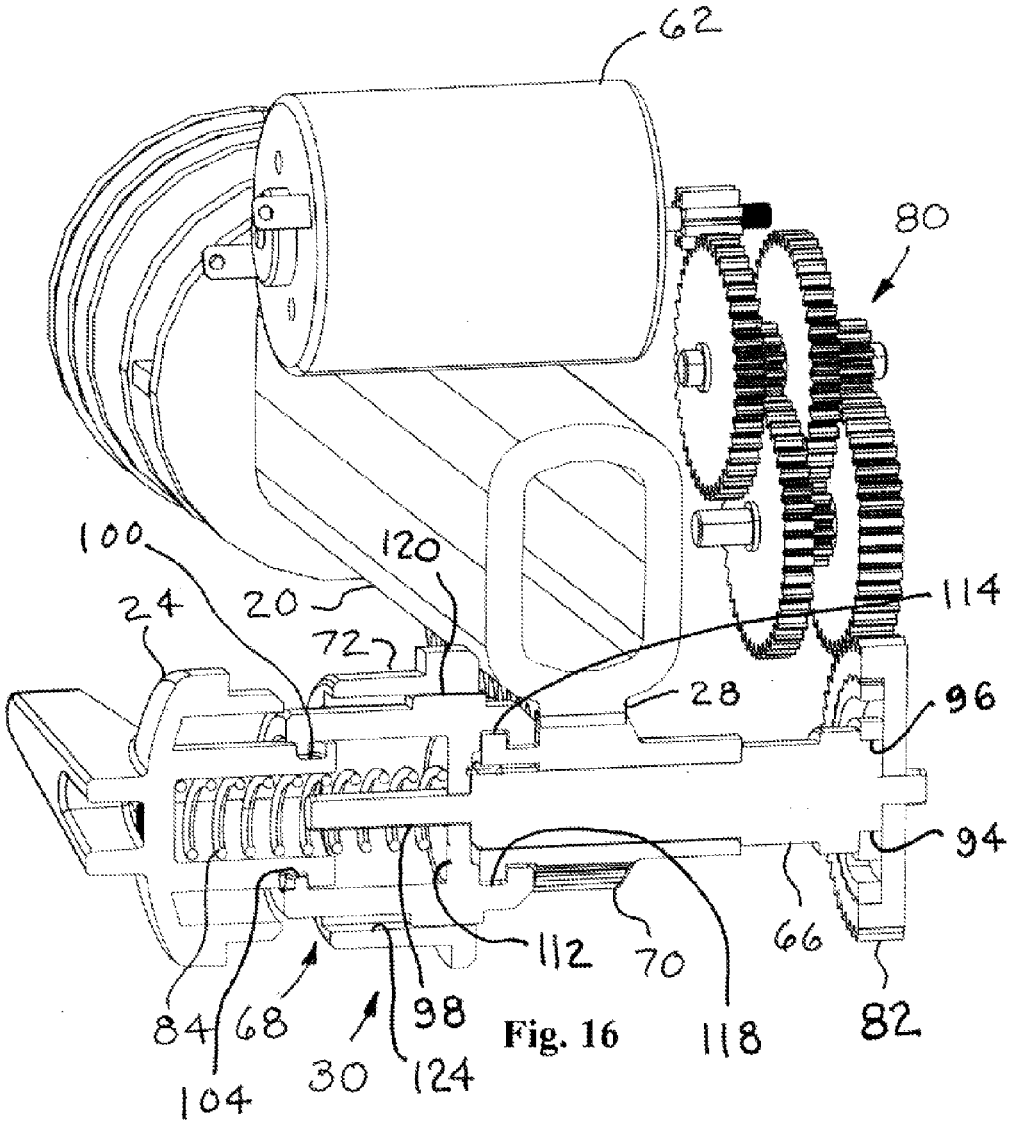
FIG. 16 is a view similar to that of FIG. 15, also taken along line XV-XV, except with certain parts omitted and with the drive mechanism engaged with the rack gear to illustrate the drive train of this embodiment of the present invention.

FIG. 15 shows a fragmentary section view taken along line XV-XV of FIG. 4. This view shows internal details of the drive mechanism 30, including the gear reduction unit 64, the drive spindle 66 and the gear shifter 68 of the engagement mechanism 30. FIG. 16 is an enlarged section view taken along line XV-XV of certain operating parts of the drive mechanism 20 to better illustrate the operation thereof. Electric motor 62 operates through a set of gears 80 to rotate an output gear 82 connected to the drive spindle 66. Drive spindle 66 rotates the pinion gear member 70 when the motor rotates. If the pinion gear member is engaged with the rack gear 28 9as it is in FIG. 16), the piston 20 will be urged either into or out of the cylinder (not shown in this view). A spring 84 urges the pinion gear member 70 towards engagement with the rack gear 28.

Figure 17:
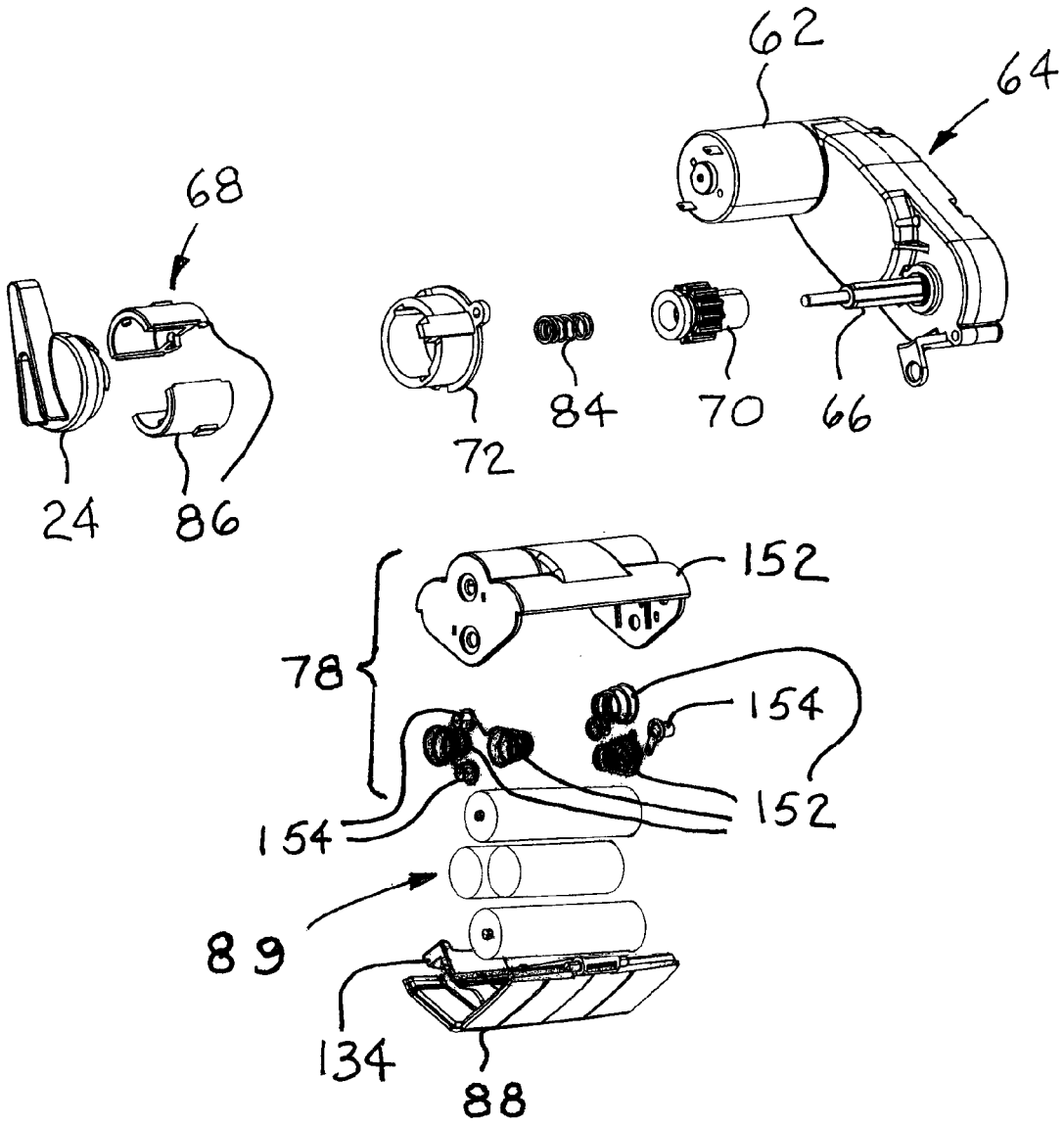
FIG. 17 is a partially exploded view of parts from the drive mechanism useful in the practice of the present invention.
Figure 28:
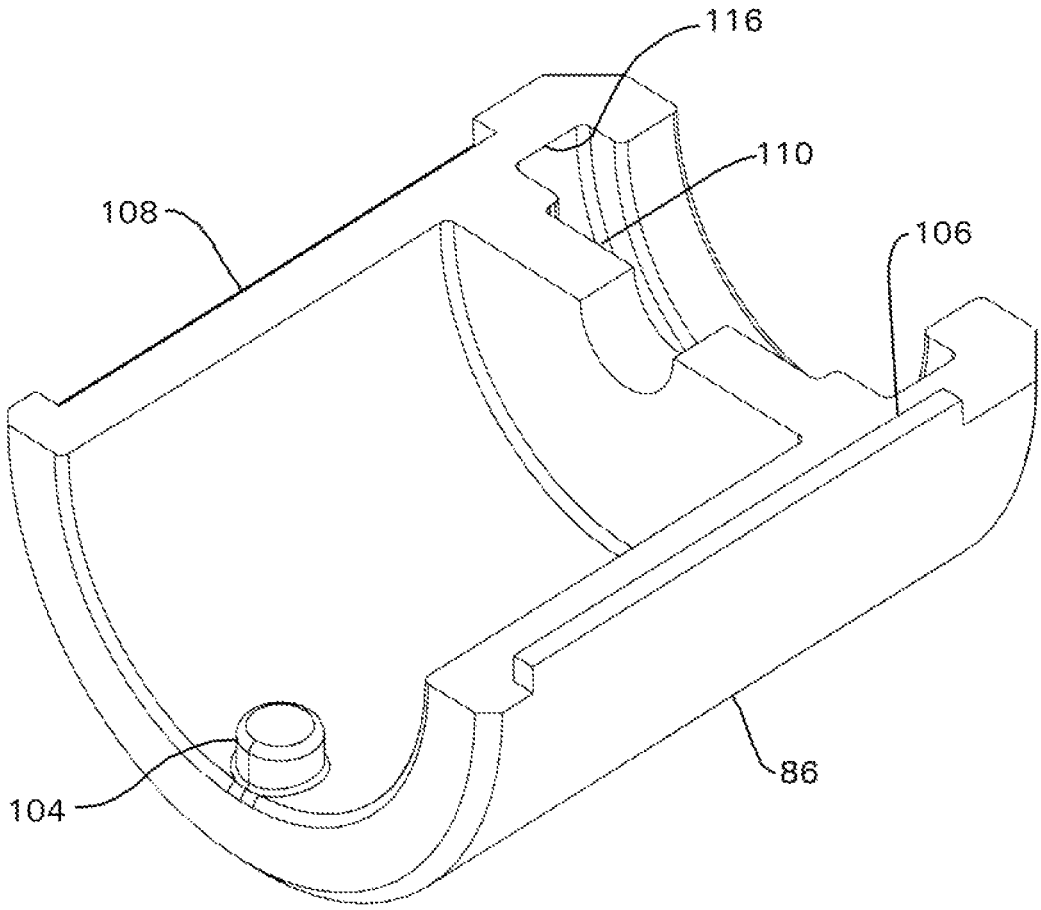
FIG. 28 is a first perspective view of an axial shifter half from the engagement subassembly of FIG. 19, showing internal details thereof.
Figure 29:
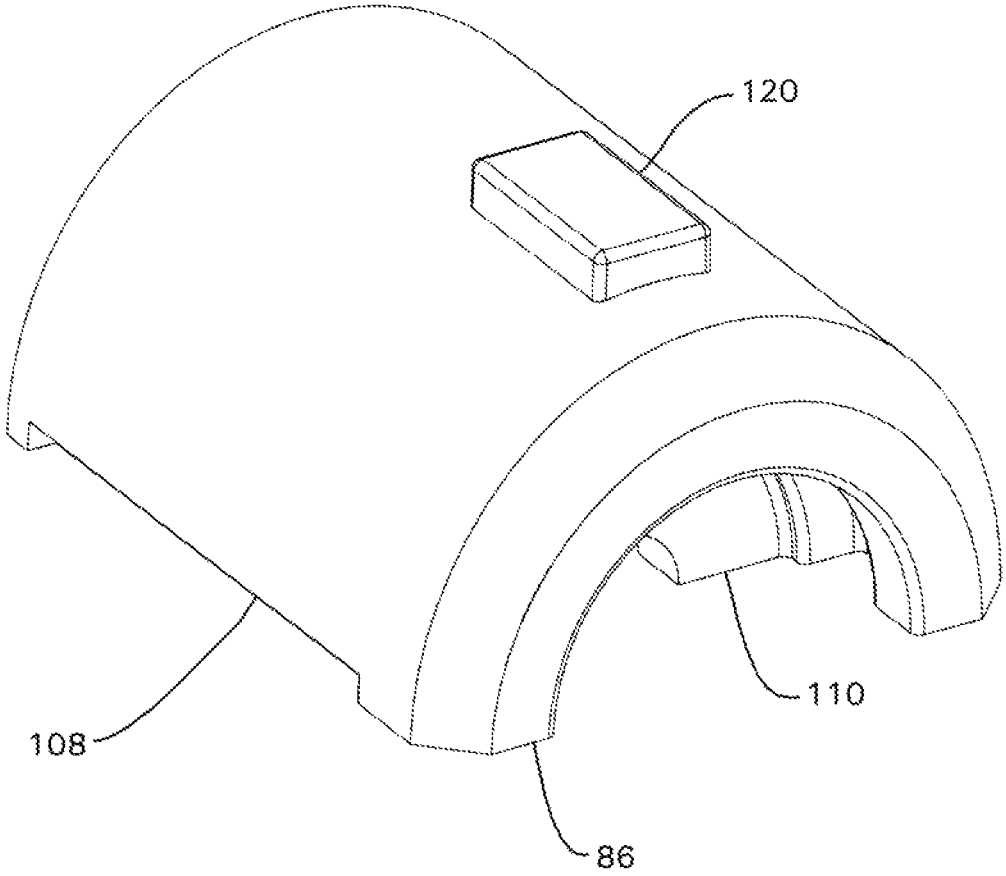
FIG. 29 is a second perspective view of the axial shifter half of FIG. 28, showing external details thereof.

Referring now also to FIG. 17, an exploded view of certain parts useful in the practice of the present invention may be seen. This Figure shows the parts of the engagement mechanism 30 in an exploded view. It is to be understood that the gear shifter 68 is preferably made up of a pair of identical axial shifter halves 86, one of which is shown enlarged in FIGS. 28 and 29. The gear shifter couples the selector switch 24 to the pinion gear member 70 to move the member 70 axially as the switch 24 is rotated within it range 34 (see FIG. 4). Parts of the battery compartment 78 and a battery access cover or door 88, along with a set of batteries 89. It is to be understood that "battery" as used herein means a single electrical dry cell or a group of electrical dry cells.

Figure 18:
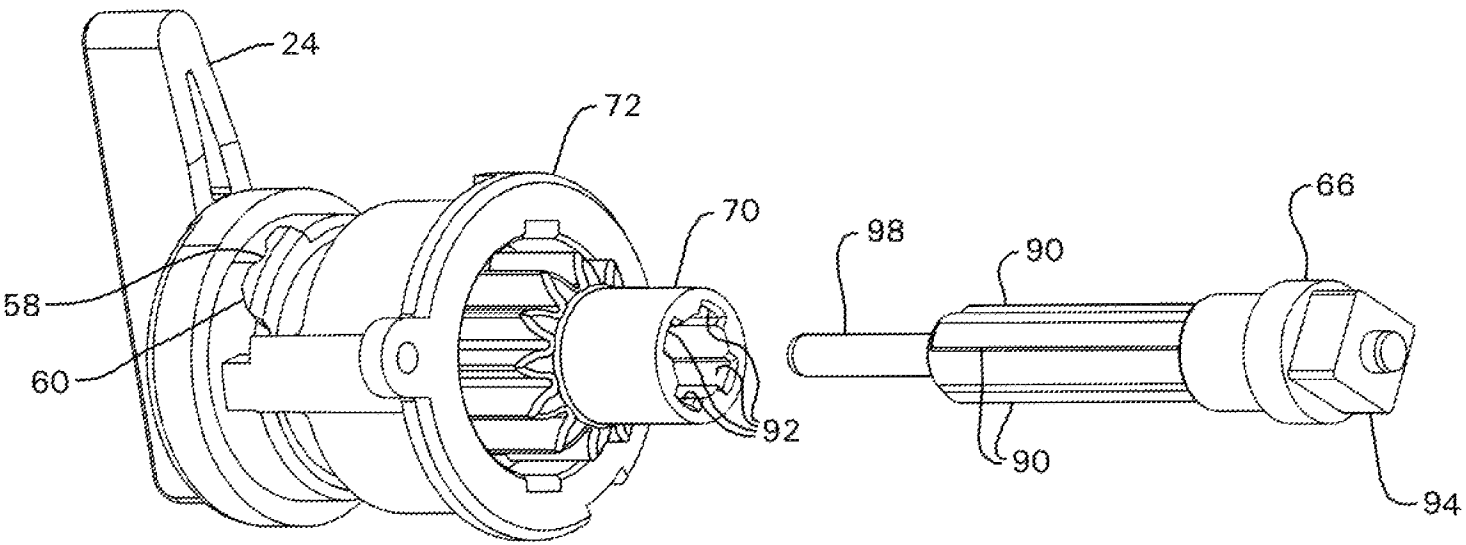
FIG. 18 is a perspective view of an engagement subassembly from the drive mechanism (shown in a disengaged condition), with a drive spindle shown separated therefrom to illustrate further aspects of the present invention.
Figure 19:
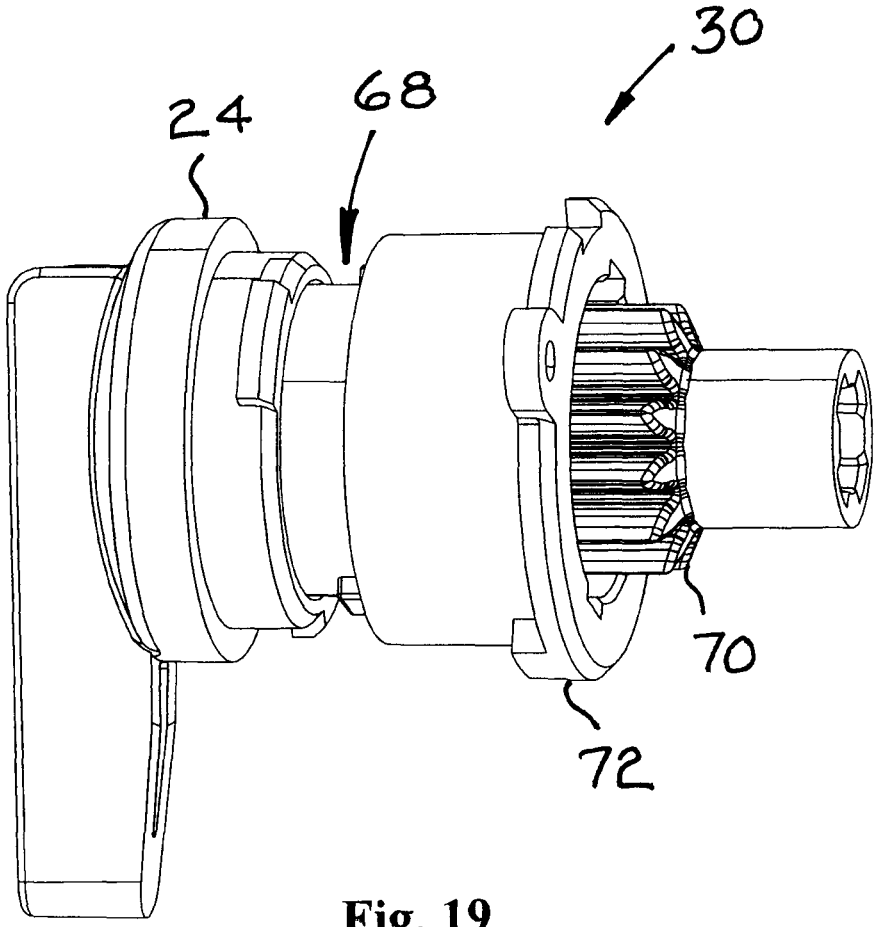
FIG. 19 is another perspective view of the engagement subassembly of FIG. 18 (still shown in the disengaged condition).

FIG. 18 shows the drive spindle 66 and the engagement mechanism 30. The drive spindle has at least one key or spline and preferably a plurality of splines 90. Splines 90 are received in mating recesses 92 interior of the pinion gear member 70. Drive spindle 66 also has a square drive surface 94 to mate with a square aperture 96 in output gear 82. Drive spindle 66 also has a shaft extension 98 to maintain alignment of the gear shifter 68 as it moves axially. FIG. 19 shows another view of the engagement mechanism 30. It is to be understood that the engagement mechanism is shown in the disengaged condition in FIGS. 18 and 19.

Figure 20:
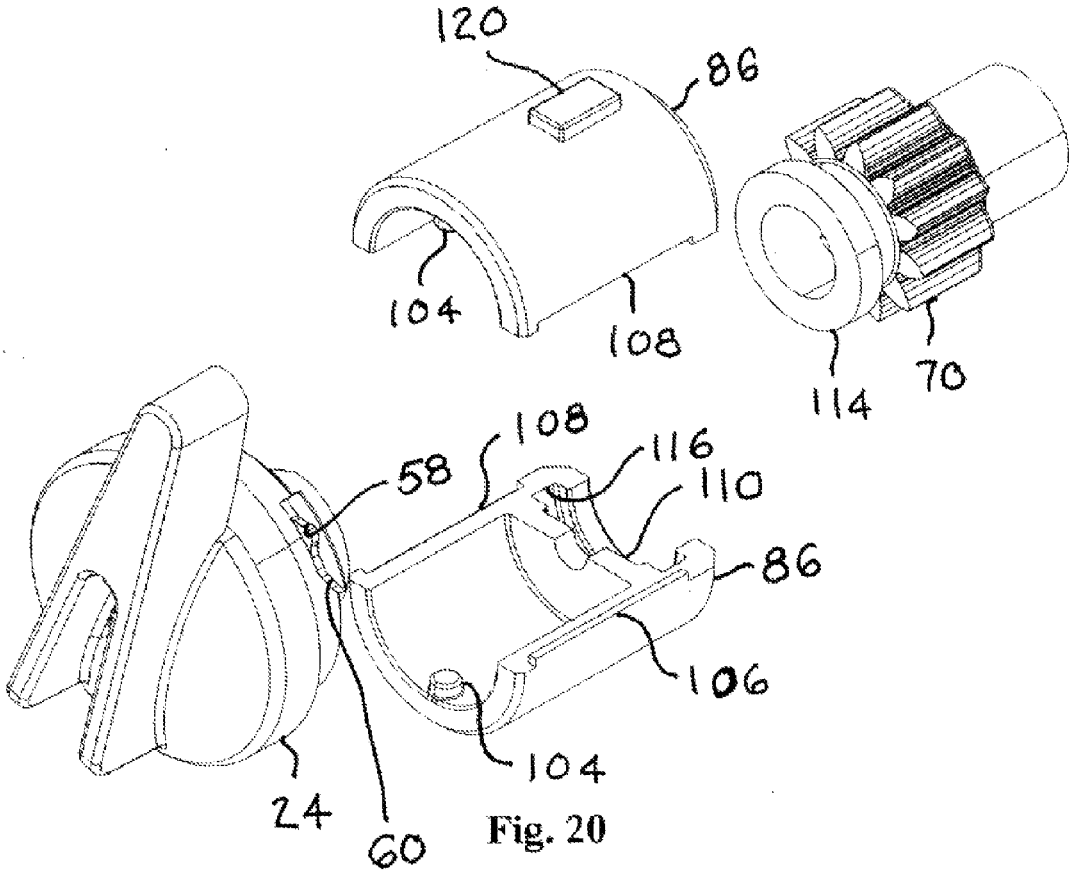
FIG. 20 is an exploded first perspective view of certain parts from the engagement subassembly of FIG. 19.
Figure 21:
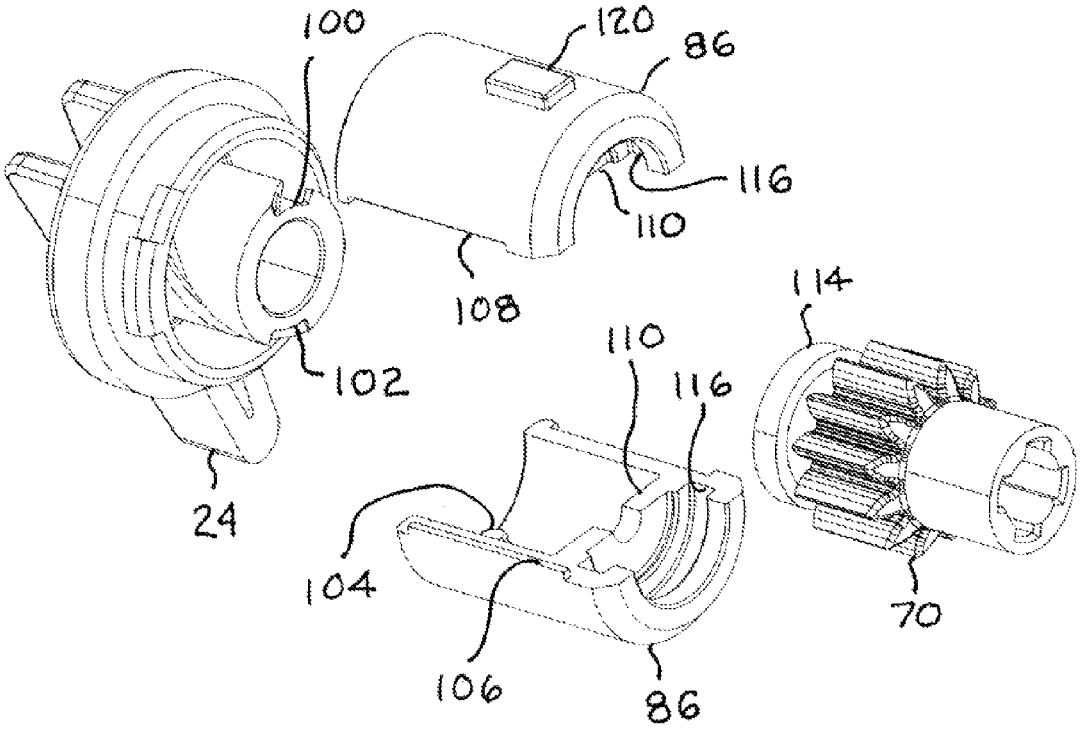
FIG. 21 is an exploded second perspective view of the parts shown in FIG. 20.
Figure 22:
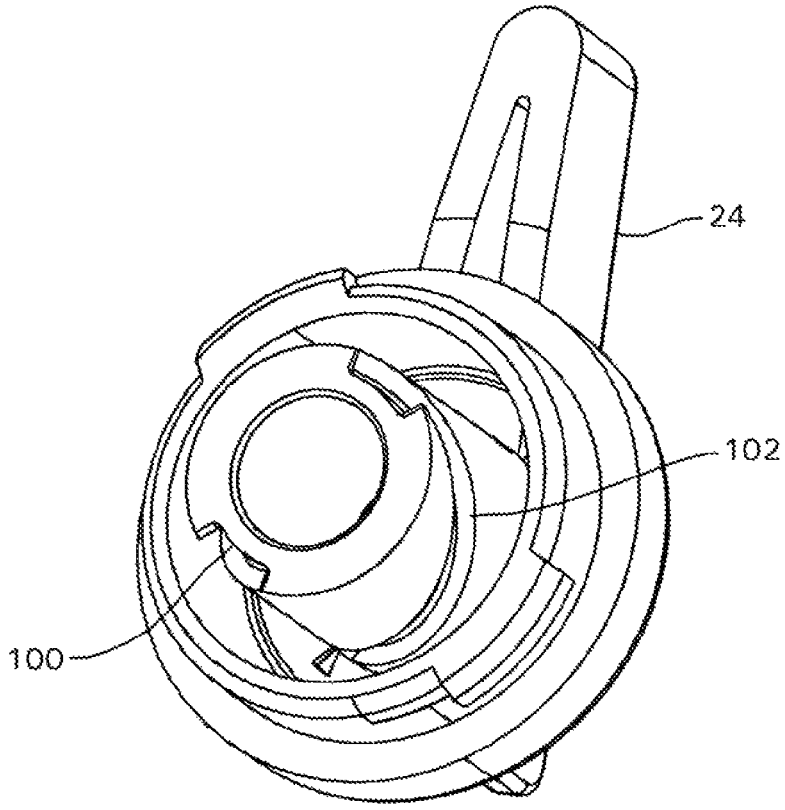
FIG. 22 is an enlarged first perspective view of a selector switch useful in the practice of the present invention.

FIGS. 20 and 21 show exploded views of the parts of the engagement mechanism with the spring 84 omitted. As may be seen in FIGS. 15 and 21-23, selector switch 24 has a pair of helical grooves 100, 102. Each of these grooves receive a radially inwardly directed projection 104 on each of axial shifter halves 86 when the engagement mechanism 30 is assembled. Together the pair of axial shifter halves 86 form the gear shifter 68 in the form of a cylinder, with a lip 106 on one side of the semi-cylindrical surface mating with a recess 108 on the other side of the semi-cylindrical surface of each axial shifter half 86. Each axial shifter half 86 also has an internal half wall 110 that, when the two halves are joined, form an internal wall in the gear shifter 68. The spring 84 is located between the selector switch 24 and the internal wall 112 of the gear shifter 68, and biases the axial shifter halves 86 (and therefore the gear shifter 68) away from the selector switch 24.

Referring now also to FIGS. 24-27, the pinion gear member 70 has a flange 114 at one end thereof and each axial shifter half 86 has a depending recess 116 receiving the flange 114 when the engagement mechanism is assembled. The recess 118 thus formed in the gear shifter 68 controls the axial position of the pinion gear member 70 without any substantial restriction on rotational motion of the pinion gear member 70. Each axial shifter half 86 also has a radially outwardly directed projection 120.

Figure 30:
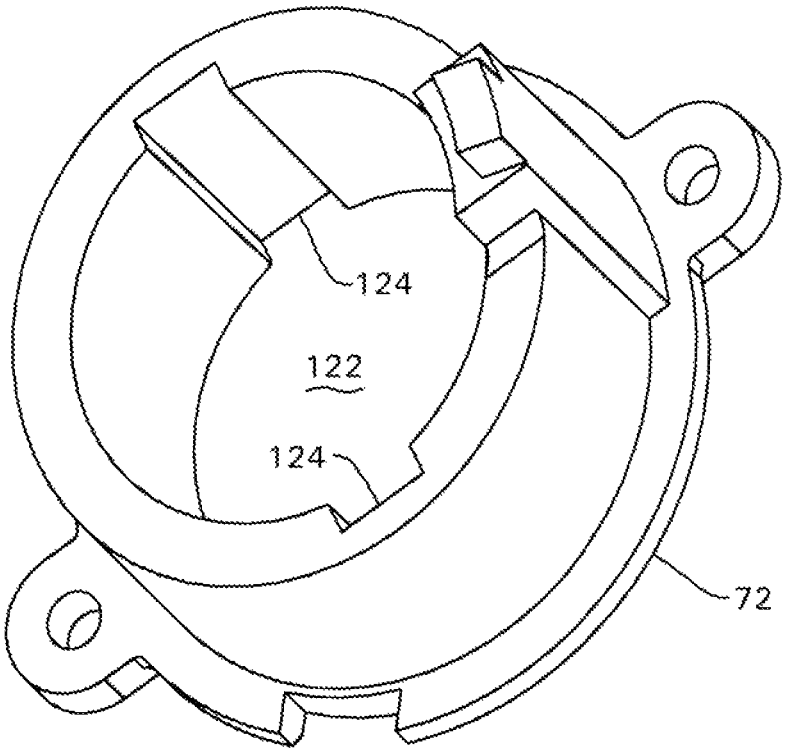
FIG. 30 is a first perspective view of a guide ring from the engagement subassembly of FIG. 19.
Figure 31:
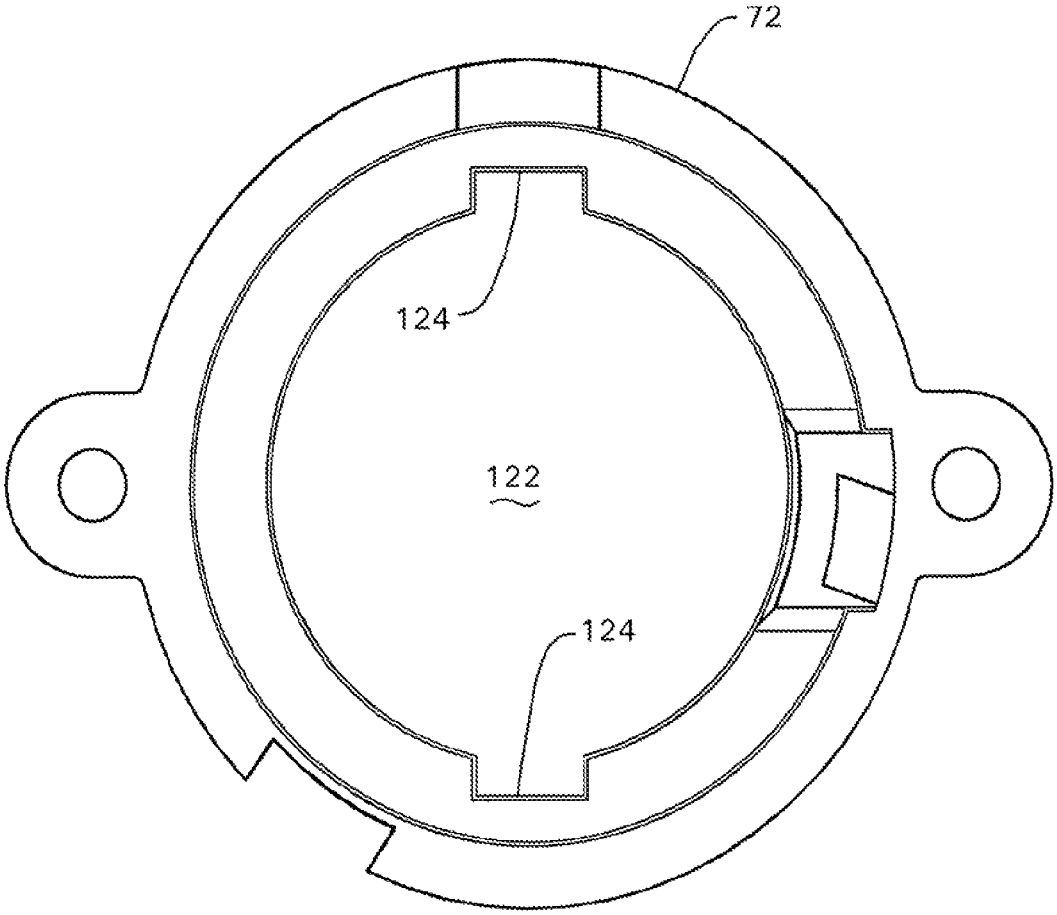
FIG. 31 is an end view of the guide ring of FIG. 30.

Referring now also to FIGS. 30 and 31, the guide ring 72 has an internal bore 122 sized to slidingly receive the gear shifter 68. The guide ring 72 also has a pair of keyways 124, each positioned and sized to receive projection 120 when the engagement mechanism 30 is assembled. Projections 120 interact with keyways 124 to prevent rotation of the gear shifter 68 while allowing axial motion thereof. The guide ring 72 may thus be seen to include a pair of axially oriented channels formed by keyways 124, with each channel 124 receiving one of the projections 120 to prevent rotational motion of the pair of axial shifter halves 86 while allowing axial motion thereof.

Referring now to FIG. 32, an electrical schematic for the apparatus of the present invention may be seen. The battery 89 is preferably made up of four 1.5V dry cells, which may be size AA, commonly referred to as "Double A batteries." Battery 89 is connected through electrical switch 22, which is preferably a two pole, double throw, center-off type switch with a spring return to center when the switch is released by a user. Switch 22 may be used to apply the nominal 6 volt power to the electric motor 62, which is preferably a 6 volt rated DC motor.

Figure 33:
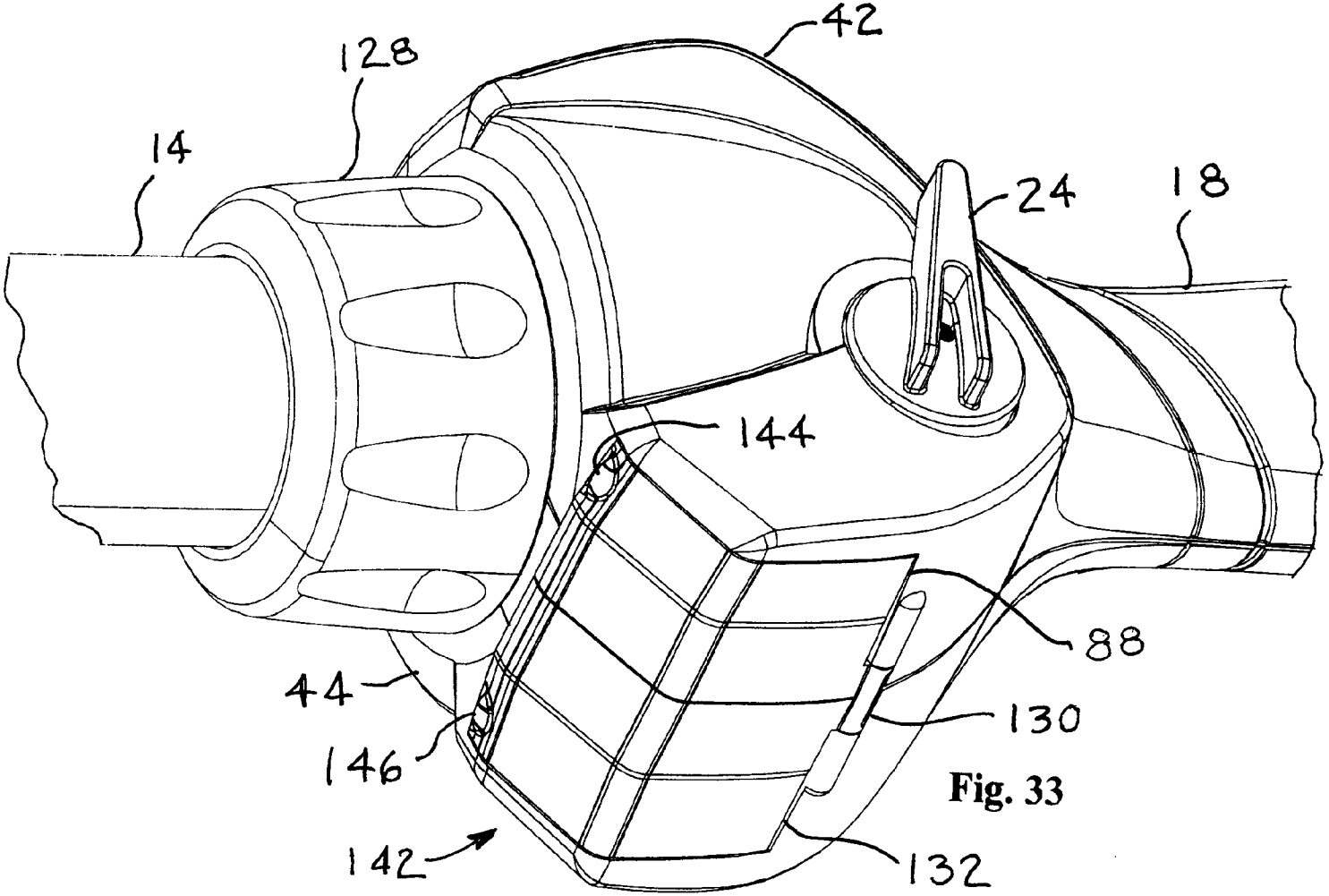
FIG. 33 is an enlarged fragmentary view of the exterior of a battery compartment of the powered internal feed apparatus of the present invention with a battery access door closed and secured.
Figure 34:
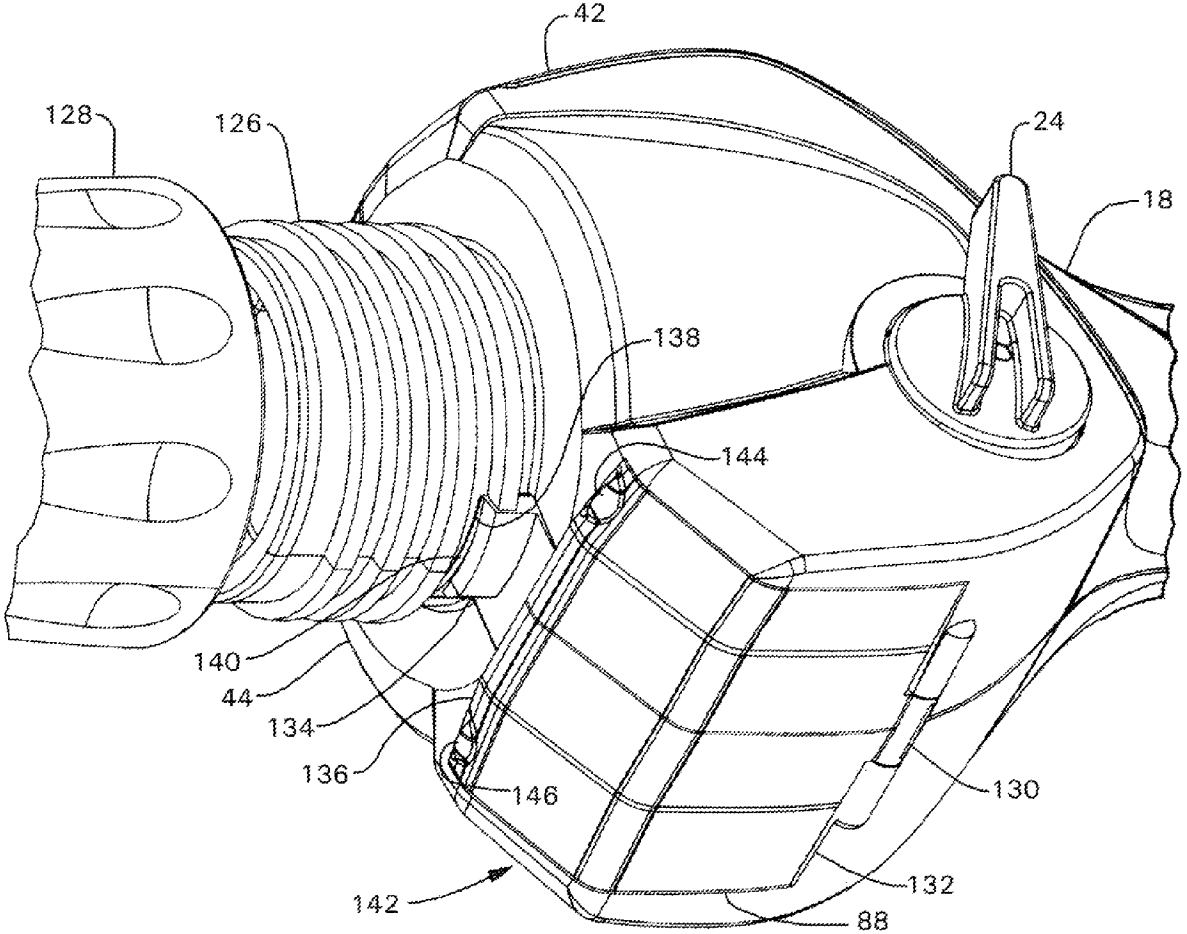
FIG. 34 is a view similar to that of FIG. 33, except with a ring unthreaded, exposing details of a latch of the battery access door.

Referring now to FIGS. 33 through 40, various aspects of the battery compartment 78 and the battery access door 88 of the present invention may be seen. FIG. 33 is an enlarged fragmentary perspective view from below and in front of the handle 18 with the battery access door 88 closed and secured. The two housing halves 44 and 46 of the handle 18 form a threaded extension 126, visible in FIGS. 34-38. A threaded ring 128 is received on the threaded extension 126 and holds the cylinder 14 to the handle 18. Door 88 has a hinge 130 on one edge 132 thereof and a projecting tab 134 on an edge 136 opposite the edge 132. The projecting tab 134 is captured by the ring 128 when the ring 128 is received on the housing 42, 44. When the threaded ring 128 is moved out of the way of the projecting tab 134, the battery access door 88 is released for opening, as illustrated in FIG. 34.

Figure 35:
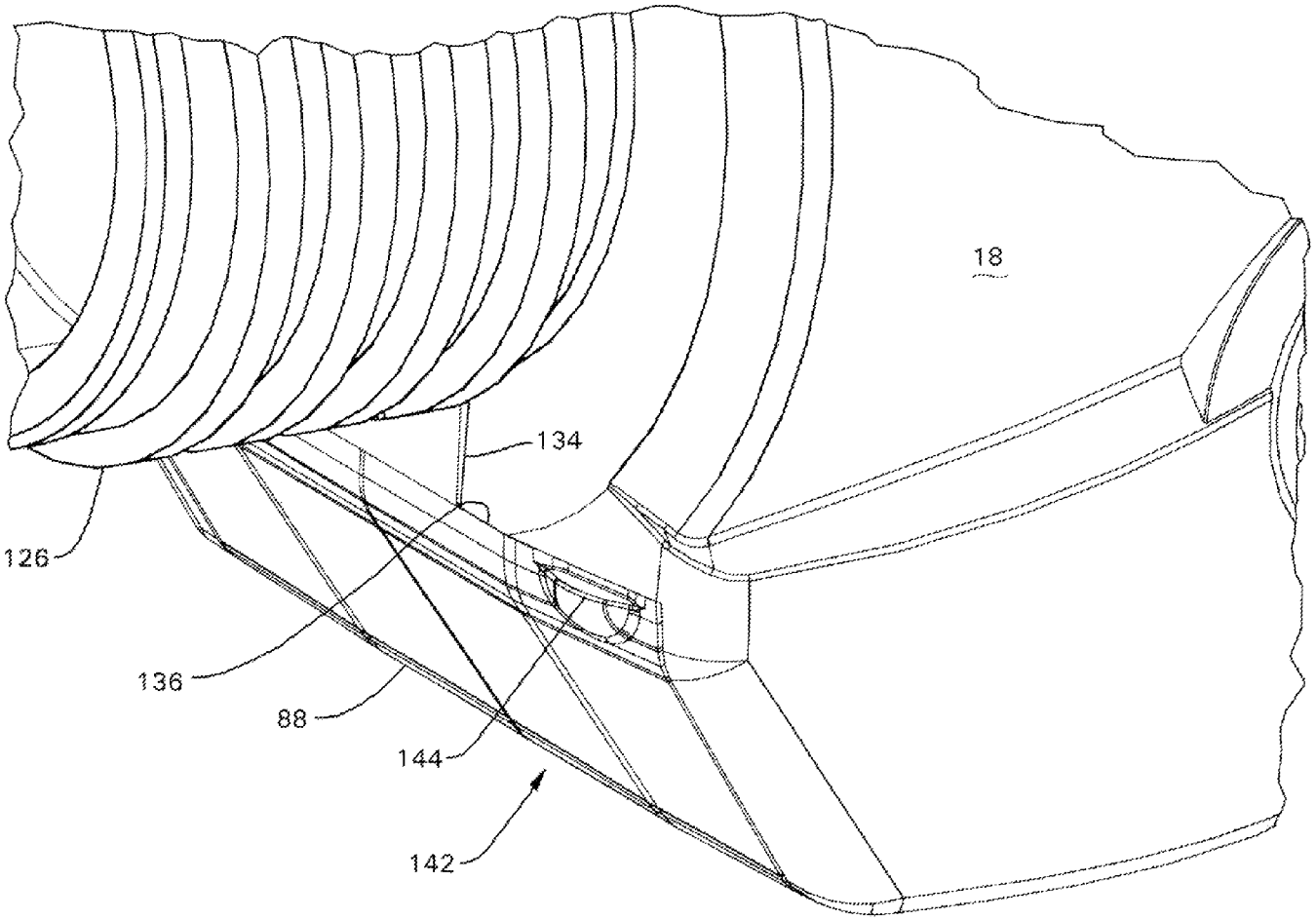
FIG. 35 is another view of the battery access door in a closed condition to illustrate details of a tab useful in opening the battery access door.
Figure 36:
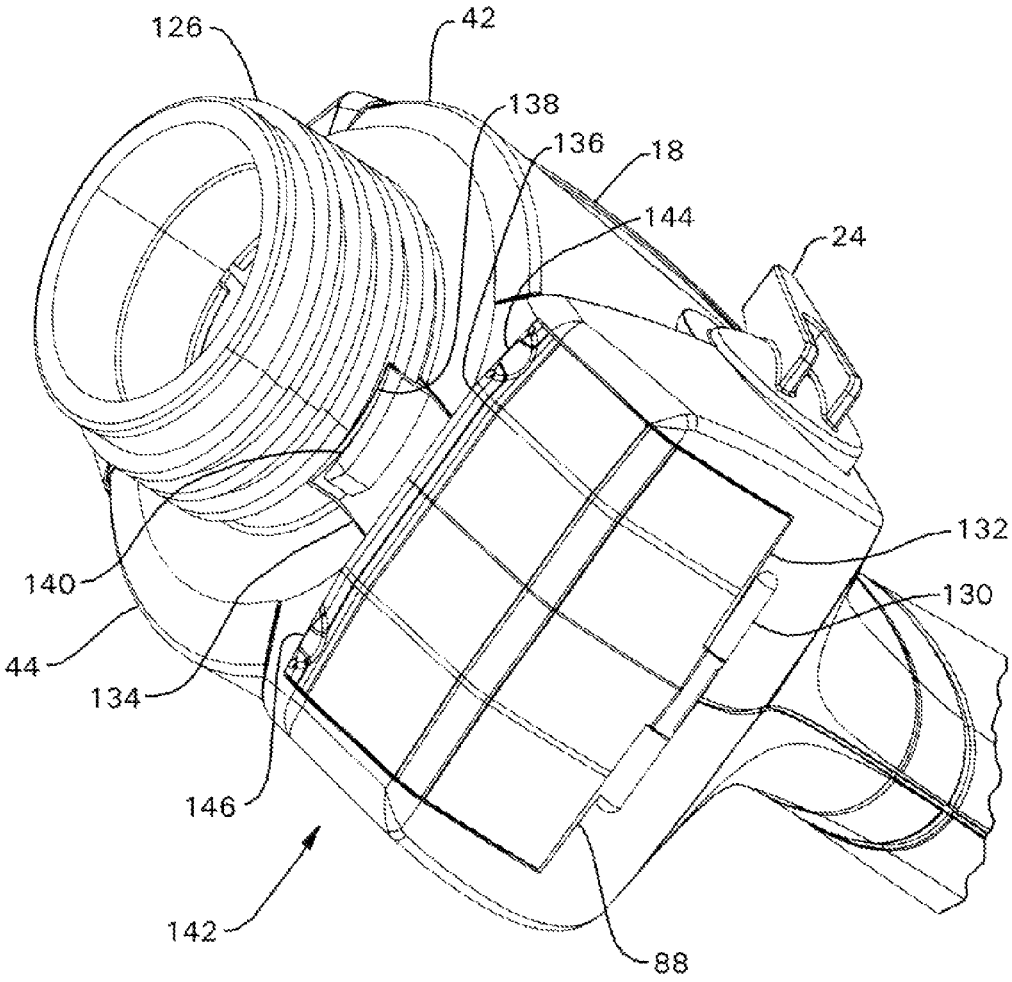
FIG. 36 is another view of the battery access door in the closed condition.

The housing 42, 44 and the projecting tab 134 on the battery access door 88 each have cooperating interfering edges 138 (on the housing) and 140 (on the tab) to retain the door 88 in a closed position 142 (as shown in FIGS. 34, 35 and 36) after the ring 128 is moved out of the way of the tab 134.

The battery access door 88 has at least one and preferably two lips 144, 146 projecting outward of the door 88 and housing 42, 44 to enable a user to open the door 88 by manually urging one or both lips 144, 146 away from the housing 42, 44. The lips 144 and 146 each provide a projecting surface extending out from the housing and door which allow a user to "lever" the door 88 open, acting against and overcoming the interference between edges 138 and 140, which otherwise hold the door 88 in the closed position 142.

Figure 37:
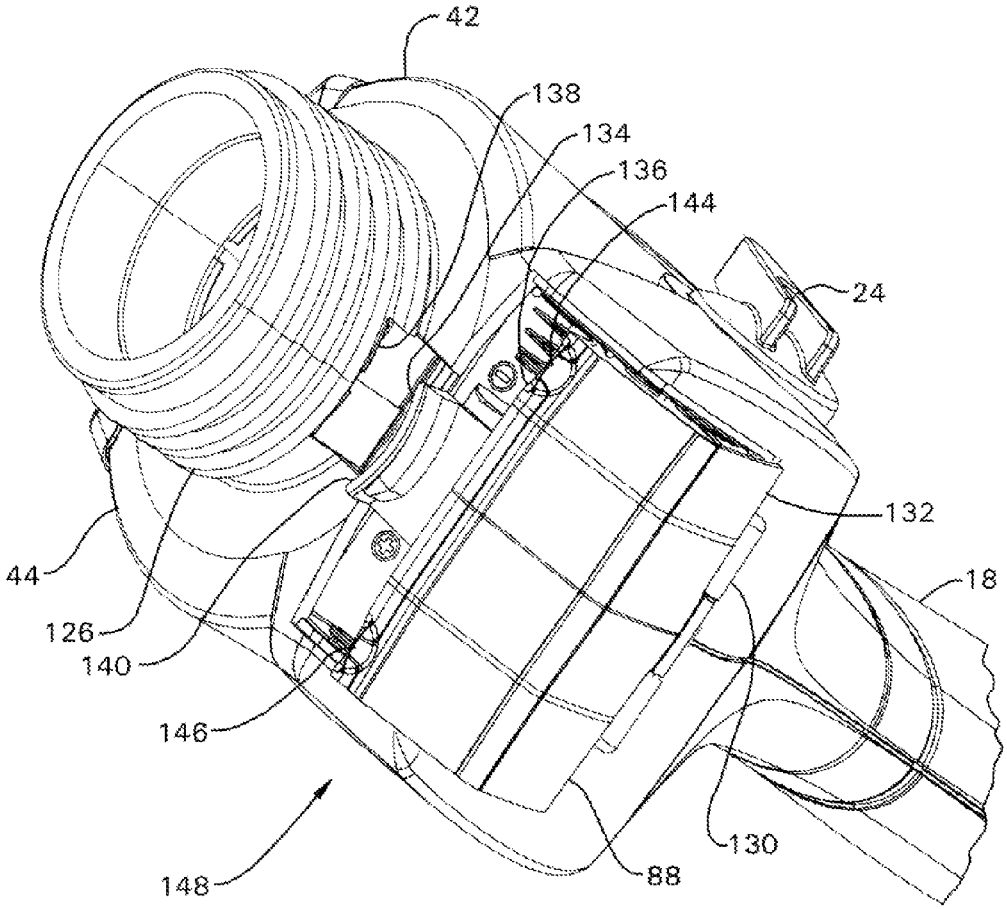
FIG. 37 is a view similar to that of FIG. 36, except with the battery access door partially open.
Figure 38:
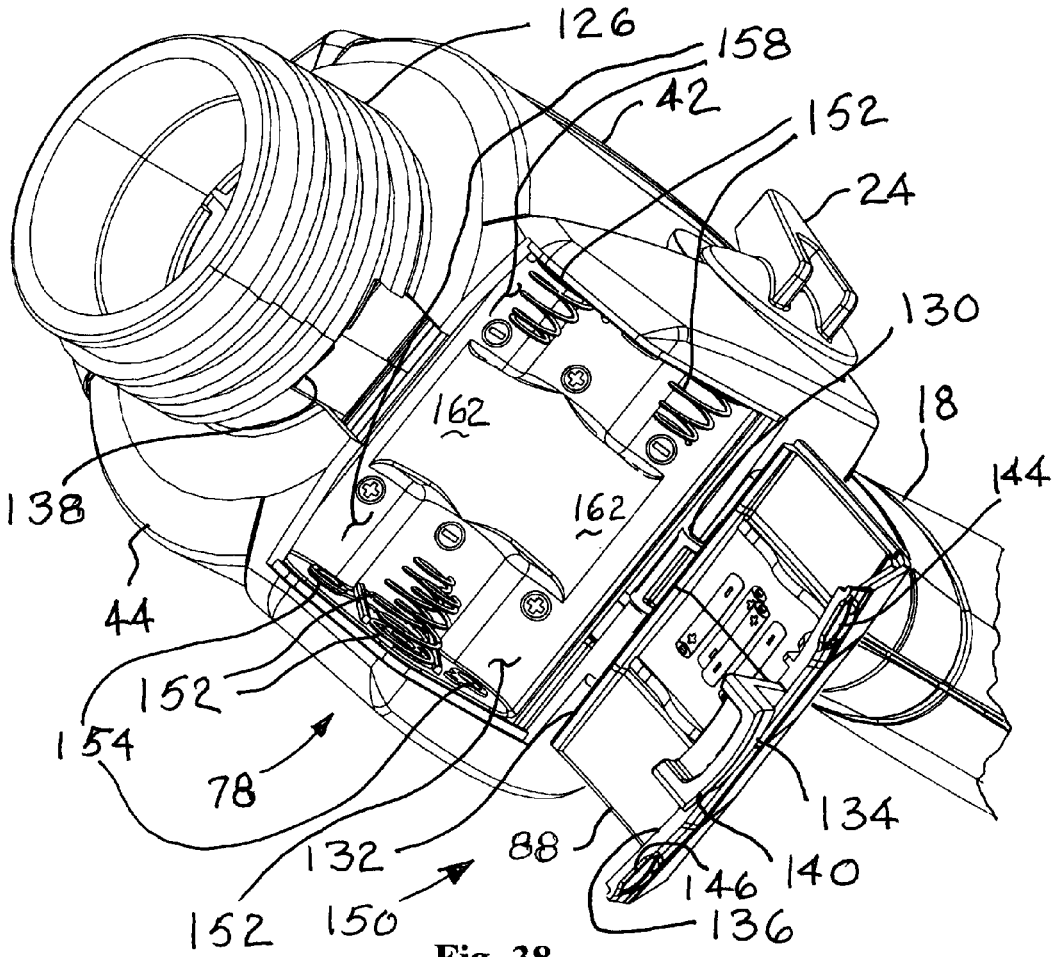
FIG. 38 is a view similar to that of FIG. 36 except with the battery access door fully open and showing certain details of the battery compartment.
Figure 39:
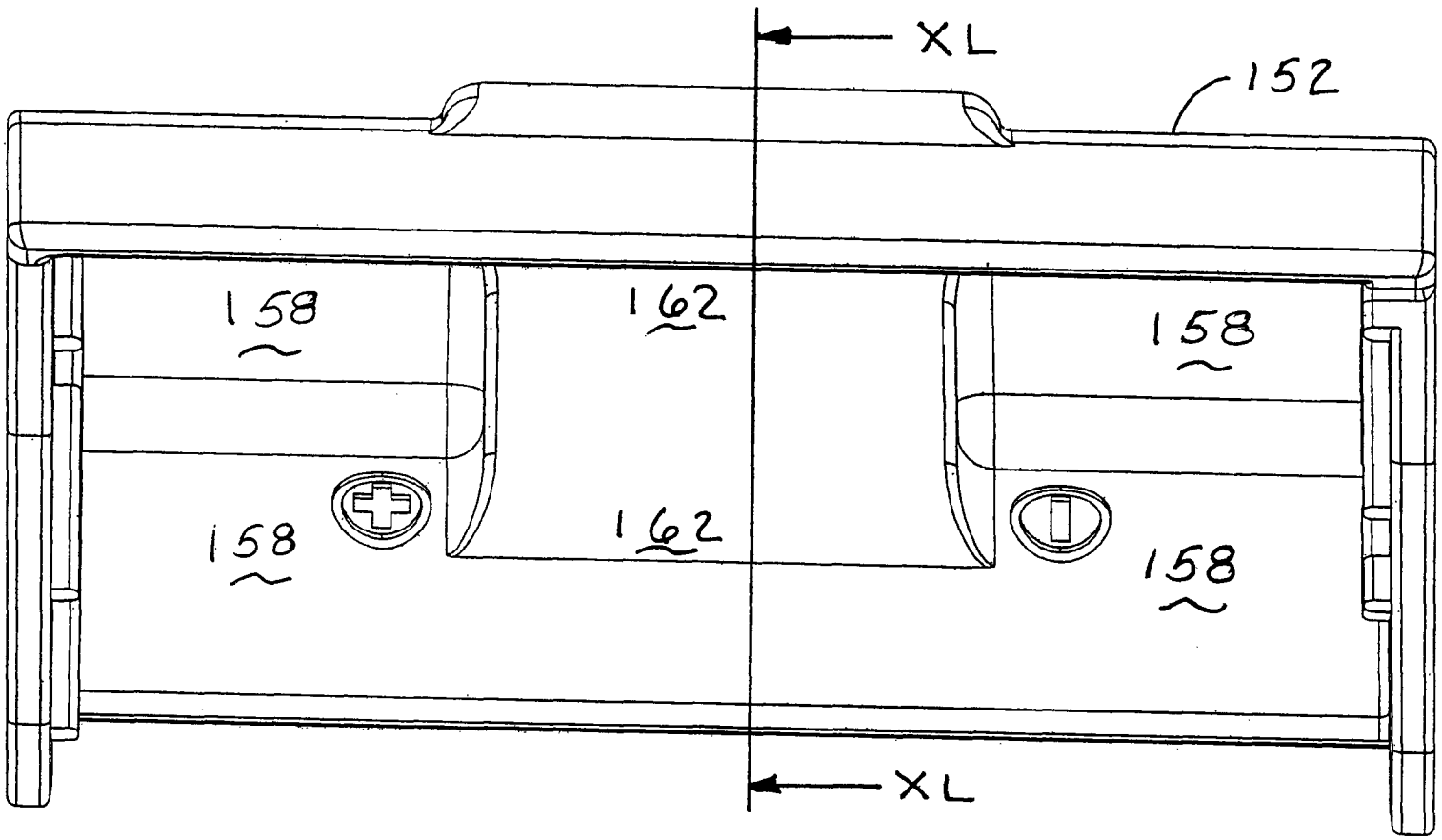
FIG. 39 is a plan view of a battery compartment frame.
Figure 40:
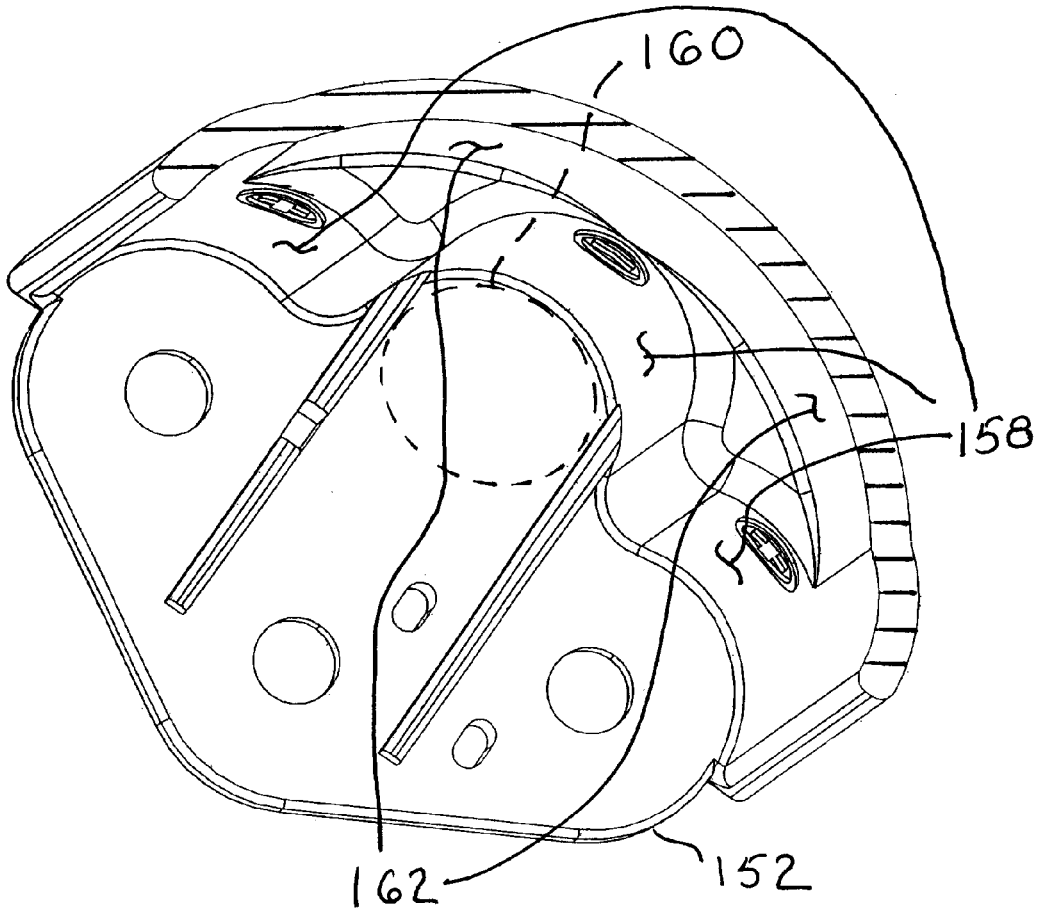
FIG. 40 is a perspective section view taken along line XL-XL of FIG. 39.
Figure 41:
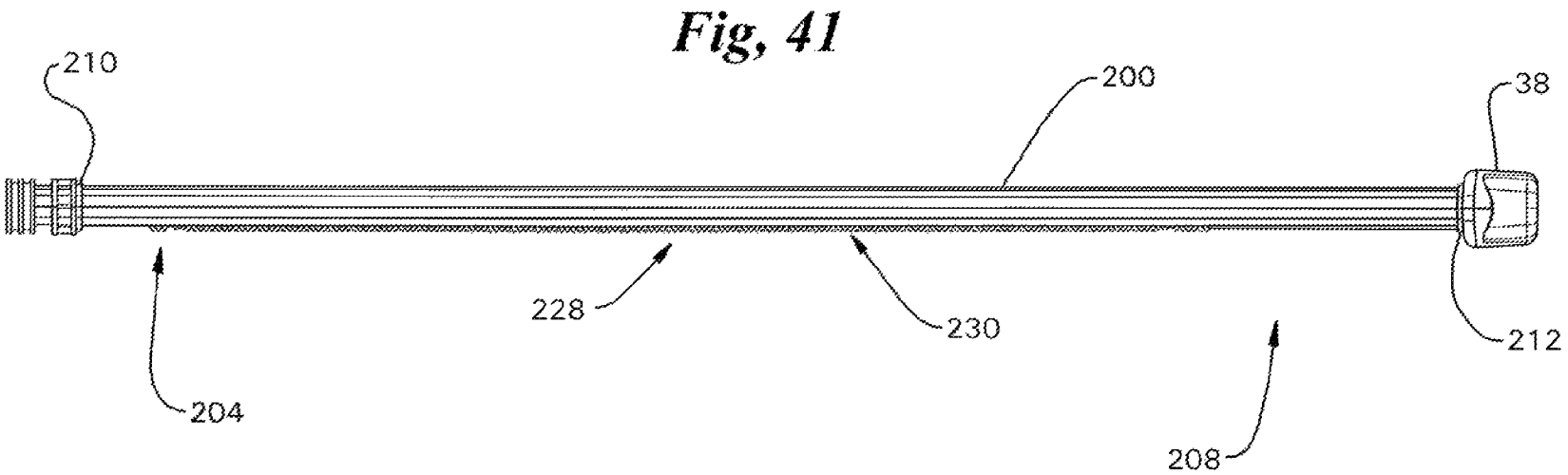
FIG. 41 is a side view of an alternative embodiment of the piston useful in the practice of the present invention.
Figure 42:
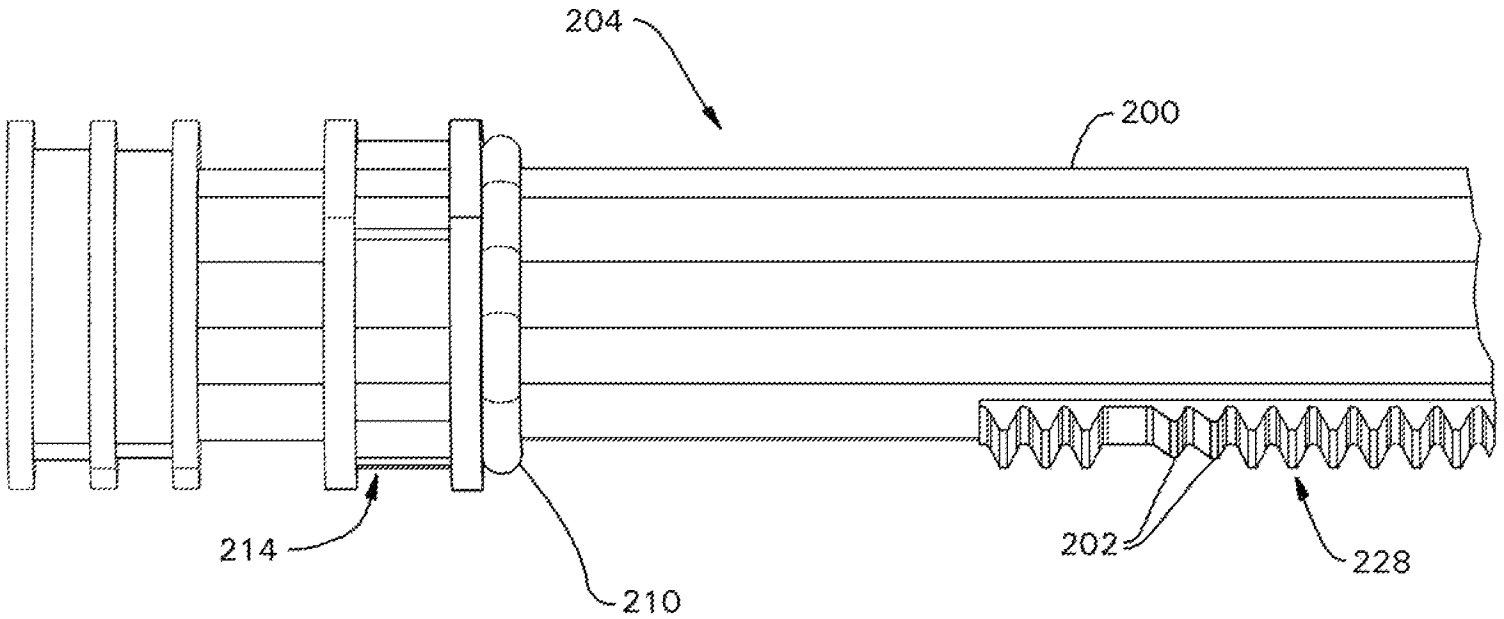
FIG. 42 is an enlarged fragmentary side view of a distal end of the piston shown in FIG. 41, rotated slightly to show details of the rack gear and an O-ring at the distal end of the piston of this embodiment.
Figure 43:
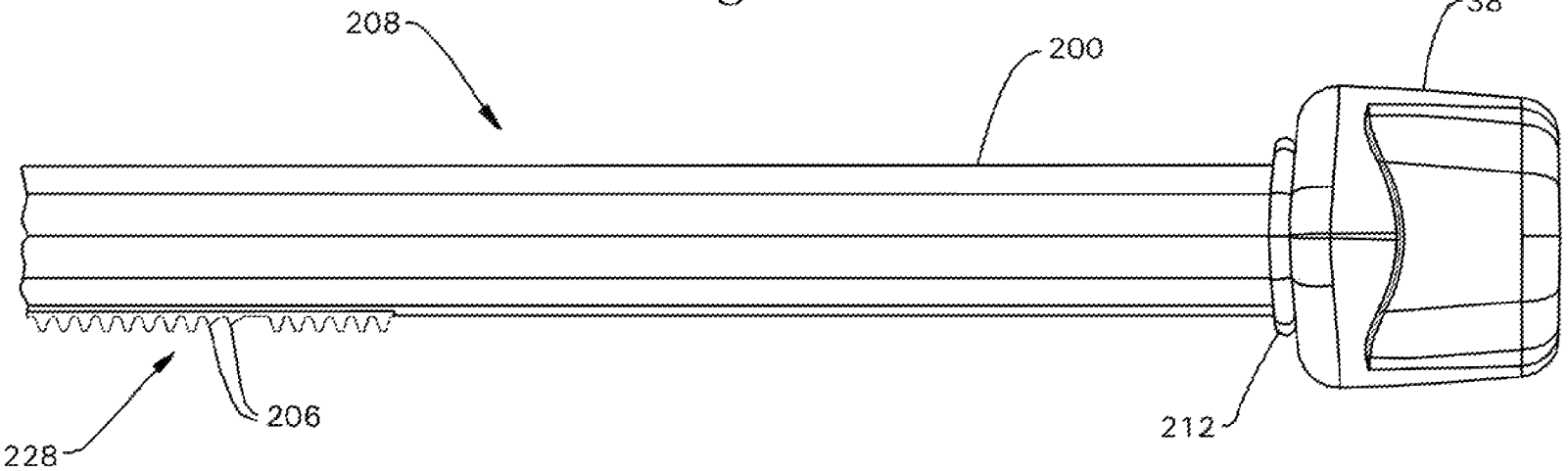
FIG. 43 is an enlarged fragmentary side view of a proximal end of the piston shown in FIG. 41.
Figure 44:
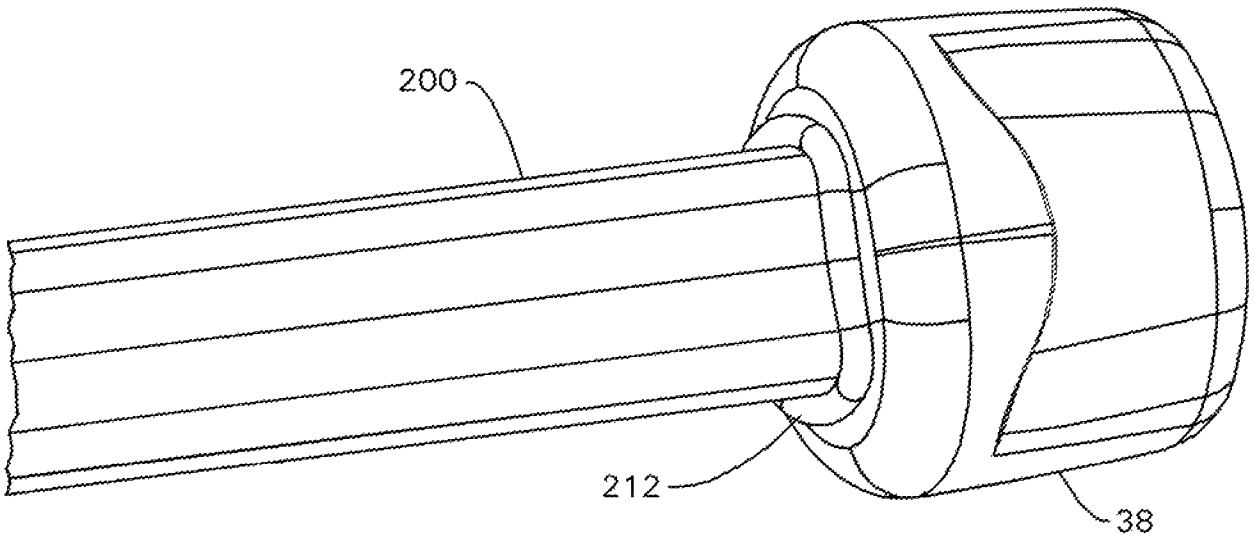
FIG. 44 is a further enlarged fragmentary perspective view of the knob shown in FIG. 43 to better illustrate an O-ring at the proximal end of the piston of this embodiment.
Figure 45:
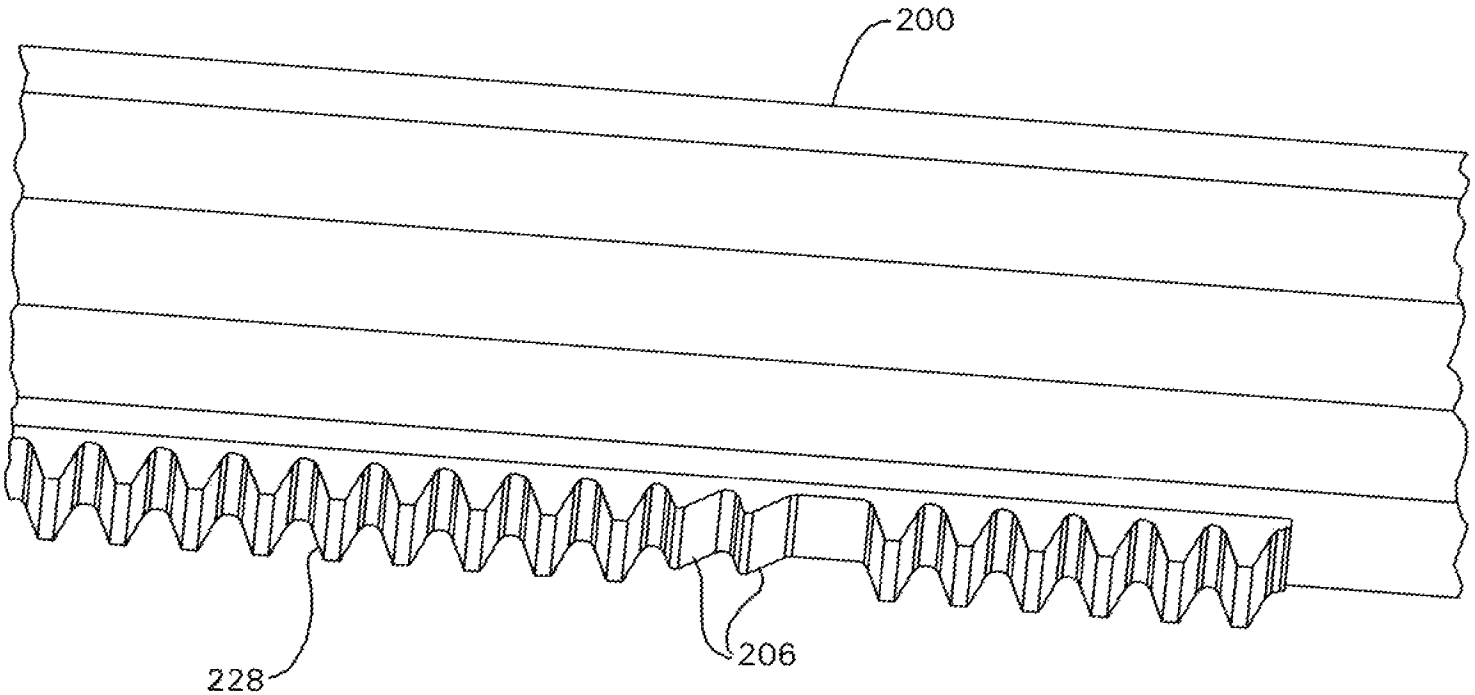
FIG. 45 is a further enlarged fragmentary view of rack gear teeth near the proximal end of the piston shown in FIG. 41, rotated to show details thereof.

FIG. 37 shows the door 88 in a slightly open position 148 in which a part of the battery compartment 78 may be seen. FIG. 38 shows the door 88 in a fully open position 150. Referring now to FIGS. 39 and 40 in addition to FIG. 38, a battery compartment frame 152. With reference to FIGS. 17 and 38, the battery compartment 78 includes frame 152 and battery contact springs 154 and battery contact rivets 154. FIGS. 39 and 40 show only the frame 152.

Referring now to FIGS. 38-40, the battery compartment frame 152 has an internal contour 158 shaped to hold at least some of the dry cells of battery 89 in desired positions within the battery compartment 78 with at least one dry cell positioned at a location 160 farthest away from the battery access door 88. The internal contour 158 has at least one and preferably two recesses 162 to allow a user to grasp the at least one dry cell located farthest away from the battery access door for removal of that dry cell.

Figure 46:
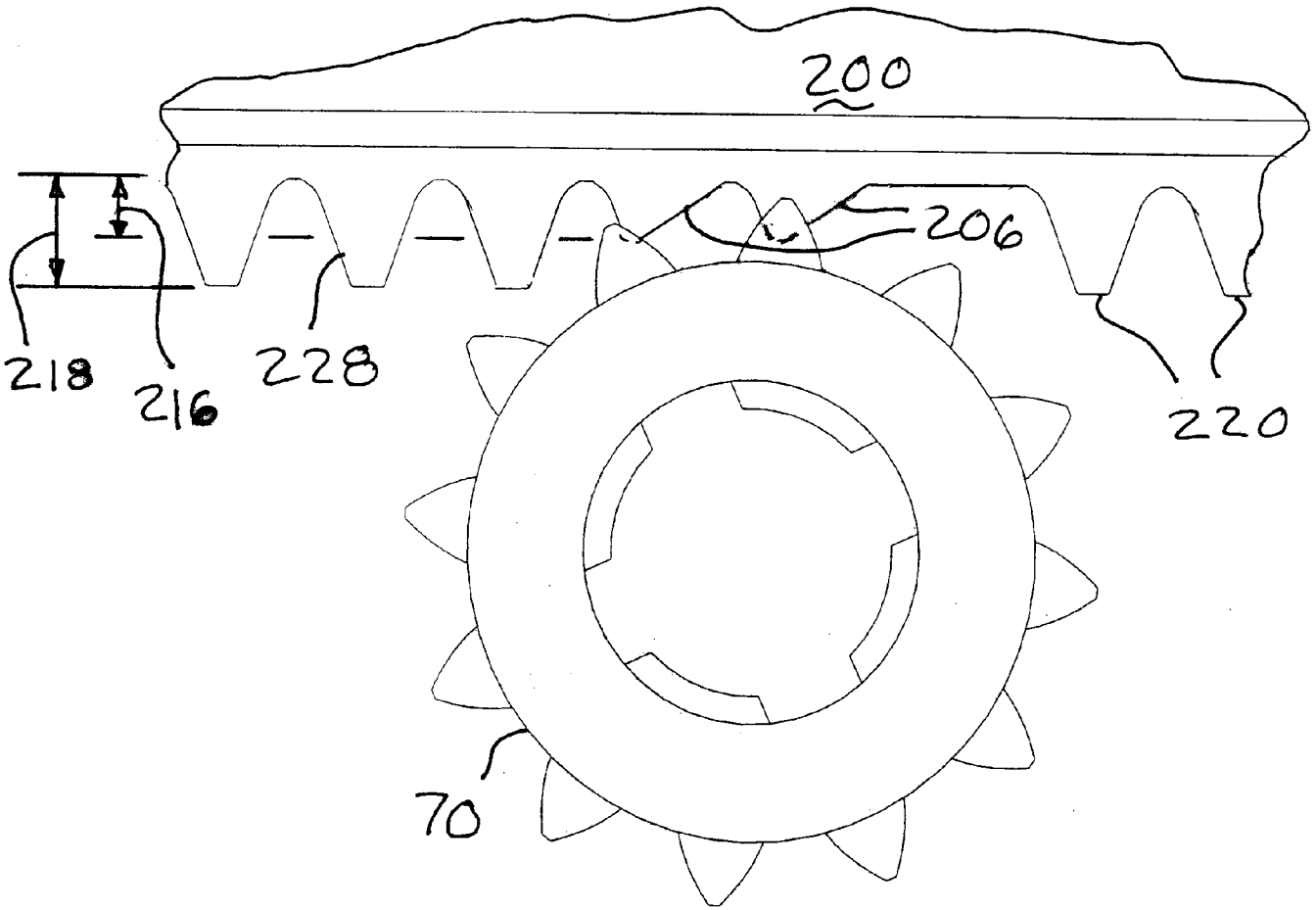
FIG. 46 is an enlarged, simplified fragmentary schematic side view of the rack gear teeth of FIG. 45 along with the pinion gear member to illustrate a certain aspect of the present invention.

Referring now to FIGS. 41 through 45, various views of an alternate embodiment of the piston 200 with a modified rack gear 228 may be seen. FIG. 46 is an enlarged, simplified fragmentary schematic side view of some of the modified rack gear teeth of FIG. 45 along with the pinion gear member 70. Piston 200 has at least one and preferably two modified profile teeth 202 at a distal end 204 and at least one and preferably two modified profile teeth 206 at a proximal end 208. Piston 200 may also have the same or a similar knob 38 at the proximal end 208.

Piston 200 also has a pair of resilient members 210, 212, each preferably in the form of an O-ring. O-ring 210 is located on piston 200 at the distal end 204 thereof such that the O-ring 210 will be compressed between an enlarged portion 214 of piston 200 and the housing 42, 44 when the piston 200 is at the end of travel in a fully retracted condition corresponding to that shown in FIG. 2. O-ring 212 is located on the piston 200 at the proximal end 208 and adjacent the knob 38 such that O-ring 212 will be compressed between knob 38 and housing 42, 44 when the piston 200 is in a fully advanced condition corresponding to that shown in FIG. 1.

Each set of the modified profile gear teeth 202 and 204 is located at respective opposite ends of travel of the piston 200 into and out of the reservoir 15, and each modified tooth has a height 216 less than a height of other teeth 220 in the rack gear 228. Each tooth of the modified profile gear teeth 202 and 204 is angled toward a central region 230 of the rack gear 228.

FIG. 46 schematically shows the relative position of the rack gear 220 and the pinion gear member 70 when the piston is advanced to the end of travel into the cylinder 14. In this condition, the pinion gear member 70 is adjacent one of the at least one modified profile teeth 206 at the proximal end 208 of the rack gear 200. When the piston is at the end of travel and the electric motor 62 drives the pinion gear member 70 in a direction to urge the piston past the end of travel, the pinion gear member 70 and rack gear 200 slip with respect to each other.

When the parts are positioned as shown in FIG. 46 and the electric motor 62 drives the pinion gear member 70 in the opposite direction to move the piston away from the end of travel and towards the central region 230 of the rack gear, the pinion gear member 70 initially engages at least one of the modified profile teeth and drives the piston away from the end of travel, subsequently engaging the unmodified profile teeth 220 of the rack gear 200.

A similar operation will occur when the piston is at the other end of travel, as illustrated in FIG. 2.

The resilient member 212 located between the piston 200 and the housing 42, 44, at the proximal end or region 208 and adjacent the knob 38 will act as a spring to assist the subsequent engagement of the piston gear member 70 with the unmodified profile teeth 220 when the motor 62 drives the piston away from the end of travel and towards the central region 230. Resilient member 210 will act in a similar manner when the piston 220 is at the other end of travel (corresponding to the condition shown in FIG. 2) and the motor 62 drives the piston 220 towards the central region 230.

Figures 47, 48:
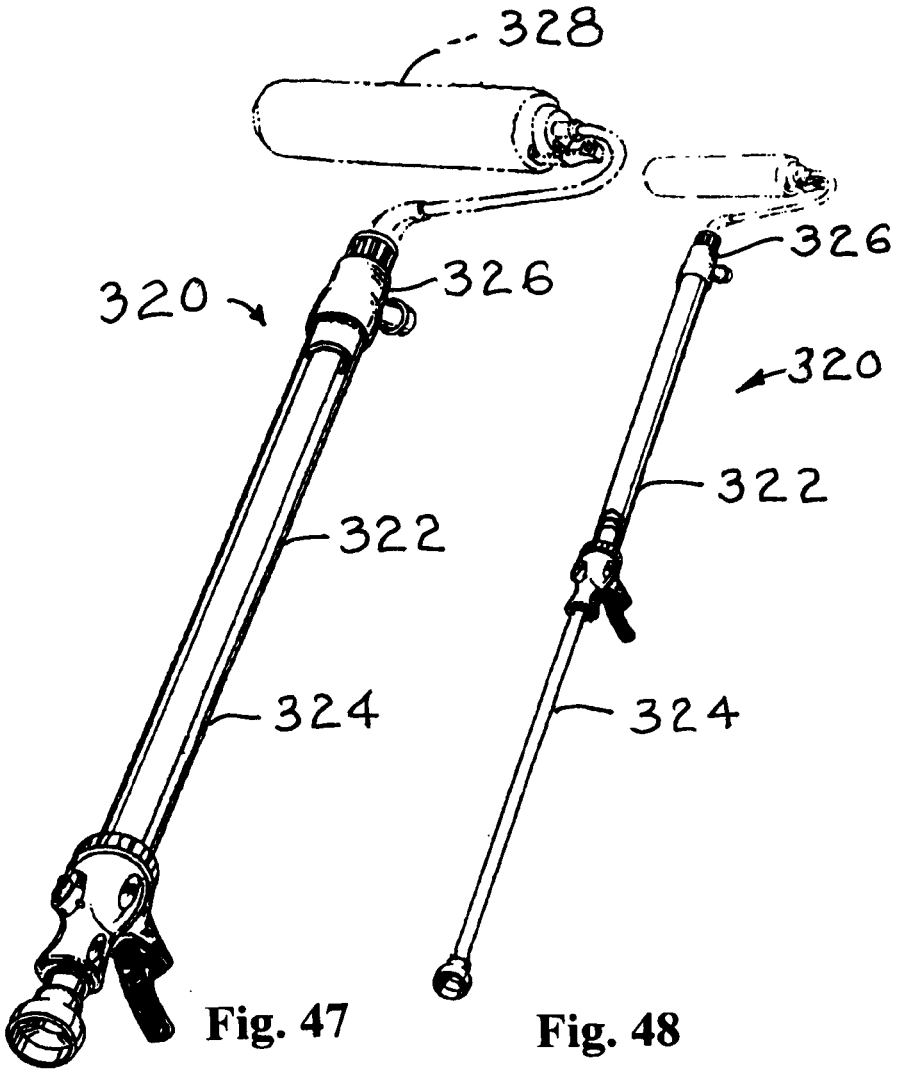
Fig. 47 PRIOR ART
Fig. 48 PRIOR ART
FIG. 47 is a perspective view of a prior art manually operated single piston internal feed paint roller applicator, with a roller head shown in phantom.
FIG. 48 is a perspective view of the prior art applicator of FIG. 47, except on a reduced scale and showing a piston fully telescoped out of a reservoir in the handle of the applicator.
Figure 49:
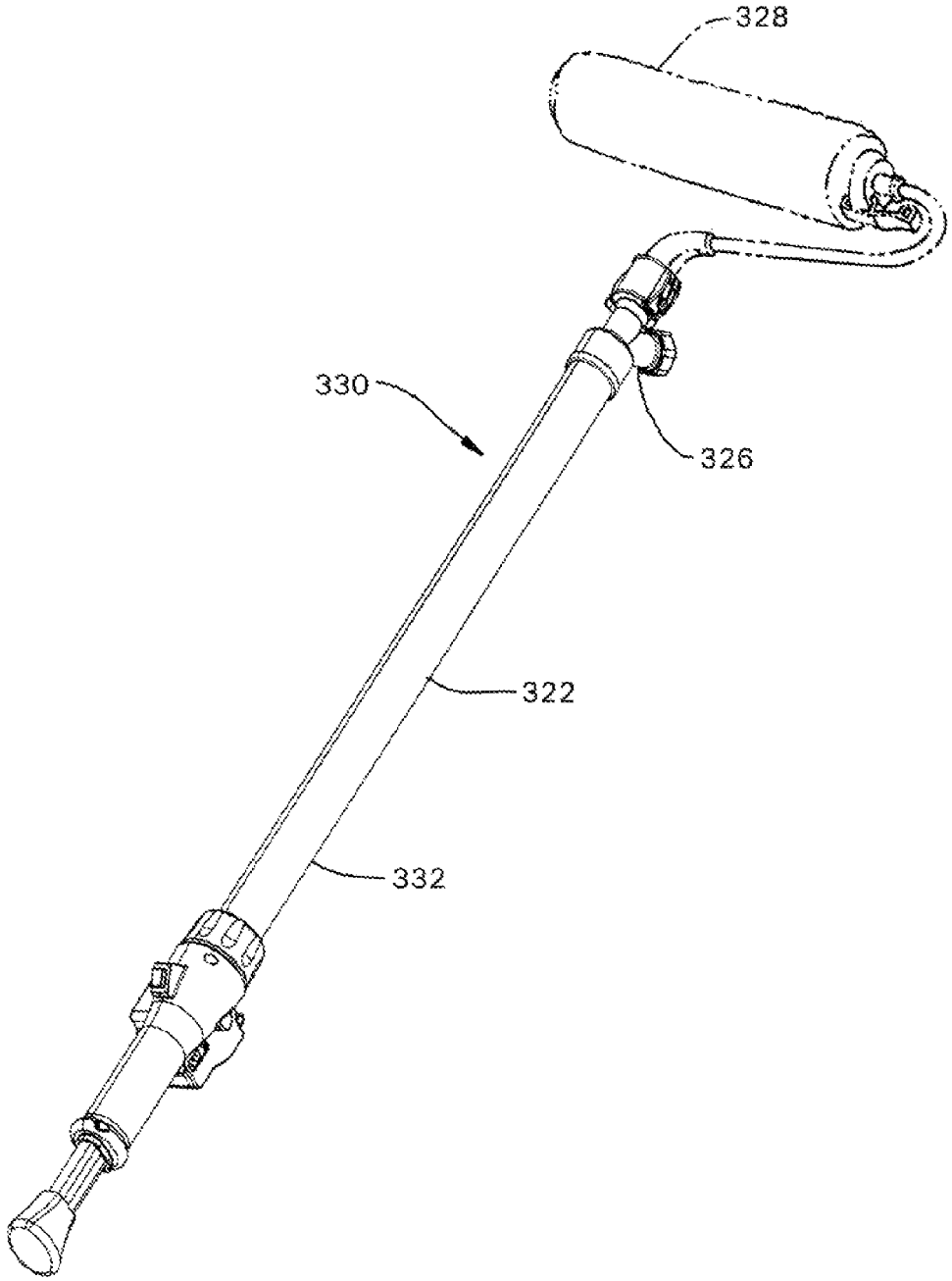
FIG. 49 is a perspective view of an alternative embodiment of a liquid applicator assembly useful in the practice of the present invention with a roller head shown in phantom.
Figure 50:
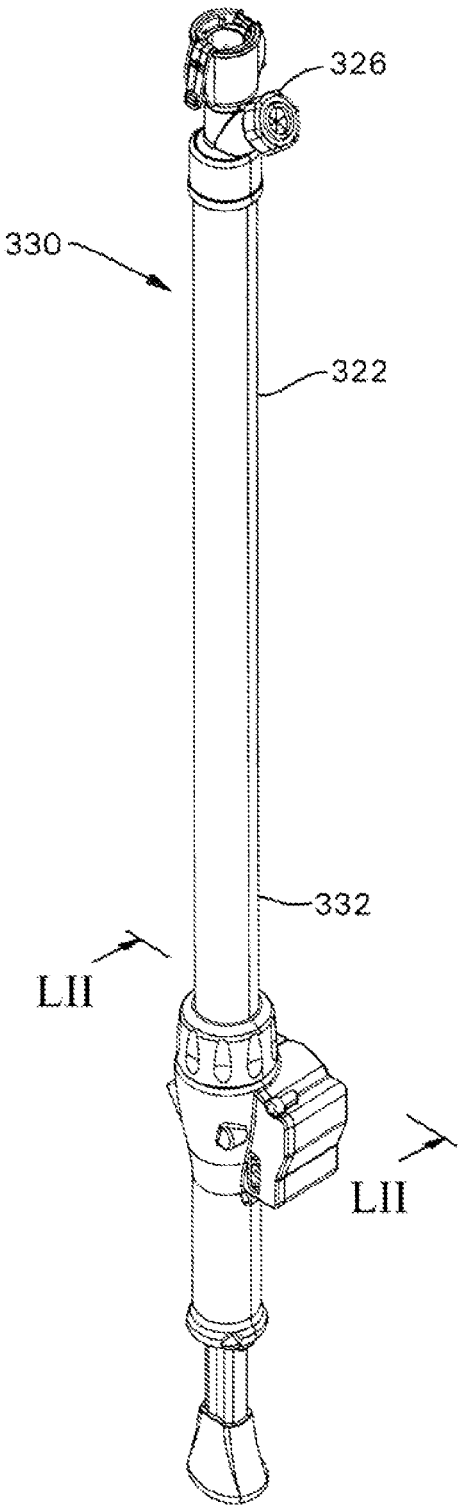
FIG. 50 is another perspective view of the assembly of FIG. 49.
Figure 51:
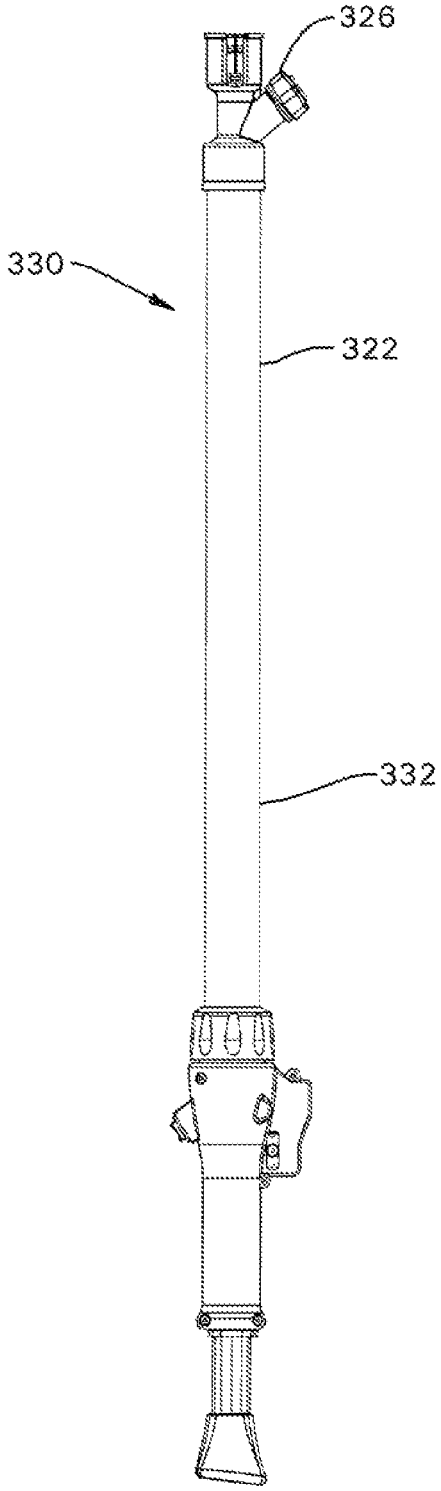
FIG. 51 is a side view of the assembly of FIG. 49.
Figure 52:
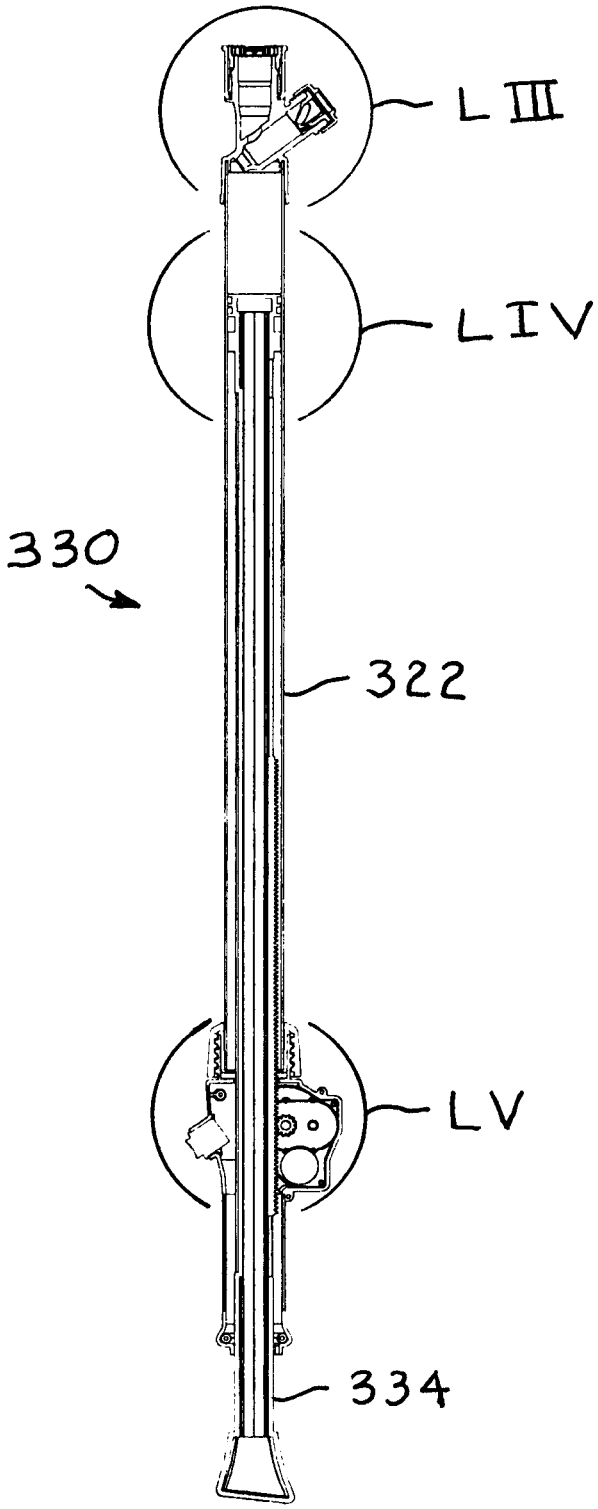
FIG. 52 is a section view taken along line LII-LII of FIG. 50.
Figure 53:
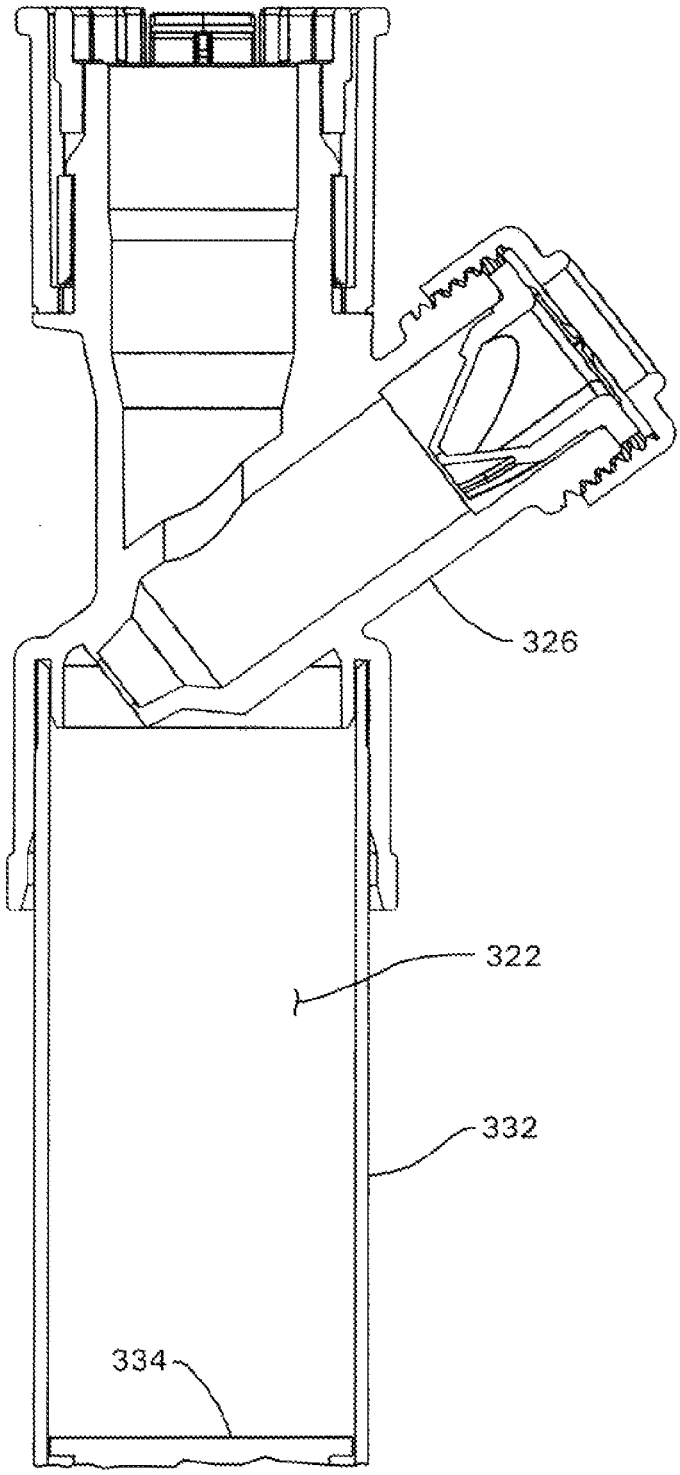
FIG. 53 is an enlarged view of detail LIII of FIG. 52.
Figure 54:
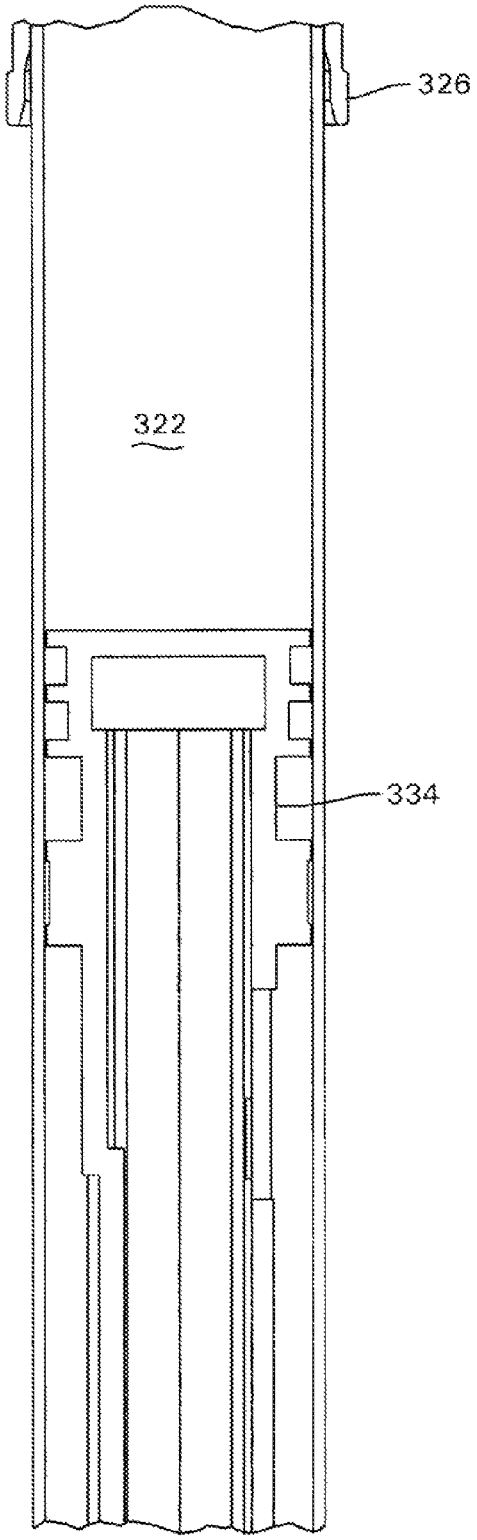
FIG. 54 is an enlarged view of detail LIV of FIG. 52.

Referring now to FIGS. 47-61, and most particularly to FIGS. 47 and 48, a prior art paint applicator 320 may be seen. This applicator is sold by Wagner Spray Tech Corporation under the PAINT MATE trademark. Applicator 320 is shown in a fully collapsed state in FIG. 47 and (in a reduced scale) in a fully extended state in FIG. 48. Because applicator 320 has a non collapsible paint reservoir 322, the fully extended state is generally twice the characteristic length of the applicator reservoir in the fully collapsed state. Applicator 320 also has a paint applicator head such as a roller head assembly 328. Alternatively, a paint pad assembly (not shown) may be used in place of the roller head assembly 328.

In operation, a user fills the reservoir 322 by drawing a piston 324 back to load the reservoir with paint while the inlet valve 326 is in communication with a fill tube (not shown) connected to a source of paint, such as a conventional one gallon paint can or container (not shown).

Referring now to FIGS. 49-61, and most particularly to FIGS. 49-55, in an alternative embodiment (as well as in the embodiments of the present invention described supra) the present invention provides an advantage over the prior art by providing a battery powered liquid applicator assembly 330. The applicator assembly 330 may use the same roller head assembly 328 (or a pad assembly, not shown), and the same inlet valve 326. A cylindrical wall 332, together with inlet valve 326 and a piston assembly 334 forms the paint reservoir 322.

Figure 55:
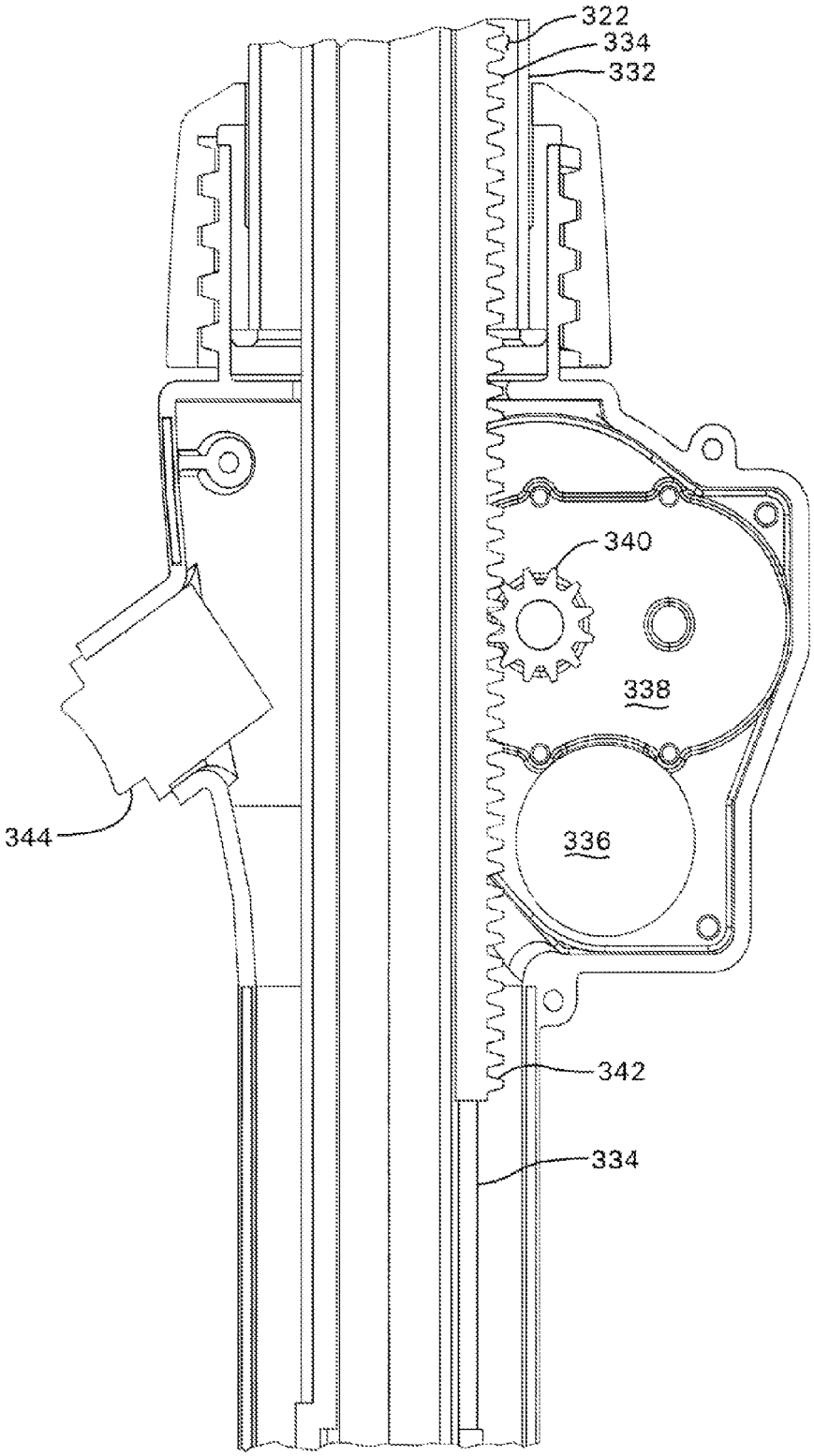
FIG. 55 is an enlarged view of detail LV of FIG. 52.
Figure 56:
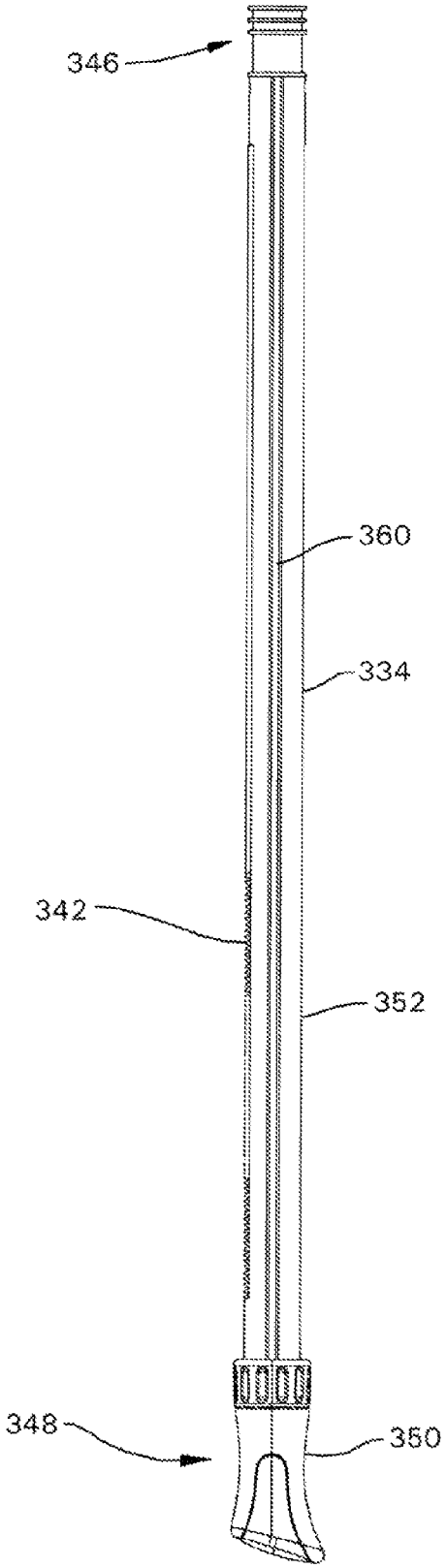
FIG. 56 is a side view of a piston assembly useful in the practice of the present invention with this embodiment.
Figure 57:
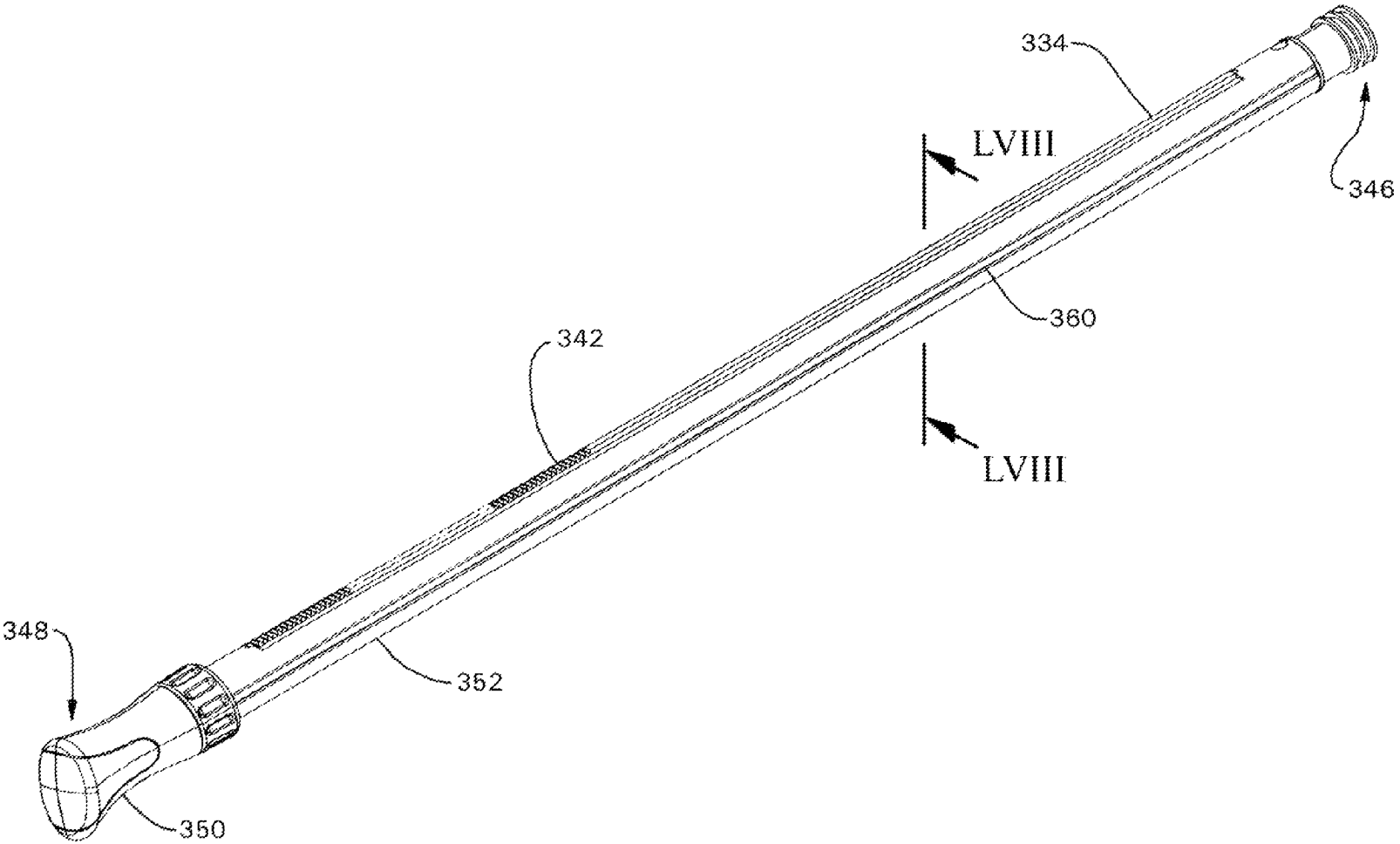
FIG. 57 is a perspective view of the piston assembly of FIG. 56.
Figure 58:
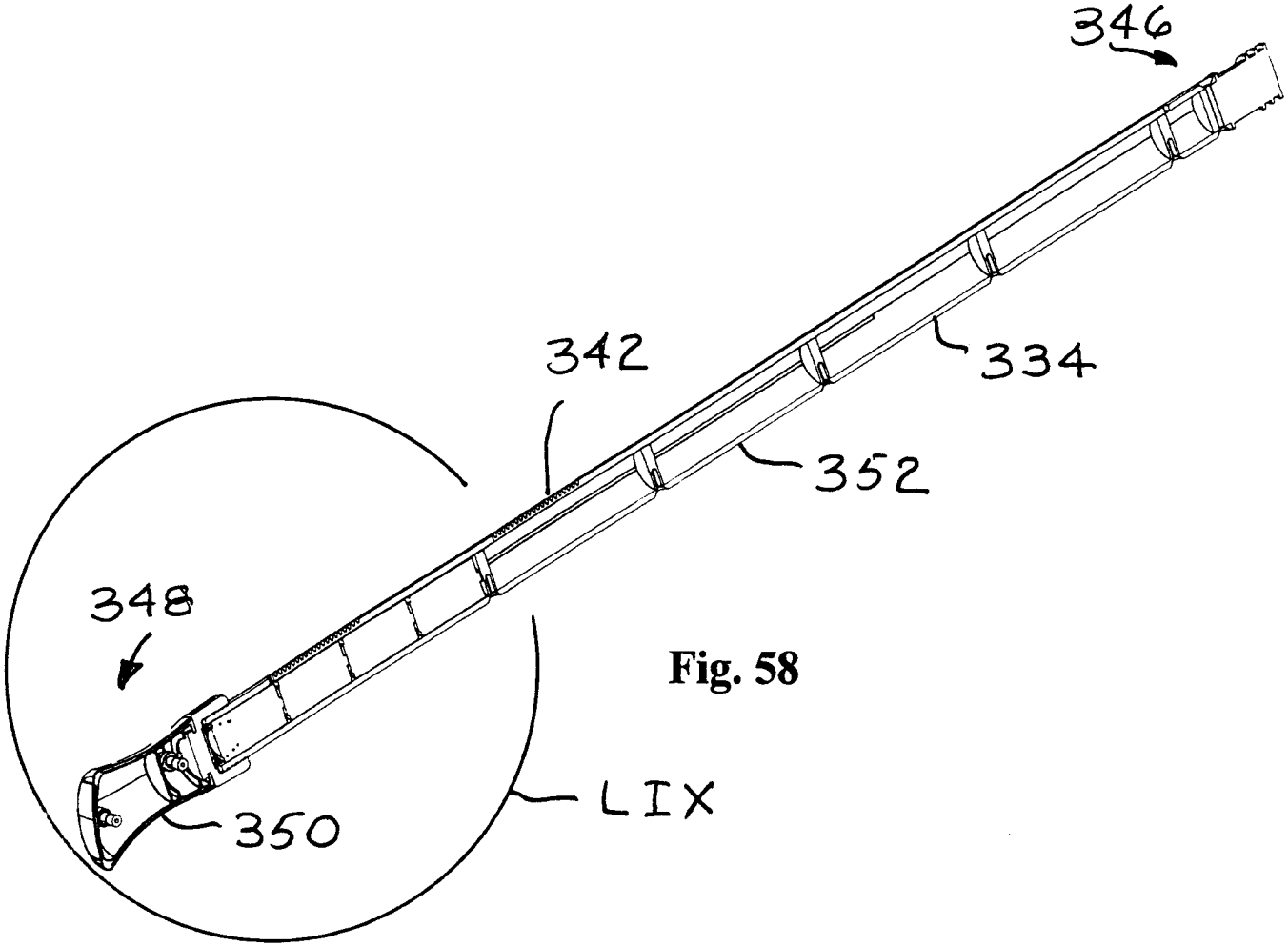
FIG. 58 is a section view of the piston assembly taken along line LVIII-LVIII of FIG. 57.
Figure 59:
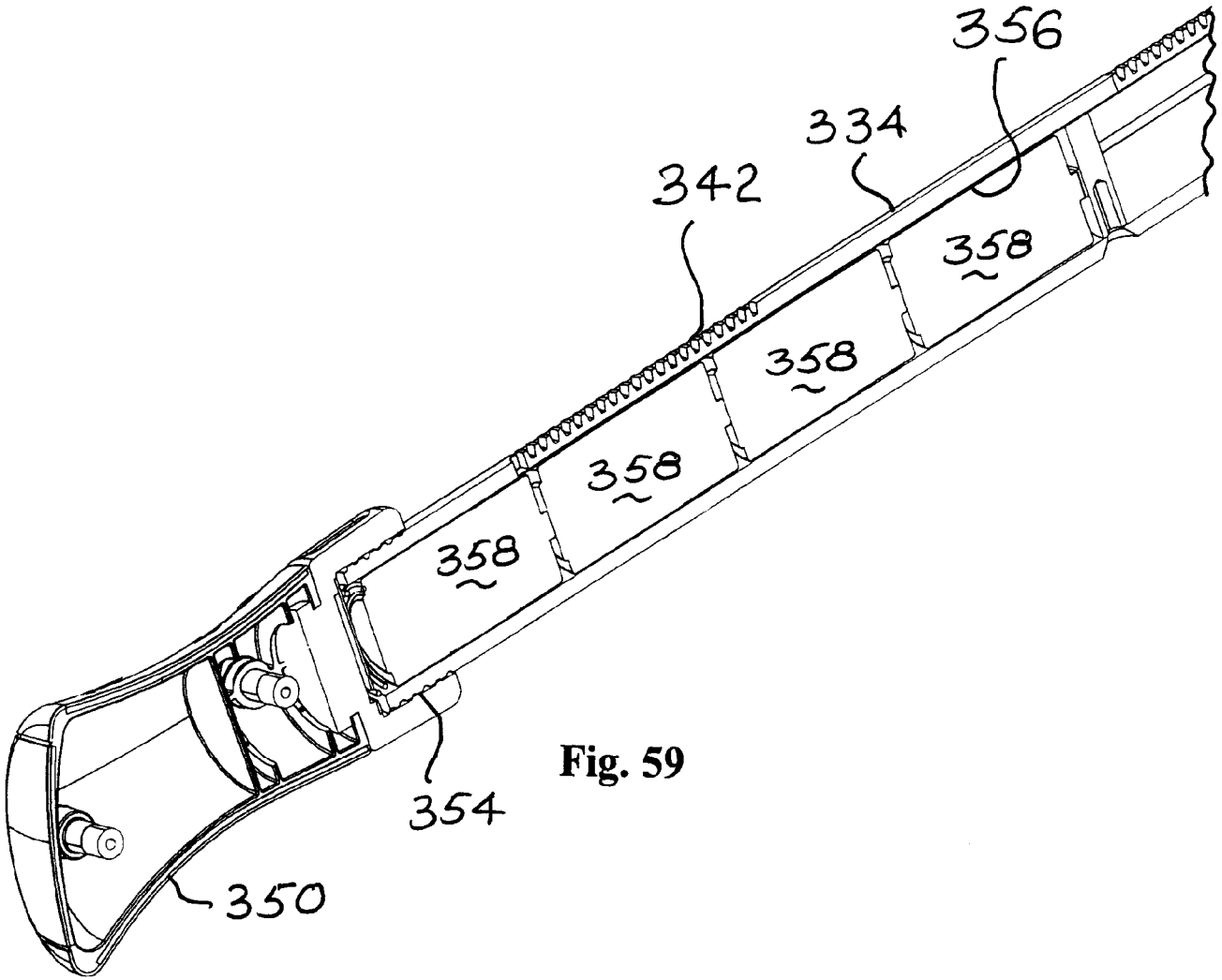
FIG. 59 is an enlarged view of detail LIX of FIG. 11.

Referring most particularly to FIG. 55, a motor 336 drives a gear reducer 338 with an output gear 340 engaged with a rack gear 342. It is to be understood that rack gear 342 is mounted on the piston assembly 334. An electrical switch 344 preferably has both forward and reverse ON positions, along with an OFF position when not depressed. In the forward ON position electrical power is applied to the motor with one polarity causing the output gear 340 to rotate clockwise as shown in FIG. 55. This causes the piston assembly to move into the reservoir 322, as would be desired when a user triggers the switch 344 to call for more liquid (such as paint) to be delivered to the roller head assembly 328. When sufficient material is delivered to the roller (or other paint applicator, not shown) attached to the assembly 330, the user may release the switch 344, allowing the switch to move to the OFF position.

To fill the reservoir of the assembly 330, the switch may be depressed to the reverse ON position, it being understood that the switch 344 may be a rocker type switch, with positions corresponding to forward ON-OFF-reverse ON. With the switch in the reverse ON position, the electrical power is applied with reverse polarity to the motor 336, causing the output gear 340 to rotate counterclockwise as shown in FIG. 55, and further causing the rack gear to pull the piston assembly out of the liquid reservoir, causing a vacuum which will draw liquid material in through the inlet valve when it is connected to an appropriate material source (such as a one gallon paint container, not shown) through a siphon tube, not shown.

Referring now to FIGS. 56-59, various views of the piston assembly 334 may be seen. It is to be understood that piston assembly 334 has a pair of O-rings (not shown) at a distal end 346 to seal the piston against cylindrical wall 332. Piston assembly 334 has a proximal end 348 with a handle 350 connected to a piston wall 352 by threads 354. Handle 350 may be removed from piston wall 352 by unscrewing the handle from the wall at the threads 354. Doing so provides a user with access to a battery compartment 356 within the piston wall 352. A plurality of batteries 358 may be installed in battery compartment, much like loading a flashlight with batteries. As shown, the batteries 358 are connected in series, with an anode electrical connection of the batteries coupled to a conductive strip 360 fastened to and extending longitudinally along an exterior of the piston wall 352. A cathode connection from the batteries 358 is coupled to a similar or identical conductive strip fastened to the piston wall 352 diametrically opposite the strip 360. A pair of brushes (not shown) or other sliding electrical contacts (not shown) mounted in the region of the motor 336 and gear reducer 38 provide electrical connection to the conductive strips, and maintain connection throughout the operating range of longitudinal travel of the piston assembly 334.

Figure 60:
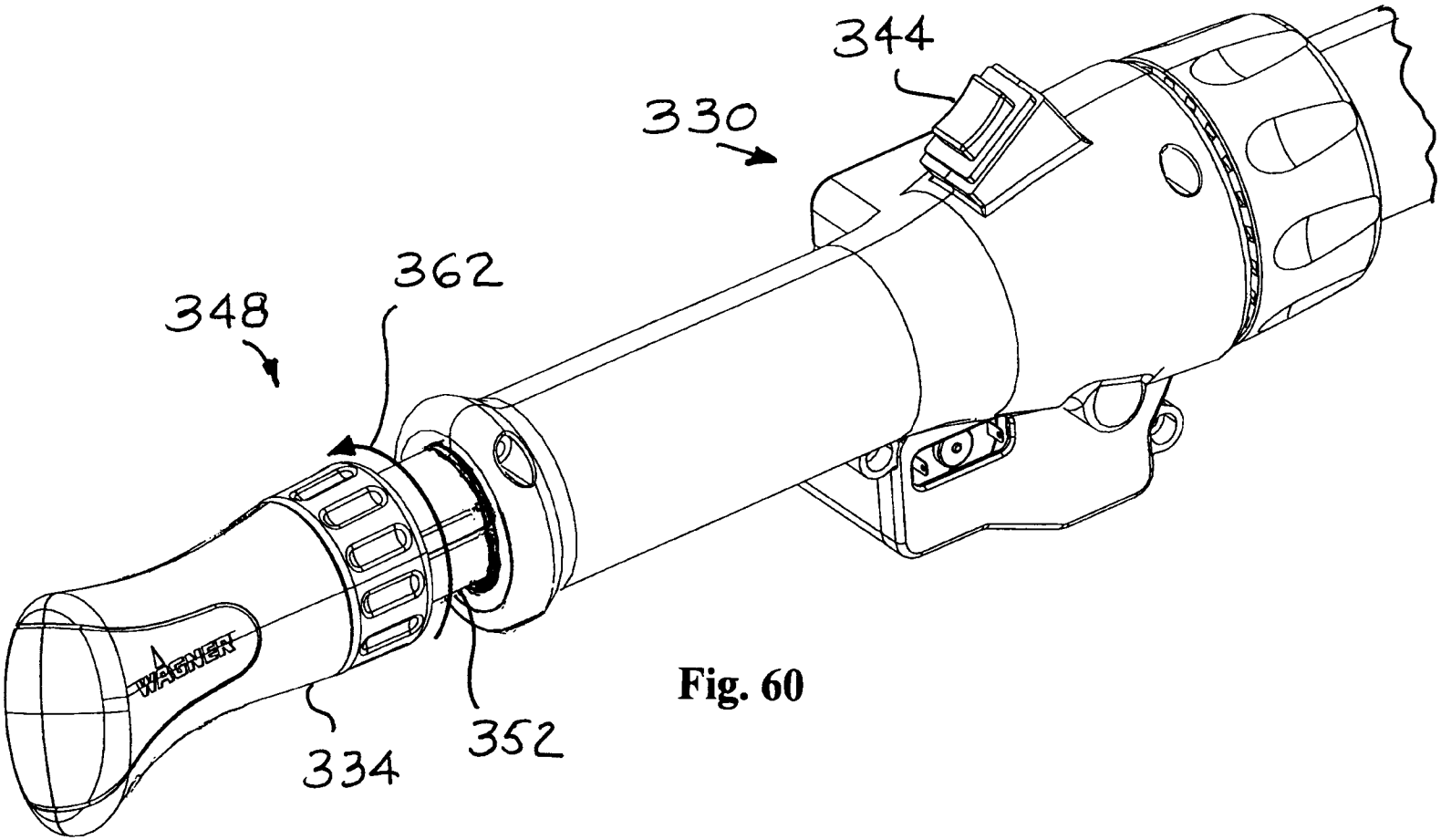
FIG. 60 is an enlarged fragmentary view of an end portion of the liquid applicator of FIG. 49, showing the piston assembly oriented for powered operation.
Figure 61:
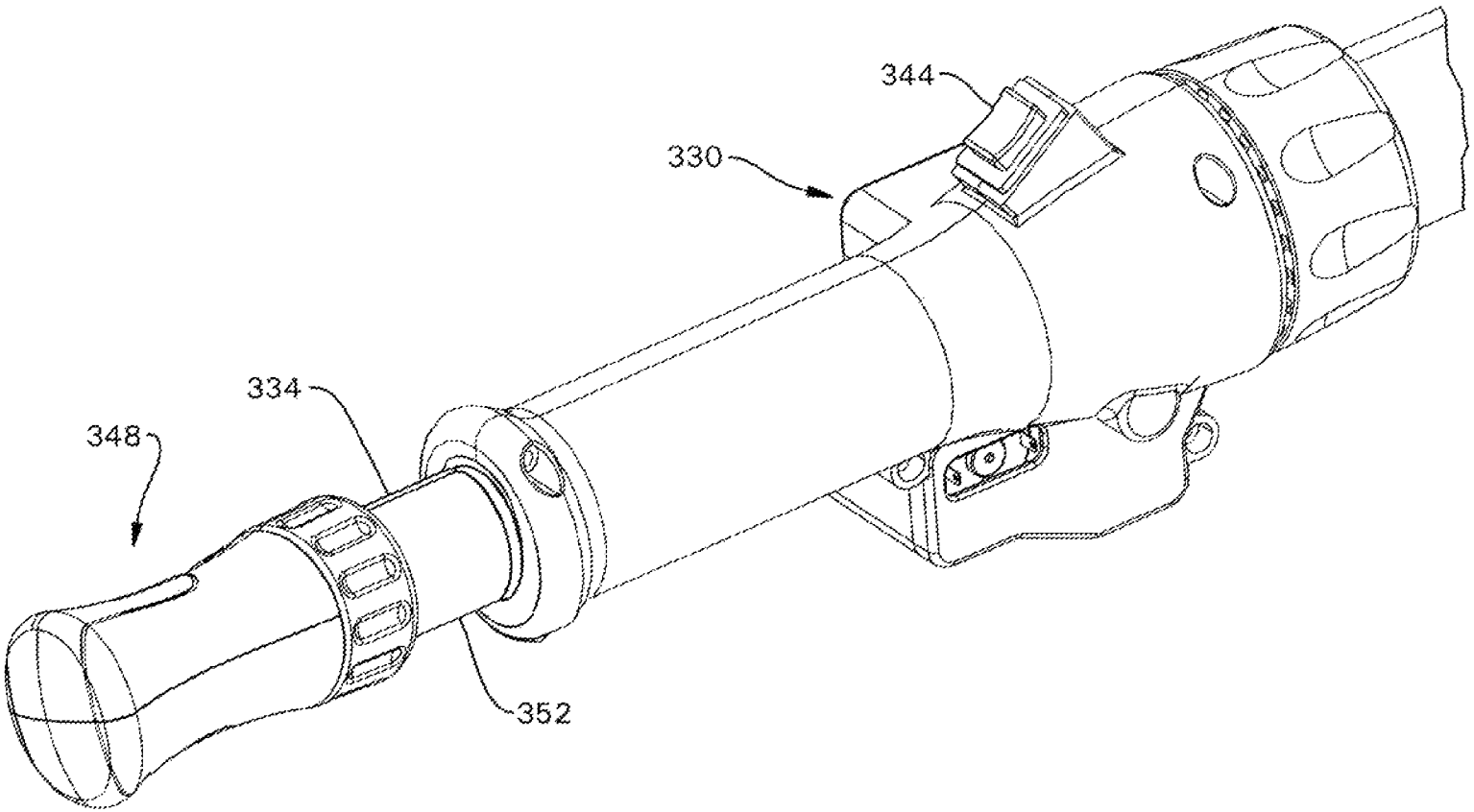
FIG. 61 is a view similar to that of FIG. 60, except with the piston assembly rotated 90 degrees from the position shown in FIG. 60, for manual operation.

Referring now to FIGS. 60 and 61, in the event that the batteries 358 are discharged or unavailable, a user may rotate the piston assembly 334 in the direction of arrow 362, disengaging rack gear 342 from output gear 340. Once the assembly 330 is in this condition, illustrated by FIG. 61, a user may manually move the piston assembly 334 in or out of the reservoir 322, to continue applying coating material without using the electrically powered aspect of the assembly 330.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof. For example, and not by way of limitation, with respect to this embodiment, batteries 358 may be either rechargeable or not. If rechargeable, batteries 358 may be recharged in the assembly 330 or removed and recharged in a separate charger. Furthermore, a battery pack may replace the plurality of individual batteries, while still remaining within the scope of the present invention. As a still further optional alternative, batteries may be dispensed with entirely, and assembly 330 arranged in a conventional manner to operate as a corded tool, taking power through an electrical power cord connected to house mains, typically in the USA, at 115 VAC, 60 Hz. Other voltages and frequencies may be used in the practice of the present invention, as well. It is to be understood that the same modifications and variations as described with respect to this embodiment may be made to the embodiment described previously. Furthermore, other modifications and additions can be made to the exemplary embodiments discussed without departing from the scope of the present invention. For example, while the embodiments described above refer to particular features, the scope of this invention also includes embodiments having different combinations of features and embodiments that do not include all of the described features.

What is claimed is:

1. A hand held, internal feed coating apparatus comprising:

an on-board coating reservoir having an outlet;

a coating applicator connected to the outlet of the coating reservoir;

an internal piston including a rack gear operable to move the internal piston to deliver coating material to the outlet of the reservoir; and a drive mechanism including:

an electric motor; and an engagement mechanism having a pinion gear member rotatably driven by the electric motor and selectively engageable with the rack gear; and a gear shifter operable to move the pinion gear member, relative to the rack gear, into and out of engagement with the rack gear wherein the motor is operable to move the piston to deliver coating material when the motor is energized and the gear shifter holds the pinion gear member in engagement with the rack gear and the piston is free to move independently of the pinion gear member when the gear shifter holds the pinion gear member out of engagement with the rack gear.

2. The apparatus of claim 1 further comprising at least one electrical dry cell selectively electrically connectable to the electric motor and an electrical switch connected between the at least one electrical dry cell and the electric motor, the electrical switch including means for selecting a direction of motion of the motor.

3. The apparatus of claim 1 wherein the pinion gear member includes a flange and the gear shifter is formed by a pair of axial shifter halves with a recess receiving the flange for controlling an axial position of the pinion gear member.

4. The apparatus of claim 1 wherein the engagement mechanism includes a guide ring preventing rotational motion of the gear shifter.

5. The apparatus of claim 1 wherein the pinion gear member includes a flange and the engagement mechanism includes:

a pair of axial shifter halves each having a depending recess receiving the flange for controlling an axial position of the pinion gear member and each having a radially outwardly directed projection and each having a radially inwardly directed projection, a guide ring having a pair of axially oriented channels, with each channel receiving one of the radially outwardly directed projections to prevent rotational motion of the pair of axial shifter halves while allowing axial motion thereof, and a selector switch having a pair of helical grooves, with each groove receiving one of the radially inwardly directed projections such that rotation of the selector switch causes axial motion of the pair of shifter halves and the pinion gear member between an engaged position and a disengaged position with respect to the rack gear.

6. The apparatus of claim 5 wherein the gear shifter has an internal wall and the engagement mechanism further includes a spring located between the selector switch and the internal wall biasing the axial shifter halves away from the selector switch.

7. The apparatus of claim 5 further comprising a housing enclosing the drive mechanism and wherein the selector switch is journaled for rotation in the housing.

8. The apparatus of claim 7 further comprising a detent mechanism located between the selector switch and the housing for retaining the selector switch in a first predetermined angular position with respect to the housing.

9. The apparatus of claim 8 wherein the detent mechanism comprises a recess on one of the selector switch and housing and a mating protuberance on the other of the selector switch and housing such that the protuberance is received in the recess when the selector switch is in the first predetermined angular position with respect to the housing.

10. The apparatus of claim 9 wherein the selector switch holds the pinion gear member out of engagement with the rack gear when the selector switch is in the first predetermined angular position and the selector switch is movable to a second predetermined angular position in which the pinion gear member is engaged with the rack gear.

11. A hand held, internal feed coating apparatus comprising:

an on-board coating reservoir having an outlet;

a coating applicator connected to the outlet of the coating reservoir;

an internal piston including a rack gear operable to move the internal piston to deliver coating material to the outlet of the reservoir; and a drive mechanism including:

an electric motor; and an engagement mechanism having a pinion gear member rotatably driven by the electric motor and selectively engageable with the rack gear; and a selector switch connected to a gear shifter operable to selectively move the pinion gear member into and out of engagement with the rack gear;

wherein the motor is operable to move the piston to deliver coating material when the motor is energized and the gear shifter holds the pinion gear member in engagement with the rack gear and the piston is free to move independently of the drive mechanism when the gear shifter holds the pinion gear member out of engagement with the rack gear.

12. A hand held, internal feed coating apparatus comprising:

an on-board coating reservoir having an outlet;

a coating applicator connected to the outlet of the coating reservoir;

an internal piston including a rack gear operable to move the internal piston to deliver coating material to the outlet of the reservoir, wherein the rack gear includes at least one modified profile tooth located at each of the ends of travel of the piston into and out of the reservoir; and a drive mechanism including:

an electric motor; and an engagement mechanism having a pinion gear member rotatably driven by the electric motor and selectively engageable with the rack gear; and a gear shifter operable to move the pinion gear member into and out of engagement with the rack gear;

wherein the motor is operable to move the piston to deliver coating material when the motor is energized and the gear shifter holds the pinion gear member in engagement with the rack gear and the piston is free to move independently of the drive mechanism when the gear shifter holds the pinion gear member out of engagement with the rack gear, and wherein the pinion gear member is adjacent one of the at least one modified profile tooth when the piston is at the end of travel and the pinion gear member and rack gear slip with respect to each other when the electric motor drives the pinion gear member in a direction to urge the piston past the end of travel.

13. The apparatus of claim 12, the at least one modified profile tooth having a height less than a height of other teeth in the rack gear and wherein each modified profile tooth is angled towards a central region of the rack gear.

14. The apparatus of claim 13 wherein the pinion gear member engages at least one of the modified profile teeth when the piston is at the end of travel and the electric motor drives the pinion gear member in a direction to move the piston away from the end of travel.

15. The apparatus of claim 12 further comprising a housing enclosing the electric motor, engagement mechanism and battery compartment and a pair of resilient members located between the piston and housing, with one resilient member of the pair located between a distal portion of the piston and the housing, and the other member of the pair located between a proximal portion of the piston and the housing.

* * * * *

UNITED STATES PATENT AND TRADEMARK OFFICE

CERTIFICATE OF CORRECTION

PATENT NO. : 8,439,586 B2
APPLICATION NO. : 12/811405
DATED : May 14, 2013
INVENTOR(S) : Jeffrey E. Sandahl and Timothy J. Wessels It is certified that error appears in the above-identified patent and that said Letters Patent is hereby corrected as shown below:

In the Specifications:

Column 1:

At line 7 (Cross Reference to Related Application section), delete "60/019,448" and insert -- 61/019,448 --

Signed and Sealed this
Third Day of September, 2013

Teresa Stanek Rea
*Acting Director of the United States Patent and Trademark Office*